US011015275B2

(12) United States Patent
James et al.

(10) Patent No.: US 11,015,275 B2
(45) Date of Patent: May 25, 2021

(54) METHOD OF QUILTING LAYERED INPUT WEB

(71) Applicant: L&P Property Management Company, South Gate, CA (US)

(72) Inventors: Michael James, Davie, FL (US); Terrance L. Myers, Joplin, MO (US); Matthew C. Smallwood, Webb City, MO (US)

(73) Assignee: L&P Property Management Company, South Gate, CA (US)

( * ) Notice: Subject to any disclaimer, the term of this patent is extended or adjusted under 35 U.S.C. 154(b) by 302 days.

(21) Appl. No.: 16/205,927

(22) Filed: Nov. 30, 2018

(65) Prior Publication Data

US 2020/0173080 A1 Jun. 4, 2020

(51) Int. Cl.

| | |
|---|---|
| ***D05B 11/00*** | (2006.01) |
| ***D05B 57/02*** | (2006.01) |
| ***D05B 39/00*** | (2006.01) |
| ***D05B 19/00*** | (2006.01) |

(52) U.S. Cl.

CPC ..... *D05B 11/00* (2013.01); *D05B 19/00* (2013.01); *D05B 39/005* (2013.01); *D05B 57/02* (2013.01)

(58) Field of Classification Search

CPC ..... D05B 11/00; D05B 57/32; D05B 57/02; D05B 39/005; D05B 19/00; D05B 19/12

See application file for complete search history.

(56) References Cited

U.S. PATENT DOCUMENTS

| | | | | |
|---|---|---|---|---|
| 29,268 | A | 7/1860 | Hicks | |
| 3,406,647 | A | 10/1968 | Rohrlick et al. | |
| 3,465,697 | A * | 9/1969 | Gerlach | D05B 11/00 112/118 |
| 3,635,785 | A | 1/1972 | Hughes | |
| 3,903,714 | A | 9/1975 | Horeni et al. | |
| 4,327,653 | A | 5/1982 | Blessing | |
| 4,651,658 | A * | 3/1987 | Vogel | D05B 11/00 112/118 |
| 4,735,568 | A | 4/1988 | Izumisawa et al. | |
| 5,154,130 | A | 10/1992 | Gribetz et al. | |
| 5,224,856 | A | 7/1993 | Nakamura | |
| 5,799,599 | A | 9/1998 | Tsukioka et al. | |

(Continued)

FOREIGN PATENT DOCUMENTS

WO 2019106453 6/2019

*Primary Examiner* — Tajash D Patel

(74) *Attorney, Agent, or Firm* — Wood Herron & Evans LLP

(57) ABSTRACT

Apparatuses, methods, and computer program products for quilting webs without compressing the webs. A quilting machine includes a needle bar to which needles are attached, needle thread passing through each needle, a looper shaft to which loopers are attached, a looper corresponding to each needle and from which looper thread is provided to form stitches, and a retainer bar to which spreaders are attached to facilitate stitching. A drive pulley powered by a first servo motor rotates cranks to move the needles through a cycle and rotates a belt which rotates an indexer pulley. Rotation of the indexer pulley oscillates the looper shaft and reciprocates the retainer bar. Another drive pulley powered by a second servo motor operates to move an input web through the machine between chain stiches.

20 Claims, 54 Drawing Sheets

(56) References Cited

U.S. PATENT DOCUMENTS

| | | | | |
|---|---|---|---|---|
| 6,145,456 | A | 11/2000 | Codos | |
| 6,178,903 | B1 * | 1/2001 | Bondanza | D05B 1/10 112/117 |
| 6,187,411 | B1 | 2/2001 | Palmer | |
| 7,143,705 | B2 * | 12/2006 | Frazer | D05B 19/14 112/117 |
| 2002/0104468 | A1 | 8/2002 | Myers et al. | |
| 2003/0164129 | A1 * | 9/2003 | Kaetterhenry | D05B 33/00 112/475.08 |
| 2004/0129189 | A1 | 7/2004 | Oxley et al. | |
| 2006/0180068 | A1 | 8/2006 | Marcangelo | |
| 2007/0261620 | A1 | 11/2007 | James et al. | |
| 2008/0245283 | A1 * | 10/2008 | Landoni | D05B 11/00 112/115 |
| 2008/0289551 | A1 | 11/2008 | Stutznacker et al. | |
| 2011/0165397 | A1 | 7/2011 | Roe et al. | |
| 2015/0202839 | A1 | 7/2015 | Kawashima | |
| 2016/0235213 | A1 | 8/2016 | Long | |
| 2016/0265150 | A1 | 9/2016 | Landoni | |
| 2017/0009388 | A1 | 1/2017 | Meiners et al. | |
| 2017/0334153 | A1 | 11/2017 | Wilson et al. | |
| 2018/0327949 | A1 | 11/2018 | James et al. | |
| 2018/0327950 | A1 | 11/2018 | James et al. | |

* cited by examiner

METHOD OF QUILTING LAYERED INPUT WEB

FIELD OF THE INVENTION

This invention relates to quilting, and particularly, to high-speed quilting machines.

BACKGROUND

Quilting is a sewing process by which layers of textile material and/or other fabrics are joined to produce compressible panels that may be both decorative and functional. The manufacture of certain products, such as mattress covers, involves the application of large-scale quilting processes. These large-scale quilting processes typically use high-speed multi-needle quilting machines to form a series of cover panels along webs of the multiple-layered materials. Large-scale quilting processes typically use chain-stitch sewing heads that produce resilient stitch chains which are supplied by large spools of thread.

In a typical quilting process, the chain stitches bring together the multiple layers to be joined. Prior to the present invention, lofted materials could not be sewn together without compressing the materials. Therefore, lofted materials such as foam, heretofore were joined together with adhesive.

When multiple layers of lofted material such as foam and fiber are joined together for use in a bedding or seating product, the layers are typically joined with adhesive. Such adhesive is expensive relative to the cost of sewing them together using the present invention. In addition, water-based adhesive must cure or dry which takes time and energy, thereby increasing manufacturing time.

Thus, improved methods, apparatuses, and computer program products are needed for producing quilted products comprising lofted layers of material, such as foam, without compressing the lofted layers of material. There is further a need for methods, apparatuses, and computer program products which enable multiple lofted layers of material to be sewn together, thereby eliminating the need for adhesive.

SUMMARY

In an embodiment of the invention, a quilting machine is provided which sews together an input web comprising multiple pieces of lofted material without compressing the pieces of lofted material. In an alternative embodiment, a quilting machine is provided which sews together an input web comprising multiple webs of materials, at least one of which is usually lofted, such as a web of foam, without compressing the webs of material.

The quilting machine includes a frame, a sewing assembly powered by a first servo motor and a feed assembly powered by a second servo motor. Each of the servo motors is supported by the frame. The machine further comprises a third servo motor which moves a pre-contact roller to a desired position for a particular input web. A programmable controller determines when each servo motor is actuated, and other tasks described herein such as activating air cylinders to move a post-contact roller or activate thread tensioners. The first and second servo motors are typically programmed to operate one at a time. However, they may be programmed to overlap slightly or operate together for a short time.

The sewing assembly further comprises a first drive pulley rotated by the first servo motor. The first drive pulley rotates a first endless drive belt. The first endless drive belt surrounds the first drive pulley, an indexer pulley of an indexer assembly and a first transfer pulley of a transfer assembly. In operation, rotation of the first drive pulley causes rotation of the first endless drive belt which rotates the indexer pulley and first transfer pulley.

The transfer assembly of the sewing assembly further comprises a second transfer pulley in addition to the first transfer pulley. The transfer pulleys are located at opposite ends of a transfer shaft which extends transversely across the machine and extends through rear bearing assemblies supported by the frame.

The crank assembly of the sewing assembly further comprises a crank pulley secured to a crank drive shaft. The crank drive shaft extends through front bearing assemblies supported by the frame. An endless transfer belt surrounds the crank pulley and the second transfer pulley to transfer rotation of the second transfer pulley to rotation of the crank pulley and crank shaft. The crank assembly further comprises first and second rotatable cranks secured to the crank drive shaft which rotate together. The crank assembly further comprises drive rods. An upper end of each drive rod is secured to one of the rotatable cranks. A needle bar is secured to a lower end of each drive rod. Spaced needles are secured to the needle bar.

The needles extend through aligned holes in a movable platen and a stationary needle plate below the platen. The platen is moved by linear actuators connected by a torque tube. Activation of the linear actuators is controlled by the programmable controller. During operation of the machine, the feed assembly moves the input web downstream between the platen and needle plate without compressing the input web.

In addition to the indexer pulley, the indexer assembly of the sewing assembly further comprises a mechanical indexer which functions to laterally move a retainer bar and oscillate a looper shaft at desired times and desired distances underneath the stationary needle plate. The indexer pulley is connected to an indexer input shaft. A first bevel gear attached to the indexer input shaft rotates a second bevel gear which rotates an output shaft of the mechanical indexer. Rotation of the input shaft of the indexer assembly causes linear movement of a retainer bar to which multiple spreaders are attached. Rotation of the output shaft of the indexer assembly causes oscillation of the looper shaft to which multiple spaced loopers are attached. A looper and spreader correspond to each needle which cooperate to form the stitches created by the machine.

The feed assembly comprises a second drive pulley rotated by a second endless drive belt. The programmable controller activates the second servo motor which activates the second drive pulley when the first servo motor is turned off in most instances. However, the first and second servo motors may operate simultaneously for a programmed amount of time. The second endless drive belt surrounds the second drive pulley and a feed pulley. The feed pulley is connected to a feed shaft which extends transversely across the machine. A plurality of spaced endless feed belts surround the feed shaft and a front shaft supported by the frame in front of the feed shaft. The feed and front shafts are generally parallel with each other. The stationary needle plate is located inside the feed belts and supported by riser plates. The riser plates are located between the spaced endless feed belts to not interfere with rotation of the endless feed belts.

One rotation of the first drive pulley and a specified amount of rotation of the second drive pulley completes a first chain stitch without compressing the pieces of the input web. Thereafter, one rotation of the first drive pulley and a specified amount of rotation of the second drive pulley complete each of the remaining chain stiches of stitch lines without compressing the pieces of the input web. A top of each chain stitch comprises a section of needle thread extending above the quilted panel. A bottom of each chain stitch comprises two different portions. One portion comprises two sections of needle thread and one section of looper thread. The other portion of the bottom of the chain stitch comprises three sections of looper thread. The side of each chain stitch comprises a section of needle thread.

Stated another way, the present invention comprises a quilting machine capable of sewing multiple pieces of lofted material of an input web into a quilted panel without compressing the lofted pieces. The quilting machine includes a frame, a sewing assembly powered by a first servo motor supported by the frame and a feed assembly powered by a second servo motor supported by the frame.

The sewing assembly further comprises a needle bar, needles secured to the needle bar, needle thread passing through each needle, a needle plate having holes through which the needles extend, loopers below the needle plate from which looper thread is provided to form chain stitches extending through the quilted panel without reducing the height of the quilted panel, a retainer bar below the needle plate movable from side-to-side and spreaders secured to the retainer bar. The feed assembly further comprises endless feed belts for moving the input web under the needles, the needle plate being inside the endless feed belts.

The machine further comprises a controller programmed to operate the first and second servo motors at different or overlapping times. One rotation of the first drive pulley driven by the first servo motor completes one stroke of the needles and one cycle of the retainer bar and loopers. One rotation or portion thereof of the second drive pulley rotates the endless feed belts a programmed distance to move the input web a predetermined distance. The predetermined distance may be any distance but in most instances is from 0.25 to 4.0 inches, for example.

Another aspect of the invention is a method of quilting an input web. The method includes providing a quilting machine including a sewing assembly powered by a first servo motor and a feed assembly powered by a second servo motor. The method further comprises moving the layered input web through the quilting machine using the feed assembly to form chain stitches in the input web without compressing the quilted panel using the sewing assembly. In most instances, only one of the feed assembly and sewing assembly operates at a time. However, as described herein, both the feed assembly and sewing assembly may operate at the same time for a pre-programmed amount of time.

The method of quilting a layered input web comprises providing a quilting machine with a feed assembly and a sewing assembly. The method further comprises powering the sewing assembly with a first servo motor to form a chain stitch in the layered input web without compressing the layered input web. The method further comprises powering the feed assembly with a second servo motor to move a stack of lofted materials through the quilting machine a fixed distance, wherein the fixed distance may be changed by a programmable controller.

In another aspect of the invention, a computer program product is provided for quilting webs that includes a non-transitory computer-readable storage medium. The storage medium includes program code that is configured, when executed by one or more processors, to cause the quilting machine to active the appropriate servo motor at the desired time to move the input web a desired distance and then complete a portion of a chain stitch. The program code further causes the quilting machine to move the pre-contact roller to the appropriate position via the third servo motor.

Another aspect of the invention is a quilted panel comprising a first lofted layer having a first height, a second lofted layer having a second height and spaced stitch lines joining the layers and extending through the layers. Each of the stitch lines comprises multiple chain stitches. Each chain stitch comprises two sides, a top and a bottom. Each of the sides extends through the first and second lofted layers and comprises two sections of needle thread. The top of the chain stitch comprises one section of needle thread and the bottom of the chain stitch comprises two sections of needle thread and three sections of looper thread. The linear distance between the top and bottom of the stitch is the sum of the first and second heights.

Stated another way, the quilted panel may comprise a top lofted layer, a bottom lofted layer and a middle layer between the top and bottom lofted layers. Spaced stitch lines extend through the layers. Each of the stitch lines comprises multiple chain stitches. Each of the chain stitches comprises two sides, a top and a bottom. Each of the sides extends through the layers and comprises one section of needle thread. The top of the chain stitch comprises one section of needle thread extending above the top lofted layer. A portion of the bottom of the chain stitch comprises two sections of needle thread and one section of looper thread below the bottom lofted layer. None of the layers is compressed. At least one of the lofted layers may be foam or may be made of pocketed springs or may be fiber or any combination thereof.

Stated another way, the quilted panel may comprise a top layer, a bottom layer and a middle layer between the top and bottom layers. Spaced stitch lines extend through the layers. Each of the stitch lines comprises multiple chain stitches. Each of the chain stitches comprises two sides, a top and a bottom. Each of the sides extends through the layers and comprises one section of needle thread. The top of the chain stitch comprises one section of needle thread extending above the top layer. A portion of the bottom of the chain stitch comprises two sections of needle thread and one section of looper thread below the bottom layer. None of the layers is compressed. At least one of the layers may be made at least partially of foam or of fiber. At least one layer may be made of at least some pocketed springs.

The above summary may present a simplified overview of some embodiments of the invention to provide a basic understanding of certain aspects of the invention discussed herein. The summary is not intended to provide an extensive overview of the invention, nor is it intended to identify any key or critical elements or delineate the scope of the invention. The sole purpose of the summary is merely to present some concepts in a simplified form as an introduction to the detailed description presented below.

BRIEF DESCRIPTION OF THE DRAWINGS

The accompanying drawings, which are incorporated in and constitute a part of this specification, illustrate various embodiments of the invention and, together with the general description of the invention given above, and the detailed description of the embodiments given below, explain the embodiments of the invention.

DETAILED DESCRIPTION OF THE DRAWINGS

Figure 1:
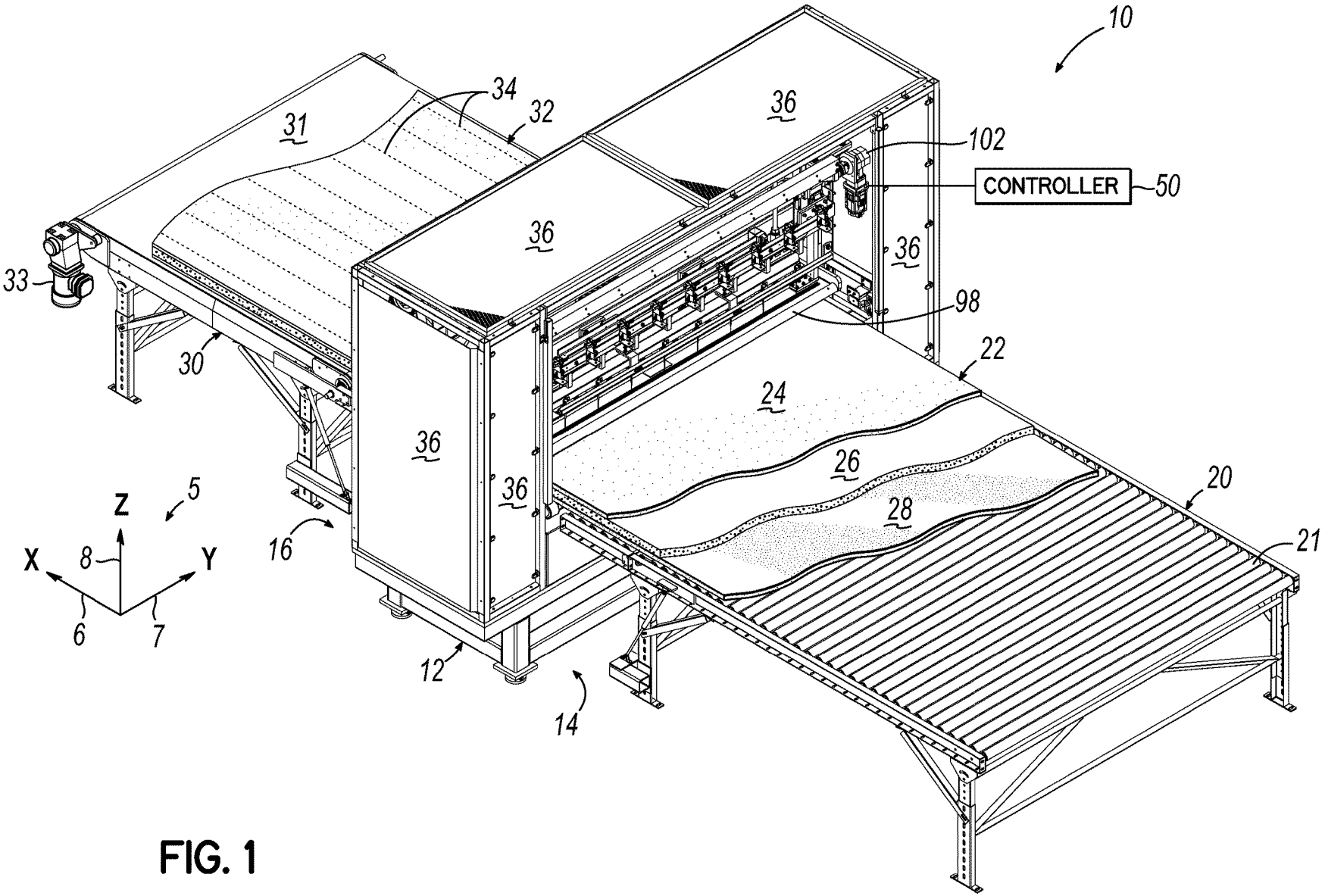
FIG. 1 is a perspective view of an exemplary quilting machine in accordance with an embodiment of the invention.
Figure 2A:
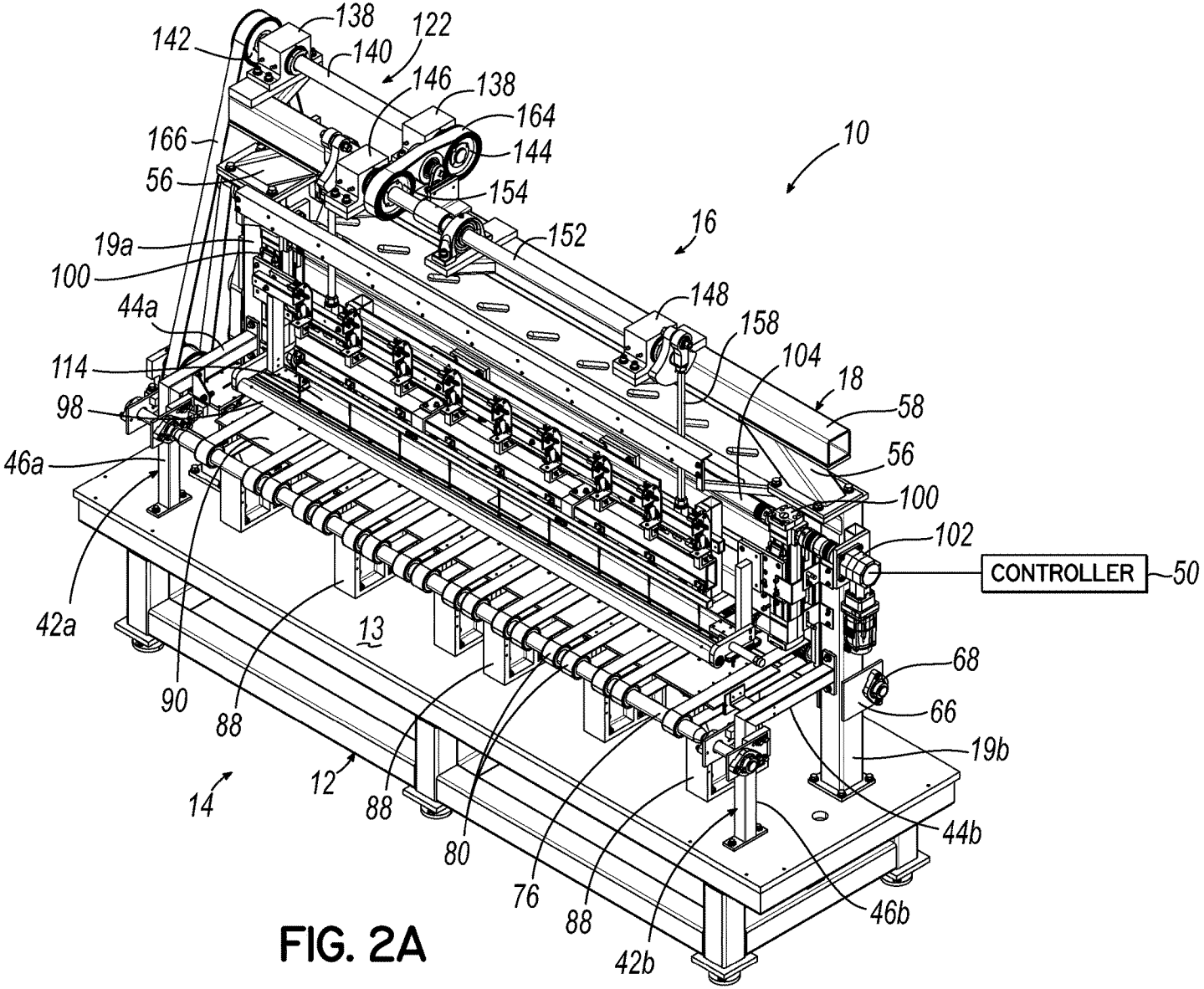
FIG. 2A is a front perspective view of the quilting machine of FIG. 1.
Figure 2B:
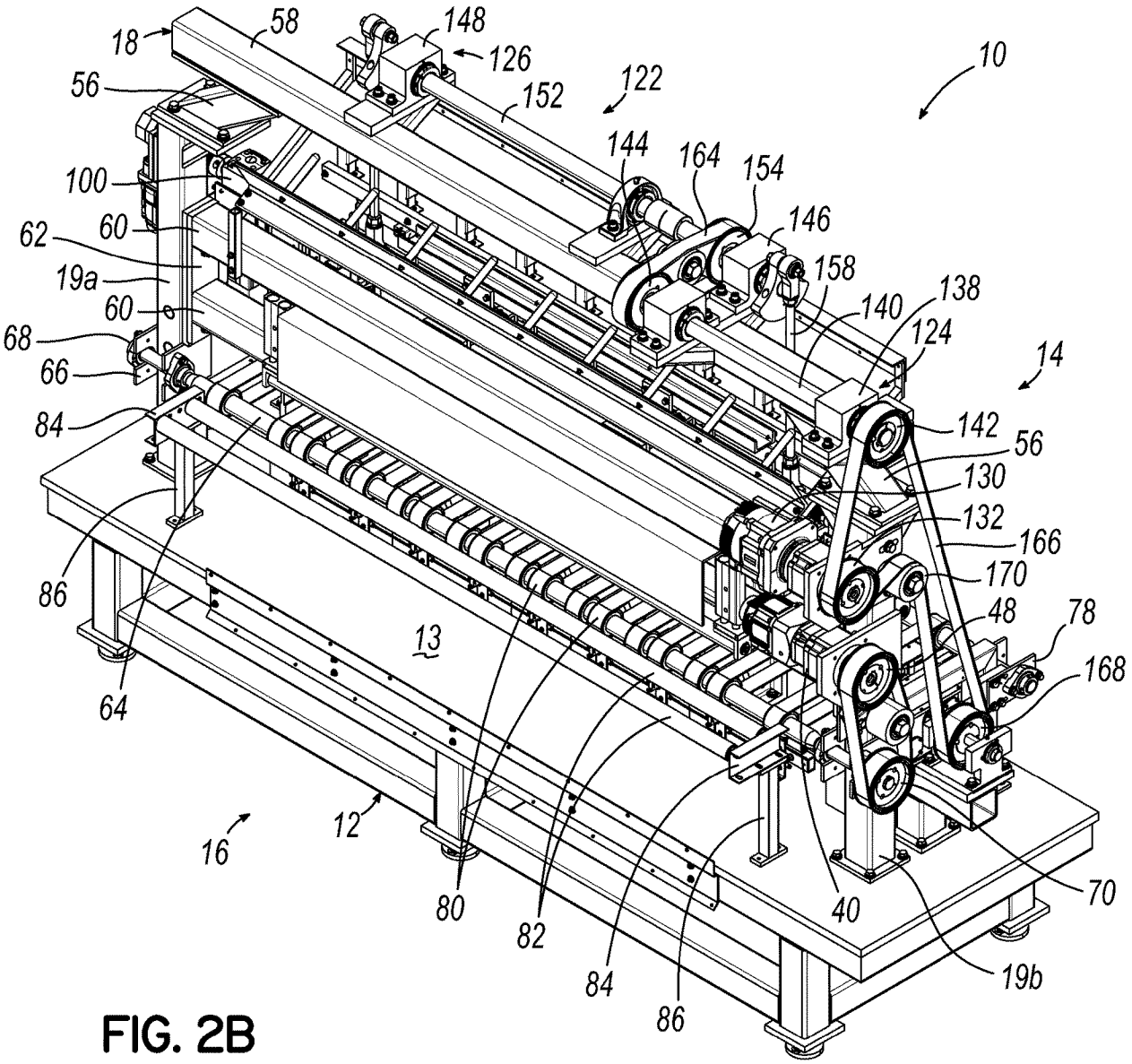
FIG. 2B is a rear perspective view of the quilting machine of FIG. 1.

FIGS. 1, 2A and 2B provide perspective views of a multi-needle quilting machine 10 in accordance with an embodiment of the invention. The machine 10 may be used, for example, to quilt webs of multi-layered material without compressing the webs. The layers may include foam, fiber or pocketed spring blankets or any combination thereof used in the manufacture of mattresses. As best shown in FIGS. 2A and 2B, the machine 10 has an upstream or input end 14 and a downstream or output end 16. For purposes of this document, the words "left" and "right" will refer to the machine as oriented as seen from the front, as shown in FIG. 2A.

The machine 10 includes a base 12 and a frame 18 supported by the base 12. The base 12 has a generally planar top 13. Although one configuration of base 12 is shown, the base may be any other configuration. Although one configuration of frame 18 is shown, the frame may be any other configuration.

Figure 5:
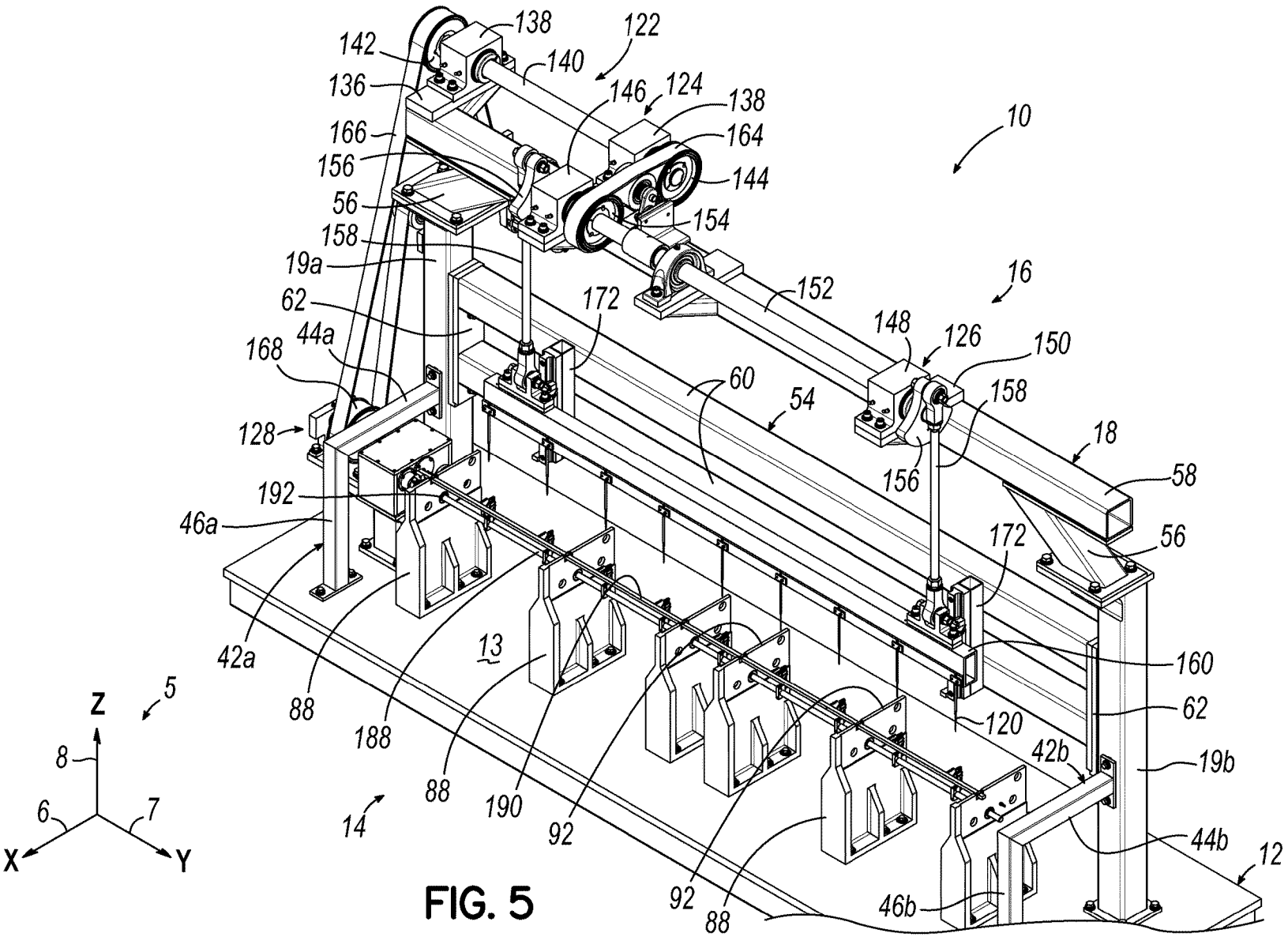
FIG. 5 is a front perspective view of the sewing assembly of the quilting machine of FIG. 1.
Figure 6:
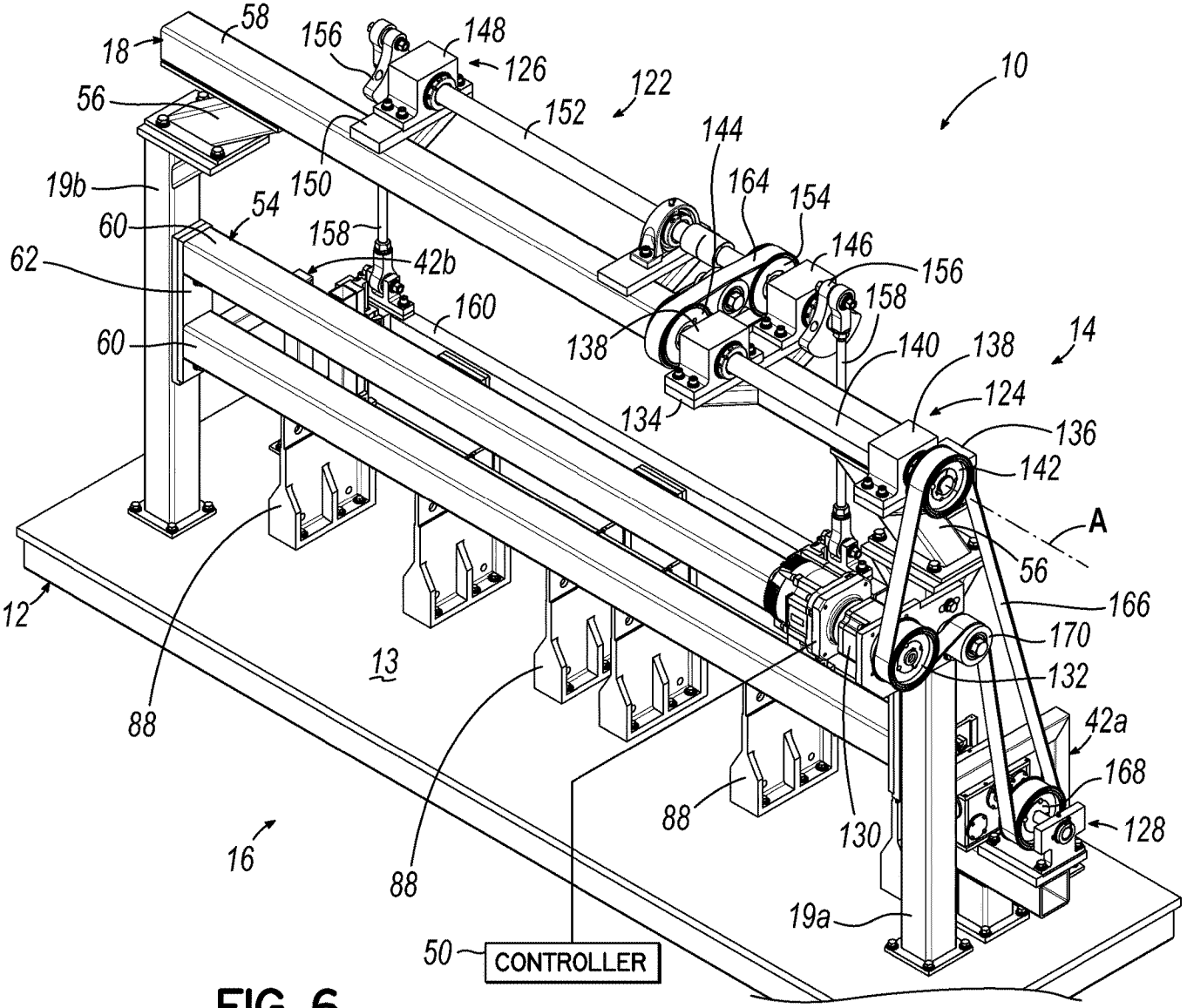
FIG. 6 is a rear perspective view of the sewing assembly of the quilting machine of FIG. 1.

As best shown in FIGS. 5 and 6, the frame 18 comprises left and right vertically oriented frame legs 19*a*, 19*b*, respectively, a middle frame member 54, two diagonal frame members 56 and a top frame member 58. The middle frame member 54 comprises two hollow spanners 60 and two mounting plates 62, each mounting plate 62 being secured to one of the frame legs 19 and each of the hollow spanners 60 extending between mounting plates 62 of middle frame member 54.

FIG. 1 shows a supply table 20 supporting an input web 22 comprising multiple pieces of lofted material (e.g., a facing piece 24, a middle piece 26, and a backing piece 28) enters the machine 10 at the input end 14 of the machine 10. The supply table 20 is illustrated being a non-motorized table comprising multiple rollers 21. However, the supply table may be motorized or any known table used in the industry.

FIG. 1 also shows an output table 30 supporting a quilted panel 32 exiting the machine 10 at the output end 16. The output table 30 comprises a conveyor 31 powered by a servo-motor 33. The output table 30 is illustrated being a motorized table. However, the output table may be non-motorized or any known table used in the industry.

Figure 24:
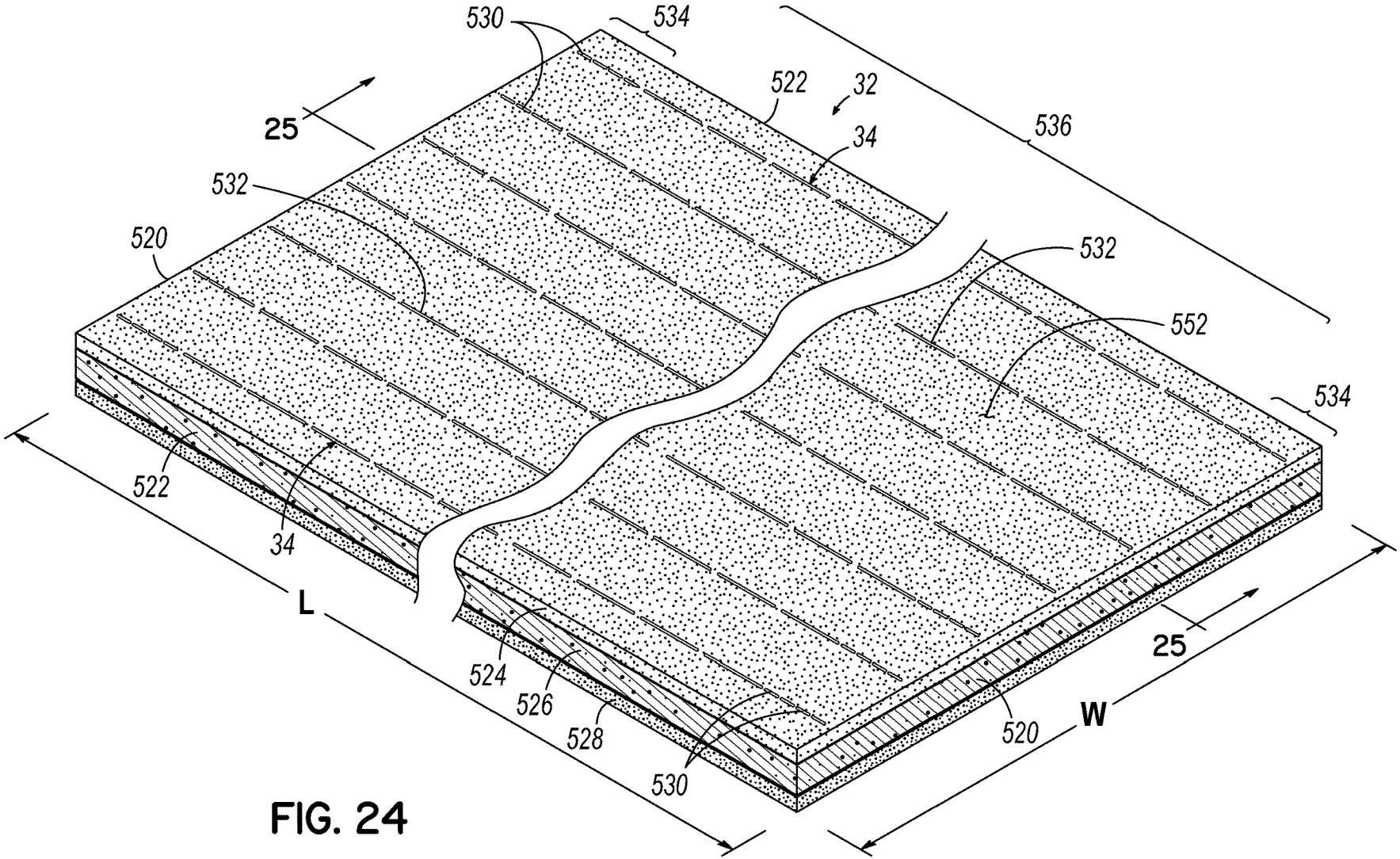
FIG. 24 is a perspective view of a quilted panel resulting from the method of using the quilting machine of the present invention.
Figure 25:
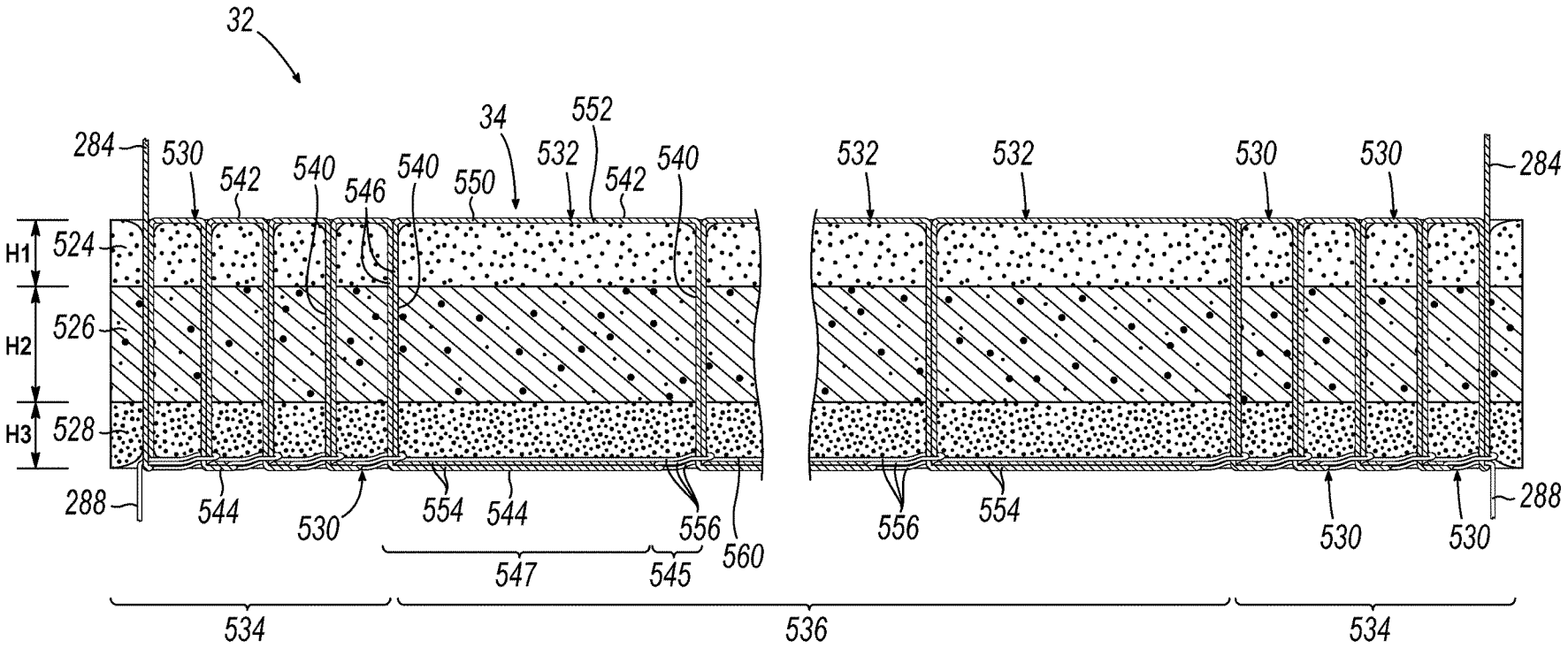
FIG. 25 is a cross-sectional view taken along the line 25-25 of FIG. 24.

The quilted panel 32 comprises the three pieces of lofted material 24, 26 and 28 sewn together with multiple parallel, spaced stitch lines 34 as shown in detail in FIGS. 24 and 25. Although the input web 22 is shown made from three pieces of lofted material 24, 26 and 28, each being a separate layer in the quilted panel 32, any number of pieces of material pre-cut to size may be quilted together using the quilting machine 10 to form a quilted panel having any number of layers without compressing the layers. FIG. 1 also shows guard panels 36 used to protect an operator from injury during operation of the machine 10.

Figure 1A:
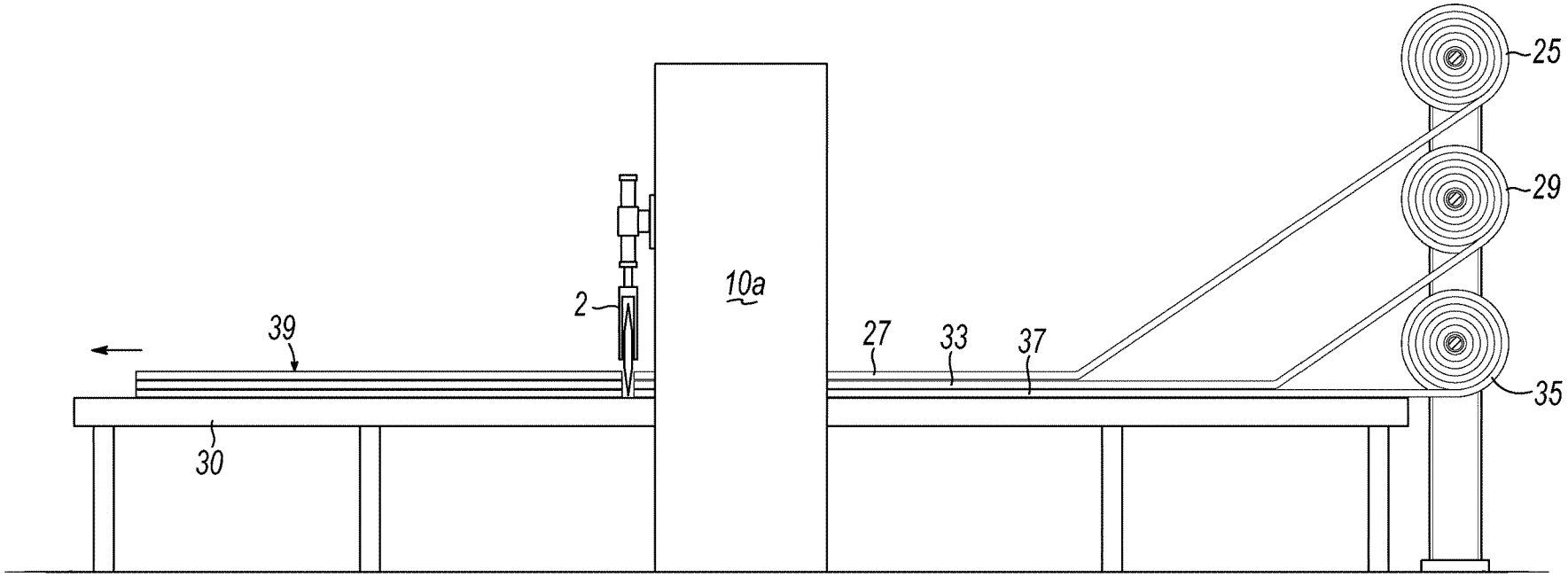
FIG. 1A is a perspective view of an exemplary quilting machine in accordance with an embodiment of the invention.

Although FIG. 1 shows pieces of lofted material 24, 26 and 28 cut to a predetermined size to be sewn together, FIG. 1A illustrates another embodiment of quilting machine 10*a* which is identical to quilting machine 10 but includes a cutter 2. Rather than individual pieces of lofted material pre-cut to size prior to entering the quilting machine 10*a*, FIG. 1A shows a roll 25 containing a web of first lofted material 27, a roll 29 containing a web of second lofted material 33 and a roll 35 containing a web of a third lofted material 37. After the first, second and third webs of lofted materials 27, 33, 37 are sewn together using the machine 10*a*, the cutter 2 cuts the quilted web 39 to a desired size to create a quilted panel before the quilted panel travels along the output table 30. Although each of the webs 27, 33, 37 is shown in FIG. 1A being a lofted material, any input web may be a pocketed spring web or non-lofted material.

Figure 3:
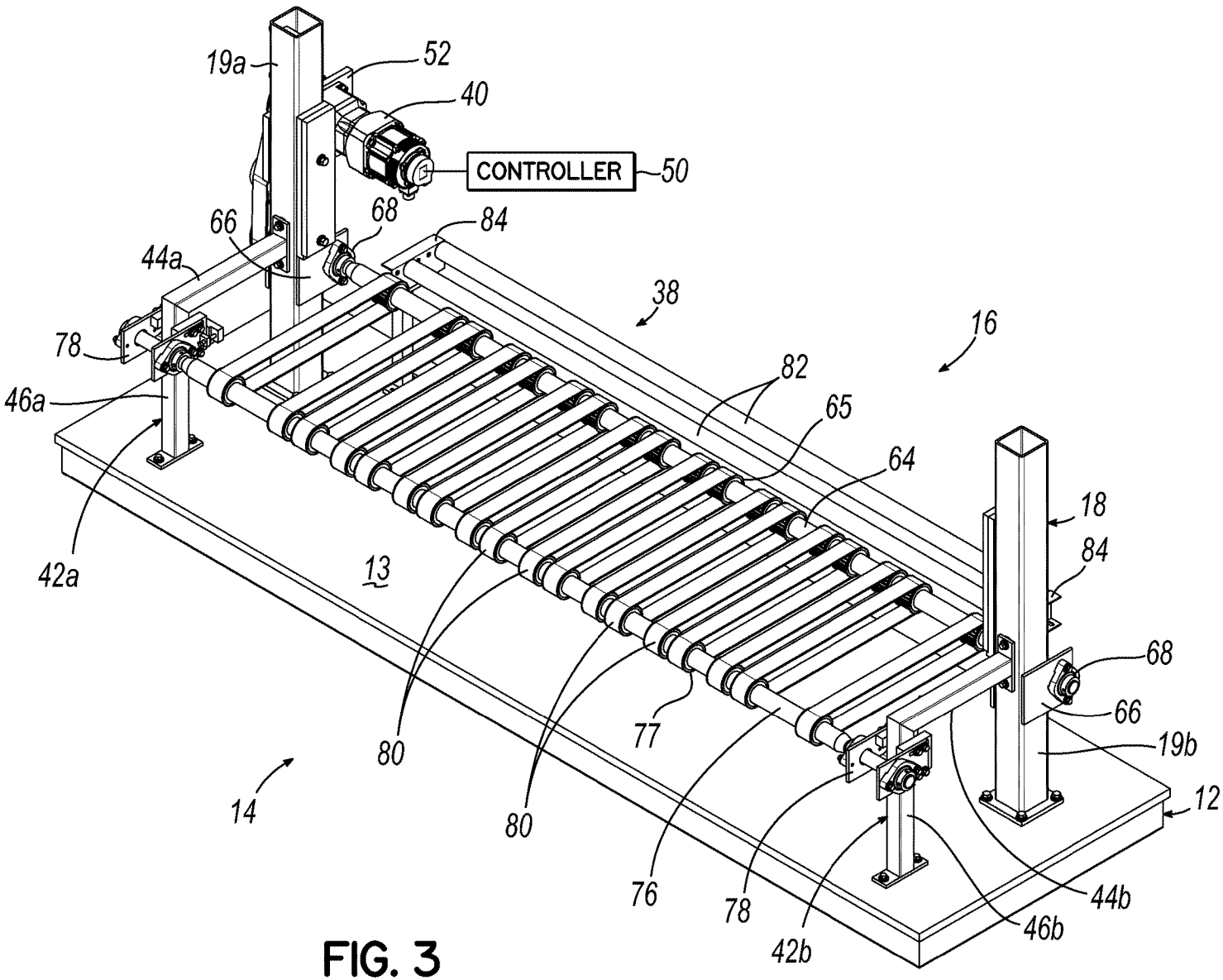
FIG. 3 is a front perspective view of the feed assembly of the quilting machine of FIG. 1.
Figure 4:
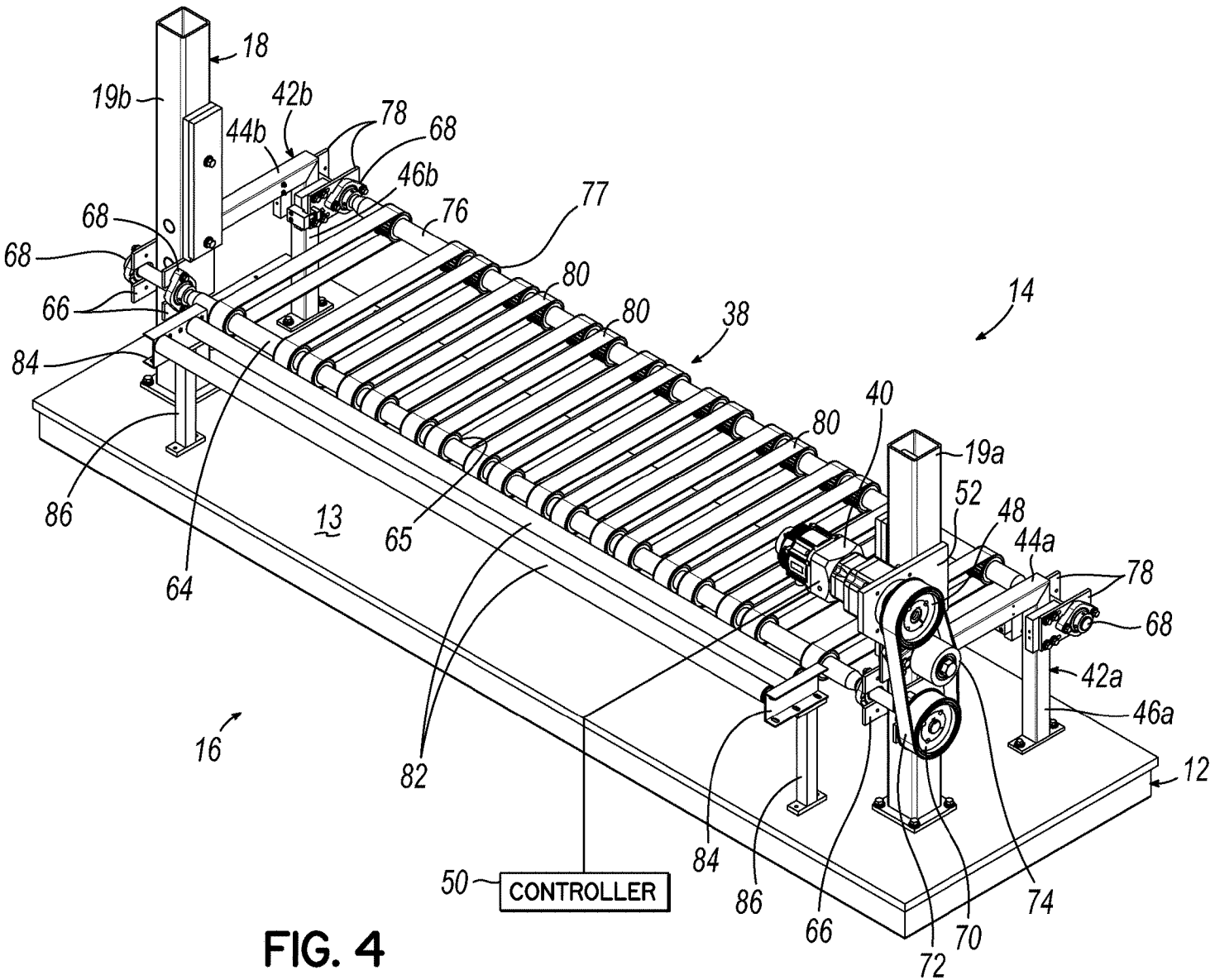
FIG. 4 is a rear perspective view of the feed assembly of the quilting machine of FIG. 1.

As best shown in FIGS. 3 and 4, the input web 22 moves through the machine 12 in an incremental fashion, as opposed to a continuous fashion, via operation of a feed assembly 38. The feed assembly 38 comprises a feed servo-motor 40 supported by one of two frame legs 19*a*, 19*b*. The operation of the feed servo-motor 40 is controlled by the controller 50. As best shown in FIGS. 3 and 4, the frame 18 further comprises left and right L-shaped braces 42*a*, 42*b*, respectively, one on each side of the machine 10. Each L-shaped brace 42*a*, 42*b* comprises a horizontal member 44*a*, 44*b* secured to one of the frame legs 19*a*, 19*b*, respectively, and a vertical member 46*a*, 46*b* secured to the generally planar top 13 of base 12. As best shown in FIG. 3, each of the left and right L-shaped braces 42*a*, 42*b* extends forwardly from the left and right frame legs 19*a*, 19*b*, respectively.

As best shown in FIGS. 3 and 4, operation of the feed servo-motor 40 rotates a drive pulley 48 located outside a mounting plate 52. The feed servo-motor 40 is located inside the mounting plate 52. The mounting plate 52 is secured to the left frame leg 19*a*.

The feed assembly 38 further comprises a feed drive shaft 64 supported by four rear brackets 66, each rear bracket 66 being secured to one of the frame legs 19*a*, 19*b*. As best shown in FIG. 3, a bearing assembly 68 is secured to each of the rear brackets 66 to facilitate rotation of the feed drive shaft 64. A feed pulley 70 is located outside the left most rear bracket 66 and is operatively coupled to the feed drive shaft 64 such that rotation of the feed pulley 70 rotates the feed drive shaft 64. As best shown in FIG. 4, an endless drive belt 72 surrounds the drive pulley 48, the feed pulley 70 and an adjustable tensioner 74 for adjusting the tension of the endless drive belt 72. The controller 50 controls the operation of the feed servo-motor 40.

As best shown in FIG. 3, the feed assembly 38 further comprises a front shaft 76 supported by four front brackets 78, each front bracket 78 being secured to one of the left and right L-shaped braces 42*a*, 42*b*, respectively. As best shown in FIG. 3, a bearing assembly 68 is secured to each of the front brackets 78 to facilitate rotation of the front shaft 76. A plurality of pulleys 77 are secured to the front shaft 76 in desired locations. See FIG. 3.

As best shown in FIGS. 3 and 4, endless feed belts 80 surround the pulleys 77 secured to the front shaft 76 and pulleys 65 secured to the feed drive shaft 64. The endless feed belts 80 are rotated by rotation of the feed drive shaft 64 caused by rotation of the drive pulley 48 rotated by the feed servo-motor 40. As the input web 22 exits the supply table 20 the input web 22 rests upon the endless feed belts 80 and is moved downstream in the machine 10 by the rotation of the endless feed belts 80.

As best shown in FIGS. 2B, 3 and 4, the feed assembly 38 further comprises two transition rollers 82 located at the rear of the machine 10 mounted to brackets 84 supported by transition posts 86. The transition posts 86 are bolted or otherwise secured to the top 13 of base 12. Each of the transition rollers 82 extends between the brackets 84 and is located behind the endless feed belts 80. The transition rollers 82 are not driven, but rather rotate as the quilted panel 32 passes over them from the machine 10 to the output table 30. Although the drawings show two transition rollers 82, any number of transition rollers may be used to provide a smooth path for the quilted panel 32 to move from the machine 10 onto the output table 30.

Figure 12:
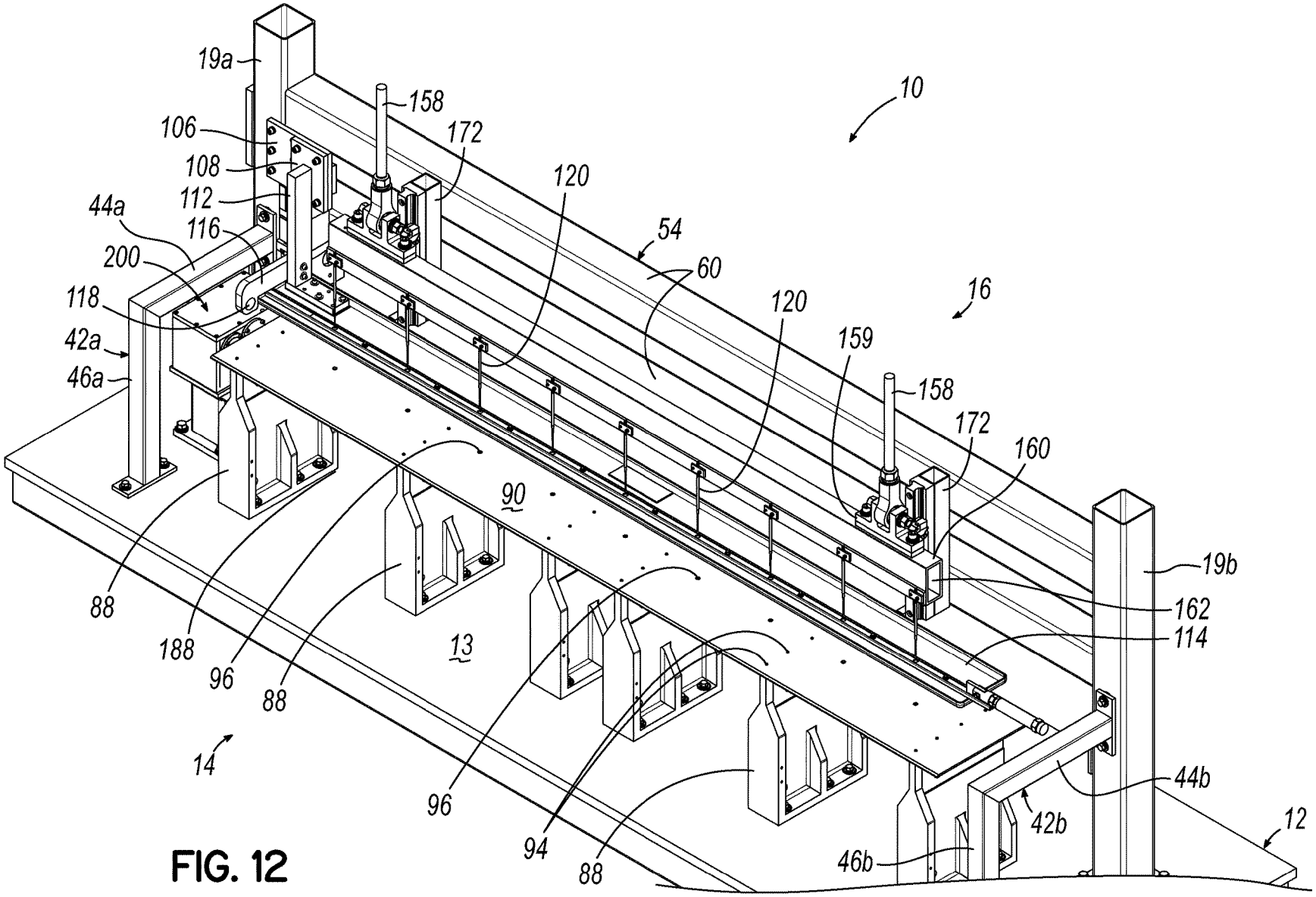
FIG. 12 is an enlarged front perspective view of a portion of the quilting machine of FIG. 1 showing the needle thread cutting assembly.

As best shown in FIGS. 1 and 2A, the feed assembly 38 further comprises a pre-contact roller 98 located at the front of the machine 10. The height of the pre-contact roller 98 is controlled by linear actuators 100 powered by a platen servo-motor 102. When power is provided to the linear actuators 100, the linear actuators 100 lift the pre-contact roller 98 upwardly. A torque tube 104 extends between the linear actuators 100. As best shown in FIG. 12, each linear actuator 100 is bolted to a large lift plate 106 which is bolted to a small plate 108 of an L-shaped lifter 112 which is bolted to a platen 114. The platen 114 extends between the L-shaped lifters 112. An arm 116 extends forwardly from each of the L-shaped lifters 112. The pre-contact roller 98 extends between holes 118 at the front of each of the arms 116 (only one being shown in FIG. 12).

Figure 4A:
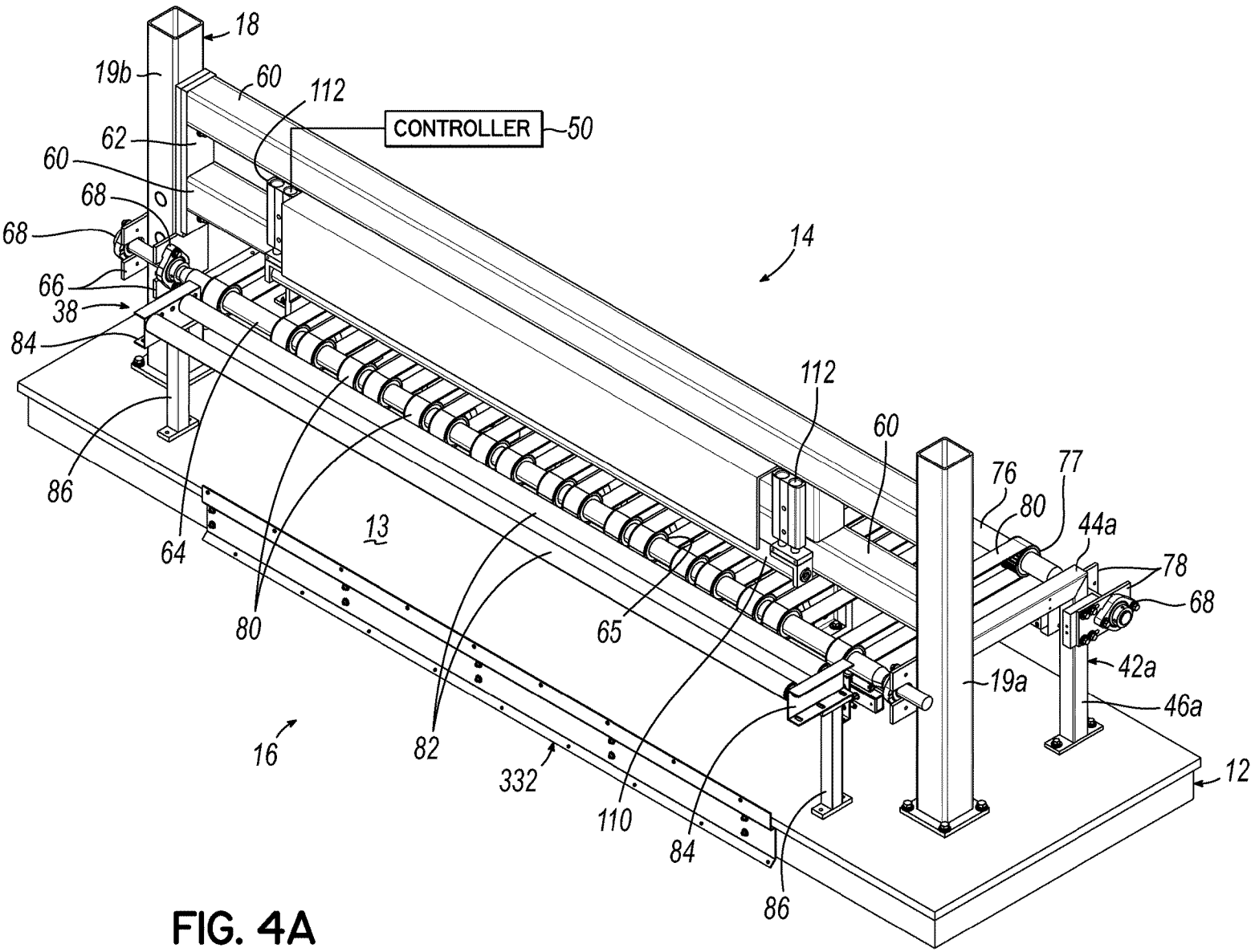
FIG. 4A is a rear perspective view of the feed assembly of the quilting machine of FIG. 1 showing the post contact roller.

As best shown in FIG. 4A, the feed assembly 38 further comprises a post-contact roller 110, the position of which is controlled by air cylinders 112. The air cylinders 112 are operated by controller 50. When power is provided to the air cylinders 112, the air cylinders 112 lift the post-contact roller 110 upwardly. When power is not supplied to the air cylinders 112, gravity drops the post-contact roller 110.

Figure 11:
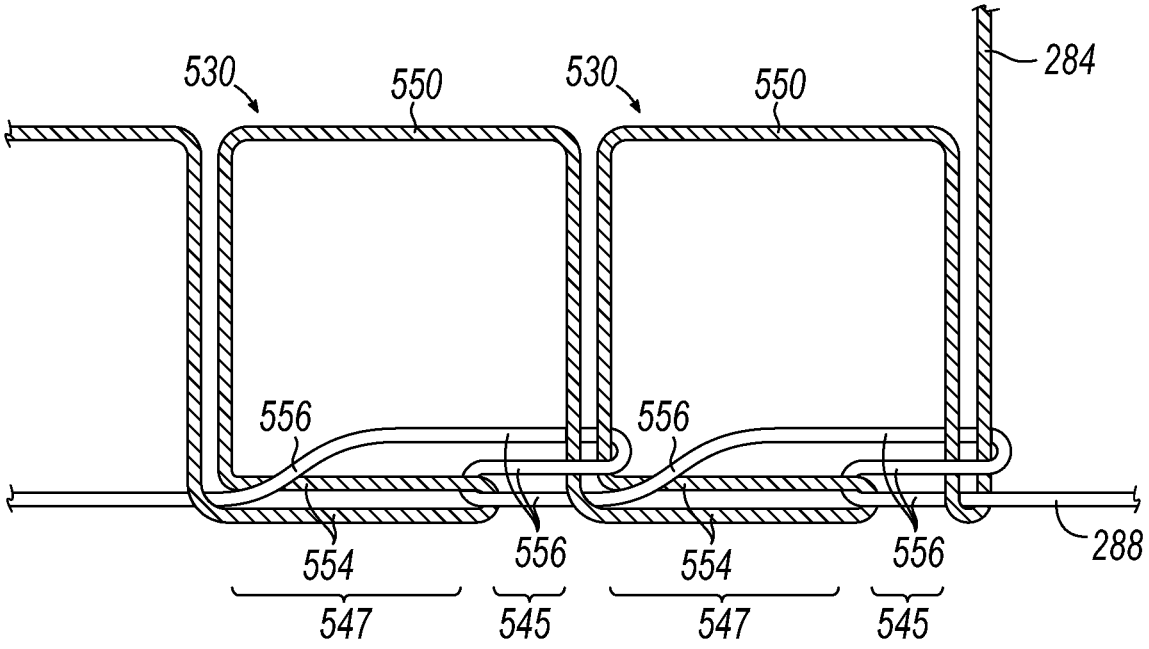
FIG. 11 is an enlarged side elevational view of a chain stitch being made in accordance with the present invention.
Figure 11A:
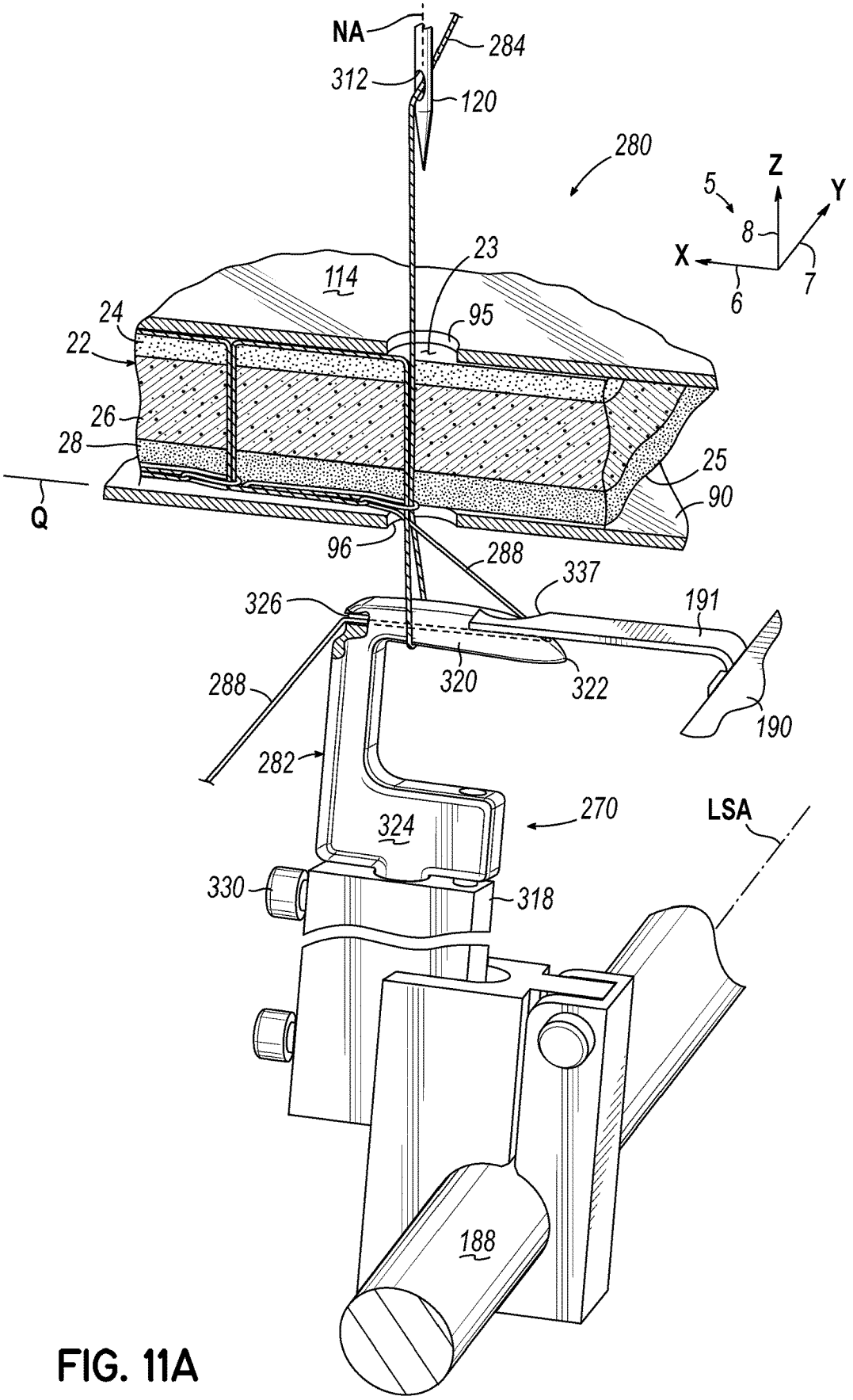
FIG. 11A is a perspective view of stitch forming elements including a needle, a looper and a spreader illustrated in their home position before the stitching process begins.

As best shown in FIGS. 2A and 5, the machine 10 further comprises a plurality of riser plates 88 secured to the top 13 of base 12. As best shown in FIG. 12, a needle plate 90 is welded or otherwise secured to the upper surfaces 92 at four locations 94 of each of the riser plates 88. The riser plates 88 are located between the endless feed belts 80 to not interfere with the movement of the endless feed belts 80. As best shown in FIG. 2A, the needle plate 90 is located inside the endless feed belts 80. As best shown in FIGS. 11A-12, the needle plate 90 has a plurality of holes 96, one per needle 120 (nine shown).

As best shown in FIGS. 5 and 6, the machine 10 further comprising a sewing assembly 122 including a transfer assembly 124, a crank assembly 126 and an indexer assembly 128, described below. As best shown in FIG. 6, the sewing assembly 122 is driven by a servo-motor 130 secured to the frame 12 and, more particularly, to the middle frame member 54. Operation of the sewing servo-motor 130 rotates a drive pulley 132.

Figure 7A:
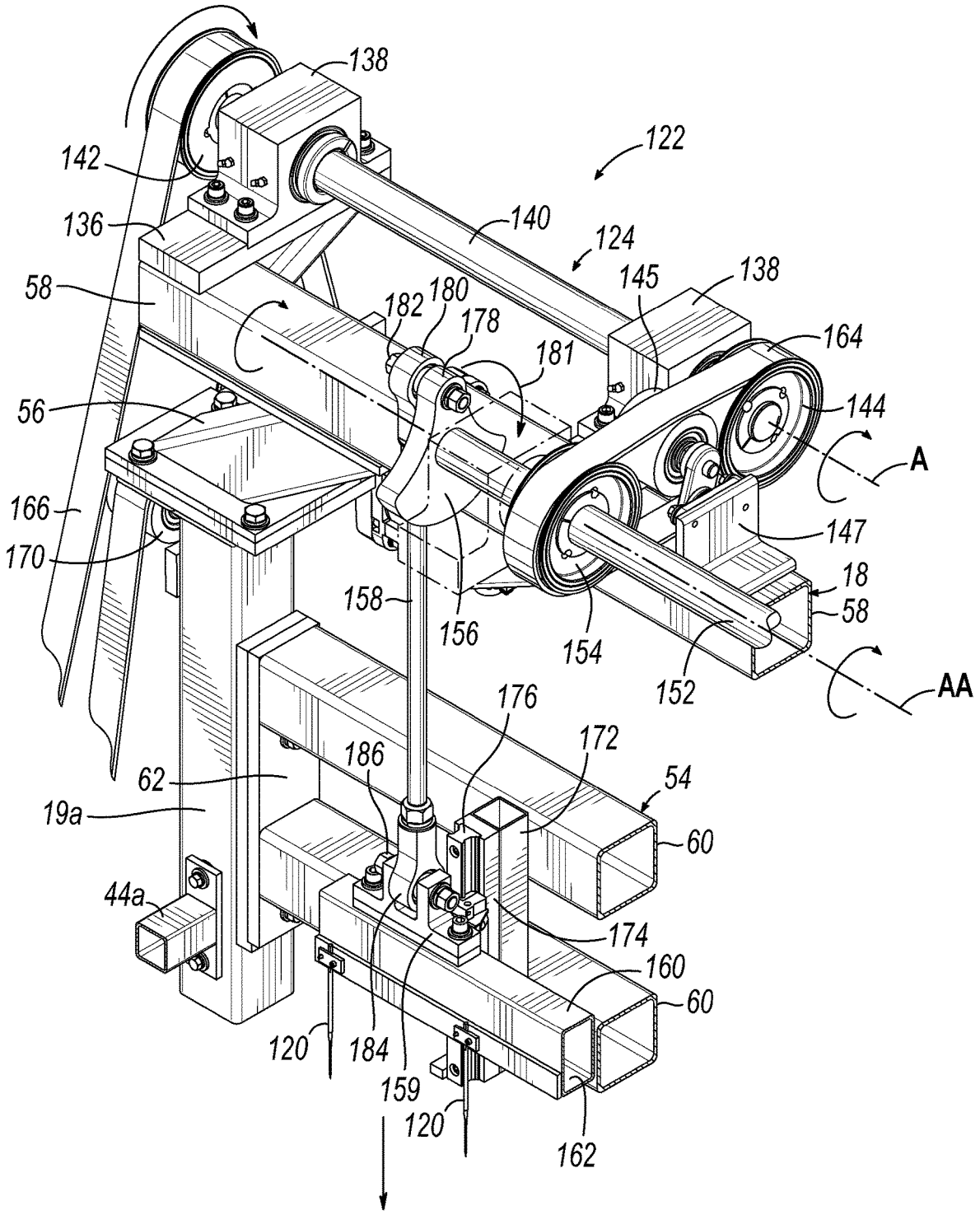
FIG. 7A is an enlarged front perspective view of a portion of the sewing assembly of FIG. 5 showing the needle bar moving downwardly due to rotation of the transfer shaft and crank drive shaft.

The transfer assembly 124 is located above the sewing servo-motor 130 and supported by the frame 12 and, more particularly, by the top frame member 58. As best shown in FIG. 6, the transfer assembly 124 comprises inner and outer mounting brackets 134, 136 secured to the top frame member 58, respectively. Rear bearing assemblies 138 are attached to the inner and outer mounting brackets 134, 136, respectively. A rotatable transfer shaft 140 extends through the rear bearing assemblies 138 and rotates about an axis A, as shown in FIG. 7A. An outside transfer pulley 142 is secured to an outside end of the rotatable transfer shaft 140 and an inside transfer pulley 144 is secured to an inside end of the rotatable transfer shaft 140.

Figure 7B:
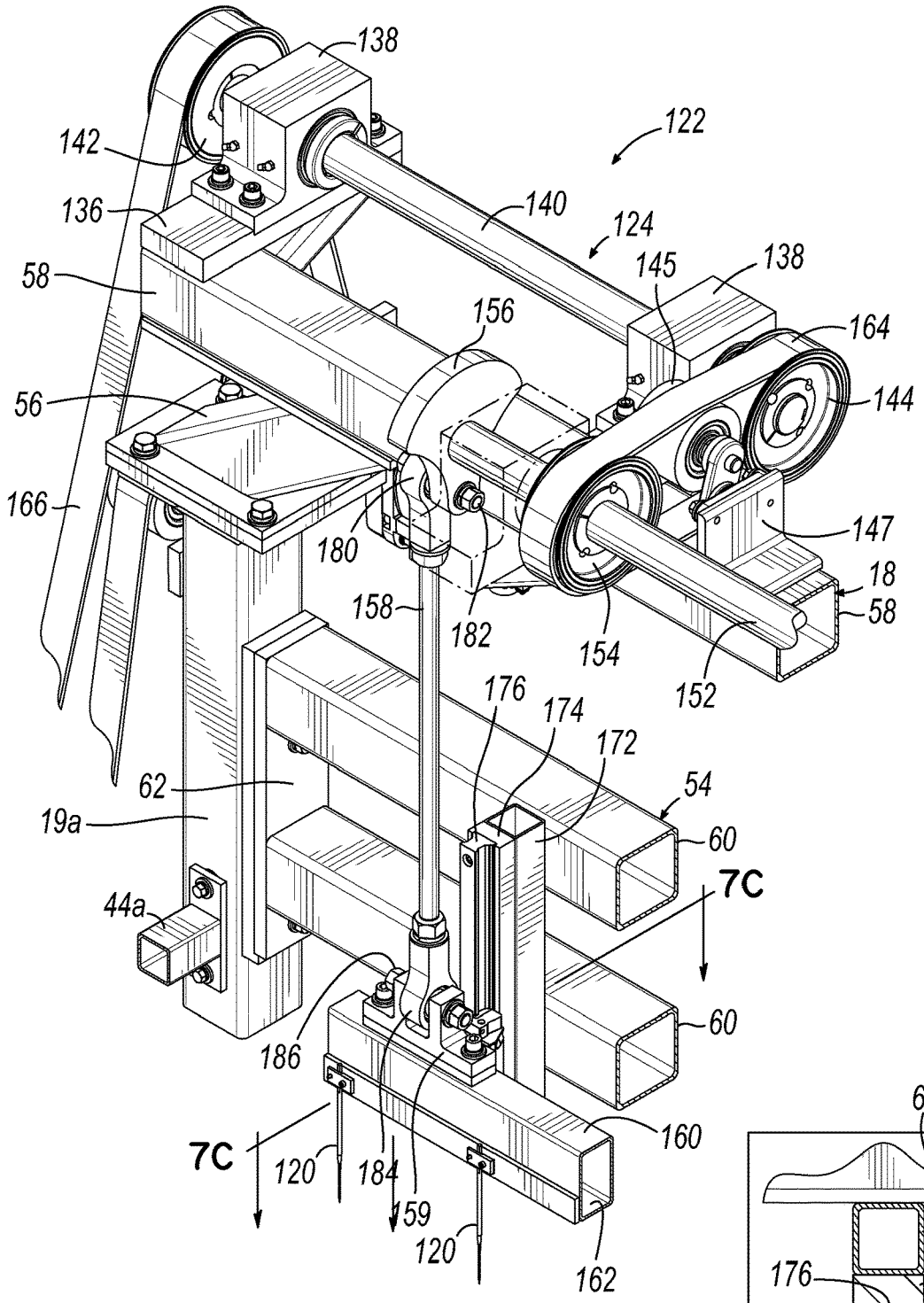
FIG. 7B is an enlarged front perspective view of a portion of the sewing assembly of FIG. 5 showing the needle bar in its lowered position.

The crank assembly 126 is in front of the transfer assembly 124 and in front of the top frame member 58. As best shown in FIGS. 5 and 6, the crank assembly 126 comprises a first front bearing assembly 146 secured to the inner mounting bracket 134 and a second front bearing assembly 148 secured to a mounting bracket 150. The mounting bracket 150 is supported by the frame 12 and, more particularly, by the top frame member 58. A crank drive shaft 152 extends between the first and second front bearing assemblies 146, 148, respectively, and rotates about an axis AA, as shown in FIG. 7A. A crank pulley 154 is secured to one end of the crank drive shaft 152 and upon rotation functions to rotate the crank drive shaft 152. An endless transfer belt 164 surrounds the crank pulley 154 and the inside transfer pulley 144. As best shown in FIGS. 7A and 7B, a belt tensioner 145 connected to an L-shaped mounting bracket 147 is manually set to provide the proper tension to the endless transfer belt 164. As best shown in FIGS. 7A and 7B, the L-shaped mounting bracket 147 is secured to the top frame member 58.

As best shown in FIGS. 5 and 6, the crank assembly 126 further comprises two rotatable cranks 156, each crank 156 being secured to an end of the crank drive shaft 152. One rotation of the crank drive shaft 152 causes one rotation of the cranks 156. As best shown in FIGS. 7A and 7B, an upper end 180 of a drive rod 158 is secured to a narrow portion 178 of a crank 156 with a bolt 182 such that one rotation of the crank 156 equals one stroke of the drive rod 158. As best shown in FIGS. 7A, 7B and 12, a bracket 159 is pivotally secured to the lower end 184 of each drive rod 158 with a bolt 186. The two brackets 159 (only one being shown in FIGS. 7A and 7B) are secured to a needle bar 160 having a hollow interior 162.

Figure 7C:
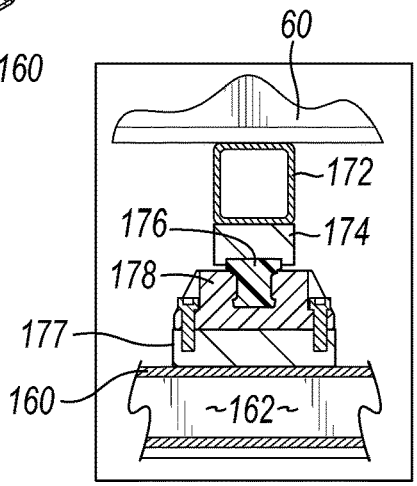
FIG. 7C is a cross-sectional view taken along the line 7C-7C of FIG. 7B.

As best shown in FIGS. 5, 7A, 7B and 7C, two spaced hollow members 172 are secured to the horizontally oriented spanners 60 of frame 12. As best shown in FIG. 7C, a spacer 174 is secured to each of the hollow members 172 in front thereof and a rail 176 is secured to each of the spacers 174 in front thereof. As best shown in FIG. 7C, a carriage 178 is secured to another spacer 177 which is secured to the needle bar 160. The machine has two carriages 178. Each carriage 178 is configured to engage one of the two rails 176 such that the needle bar 160 moves in a generally vertical direction and does not separate from the rails 176. The rails 176 are thereby configured to reciprocate the needle bar 160 in a generally linear path perpendicular to the quilting plane Q (see FIGS. 11A-11G) in response to rotation of the crank pulley 154.

Nine needles 120 are bolted to the needle bar 160 and move with the needle bar 160. However, any number of needles may be secured in any known manner to the needle bar 160. In one embodiment, each of the needles 120 is six inches in length. However, the needles may be any desired length.

An endless drive belt 166 surrounds the drive pulley 132 rotated by the servo-motor 130, the outside transfer pulley 142, an indexer pulley 168 described below and a belt tensioner 170. The position of the belt tensioner 170 is changed manually. The operation of the sewing servo-motor 130 which rotates the drive pulley 132 is controlled by the controller 50.

Figure 8A:
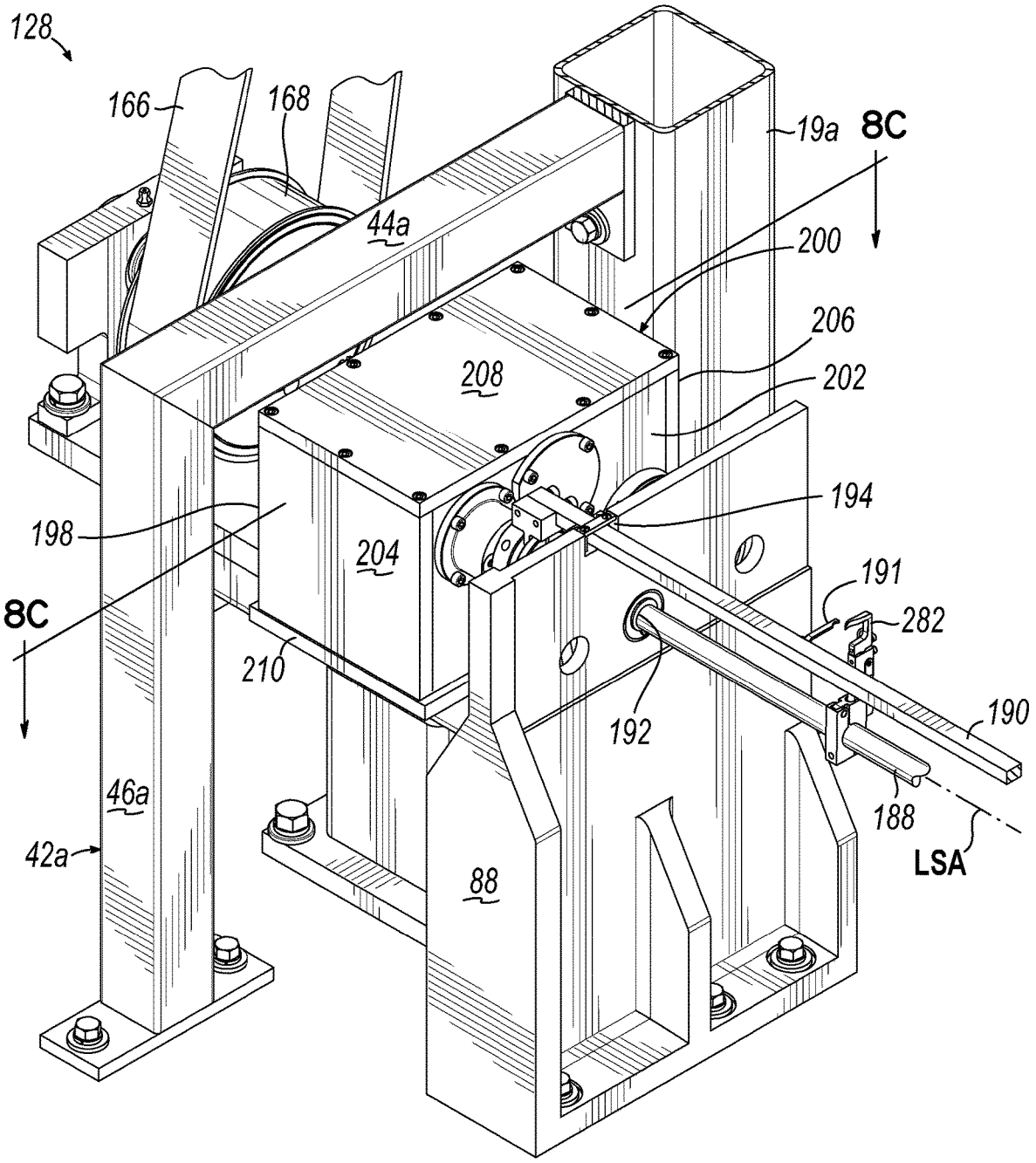
FIG. 8A is an enlarged front perspective view of a portion of the sewing assembly of FIG. 5 showing the indexer assembly and a portion of a retainer bar and looper shaft.

The indexer assembly 128 of the machine 10 is driven by rotation of the indexer pulley 168 rotated by the endless drive belt 166 and functions to oscillate a looper shaft 188 and move a retainer bar 190. As shown in FIGS. 5 and 8A, the looper shaft 188 extends through openings 192 in the riser plates 88 and the retainer bar 190 extends through cutouts 194 in the riser plates 88 above looper shaft 188. As shown in FIGS. 8A, 9A, 9B and 11A-11E, a plurality of spreaders 191 are secured to the retainer bar 190.

Figure 8B:
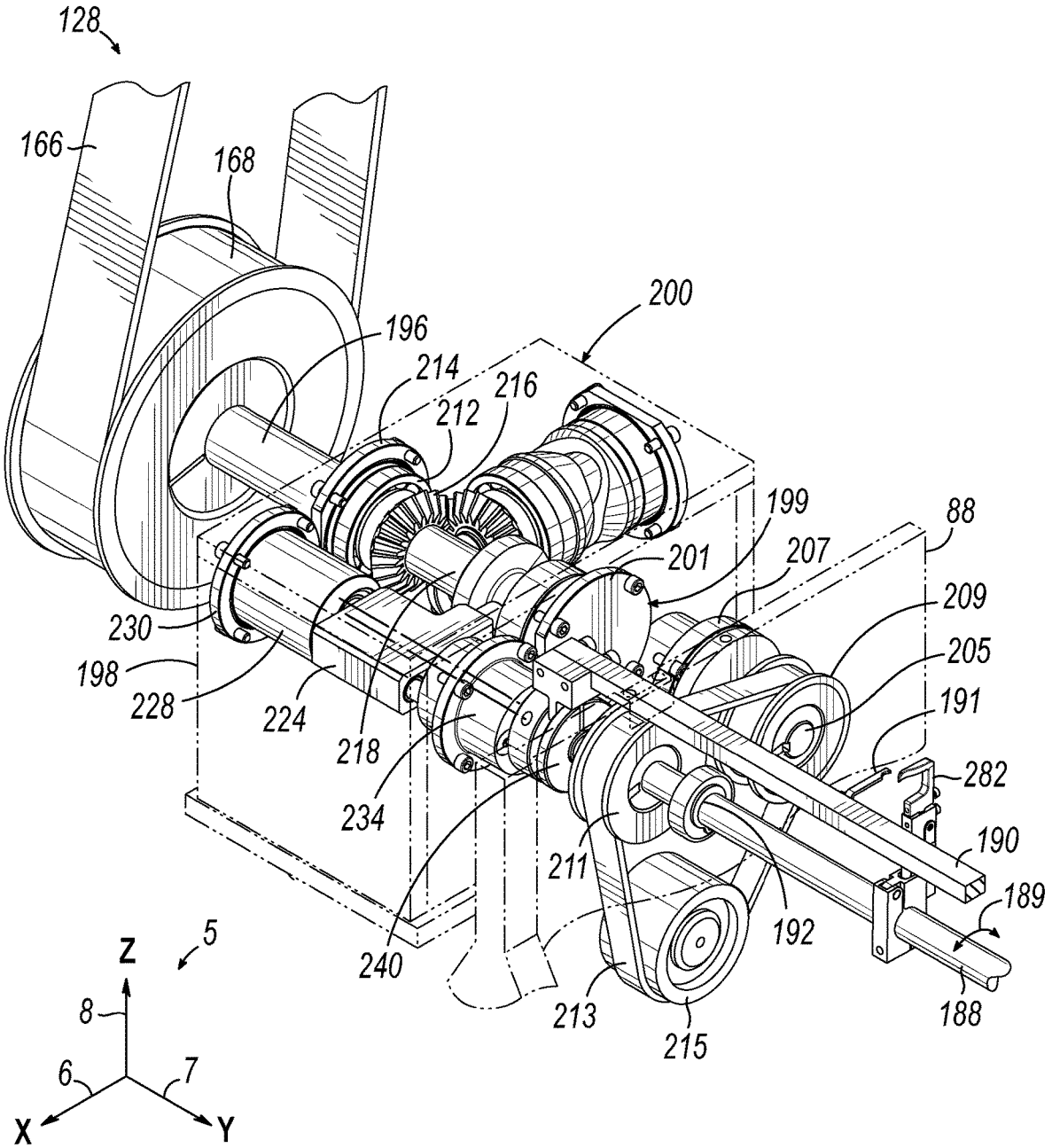
FIG. 8B is an enlarged front perspective view of a portion of the sewing assembly of FIG. 5 showing additional details of the indexer assembly and a portion of a retainer bar and looper shaft.
Figure 8C:
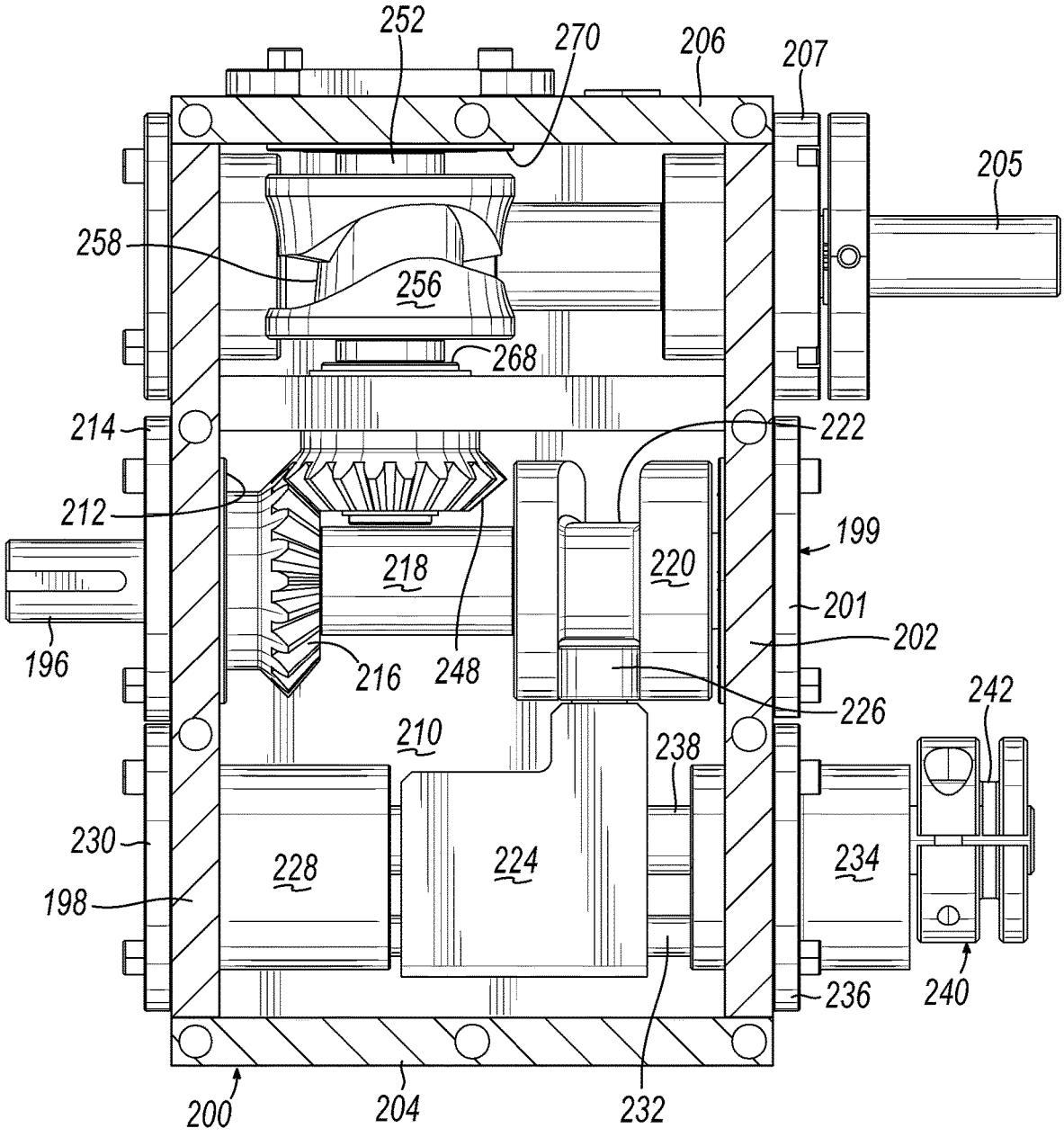
FIG. 8C is a cross-sectional view taken along the line 8C-8C of FIG. 8A.

As shown in detail in FIGS. 8A-8C, the indexer assembly 128 of the machine 10 comprises an indexer input shaft 196 connected to the indexer pulley 168 such that rotation of the indexer pulley 168 by the endless drive belt 166 rotates the indexer input shaft 196. As shown in detail in FIGS. 8A-8C, the indexer input shaft 196 extends through an outer wall 198 of an indexer housing 200 and ends in an inner bearing assembly 199 having a bearing mount 201 attached to an inner wall 202 of the indexer housing 200. As shown in detail in FIG. 8A, the indexer housing 200 also has an inner wall 202, a front wall 204, a rear wall 206, a top 208 and a bottom 210. As shown in detail in FIG. 8B, the indexer input shaft 196 extends (from left to right as seen in FIG. 8B) through an outer bearing assembly 212 having a bearing mount 214 secured to the outer wall 198 of the indexer housing 200, a drive bevel gear 216, a spacer 218 surrounding the indexer input shaft 196, a barrel cam 220 and inner bearing assembly 199 including a bearing mount 201 secured to the inner wall 202 of the indexer housing 200. The barrel cam 220 is attached to the indexer input shaft 196 such that upon rotation of the indexer input shaft 196, the barrel cam 220 rotates.

As best shown in FIGS. 8B, 8C, 9A and 9B, the barrel cam 220 has a groove 222 machined therein to move a thruster 224 linearly in the direction of the y-axis 7. The thruster 224 has an extension 226 which rides inside groove 222 of the barrel cam 220 as the barrel cam 220 rotates to move the thruster 224 linearly in the direction of the y-axis 7.

Figure 9A:
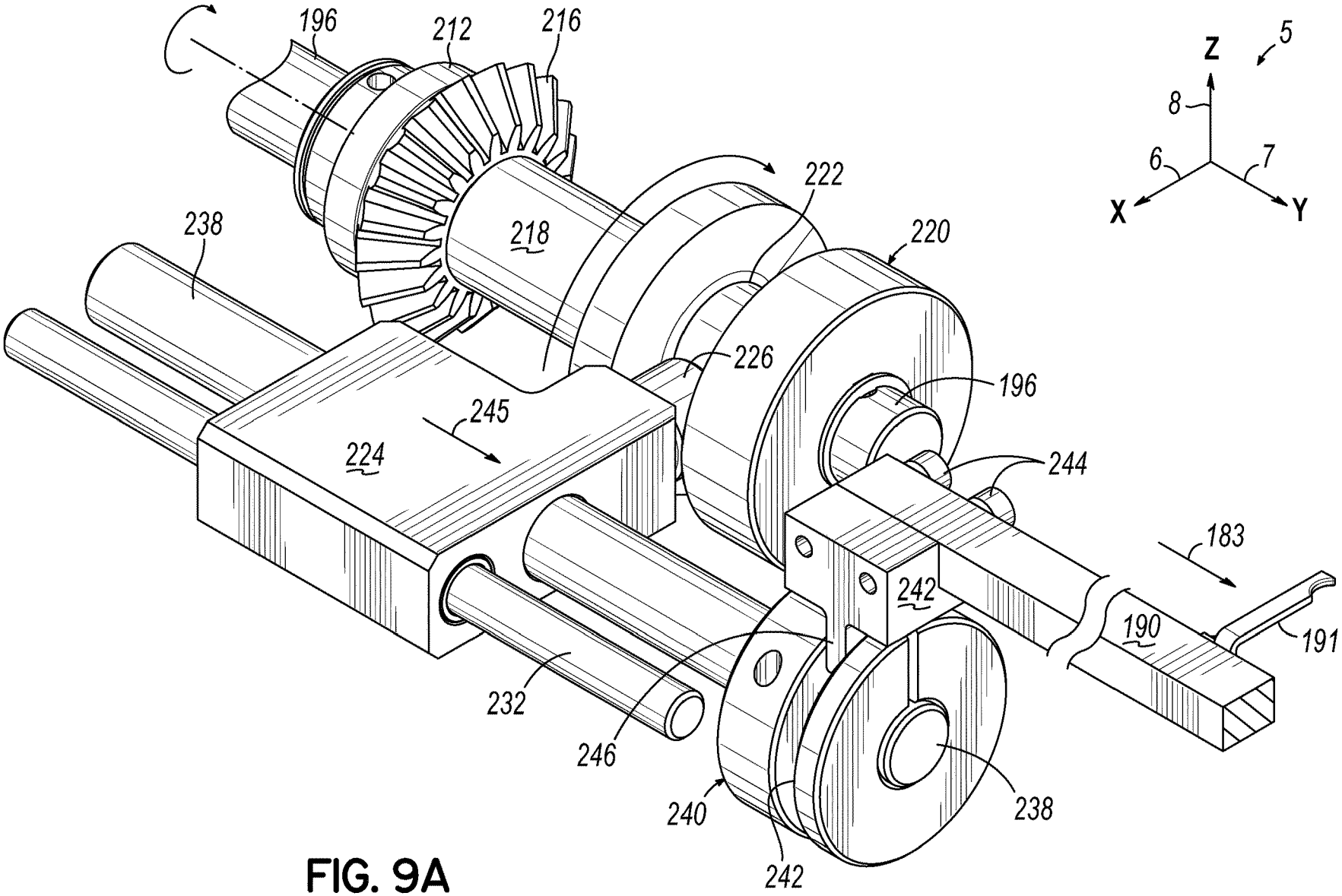
FIG. 9A is an enlarged front perspective view of a portion of the indexer assembly.
Figure 9B:
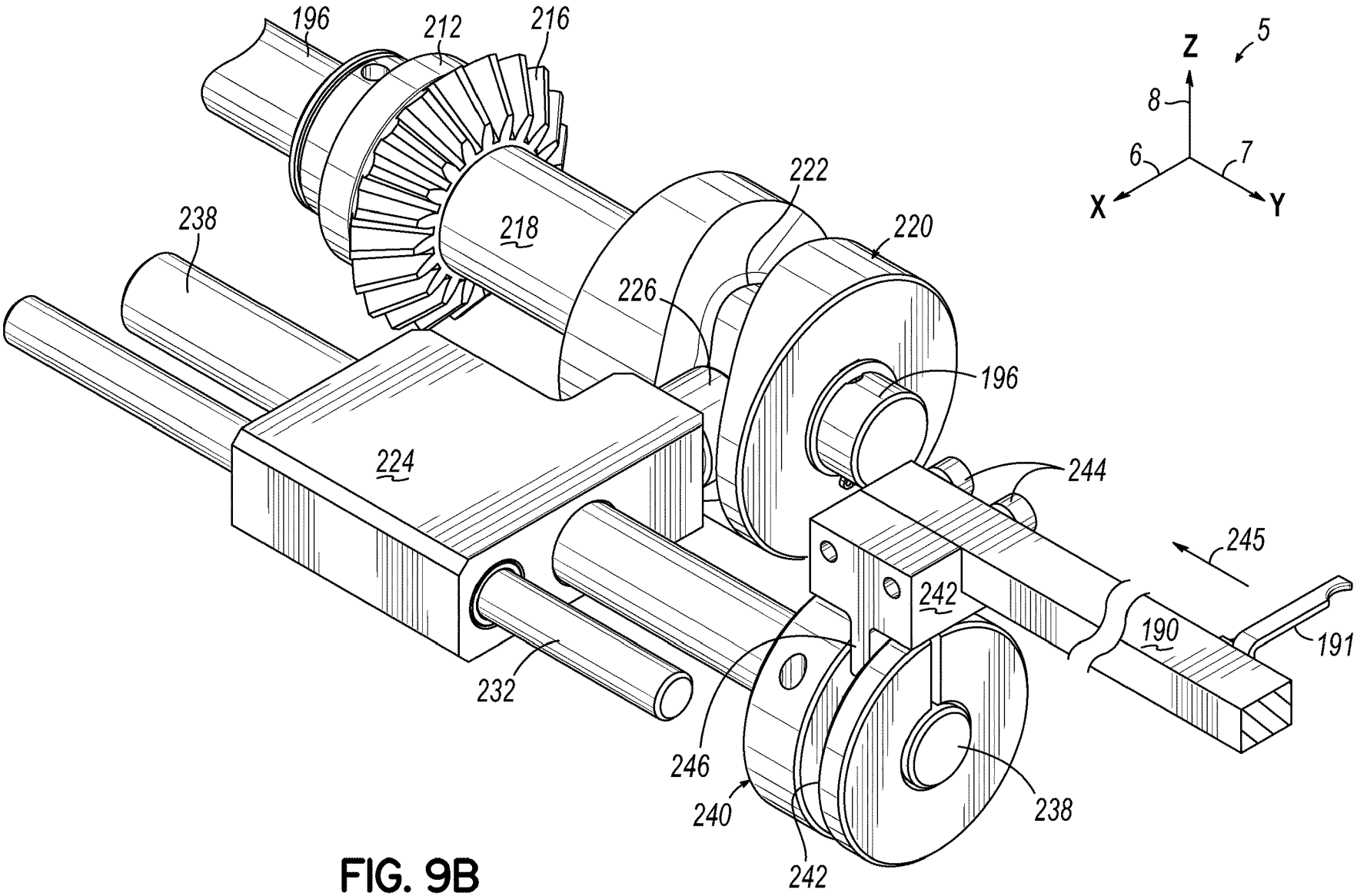
FIG. 9B is an enlarged front perspective view of a portion of the indexer assembly.

As best shown in FIG. 8C, a bearing assembly 228 including a bearing mount 230 is secured to the outer wall 198 of the indexer housing 200. As best shown in FIGS. 8B, 9A and 9B, a stationary rod 232 is secured to the bearing assembly 228 at one end and to another bearing assembly 234 at the other end. The bearing assembly 234 includes a bearing mount 236 secured to the inner wall 202 of the indexer housing 200. A linearly moveable thruster shaft 238 is attached to the thruster 244 and moves linearly with the thruster 244 as determined by the groove 222 of the barrel cam 220. As best shown in FIG. 8C, the linearly moveable thruster shaft 238 extends through the bearing assembly 234 and extends outside the indexer housing 200. A thruster paw 240 is attached to an inner end of the thruster shaft 238 and moves linearly with the thruster shaft 238 and thruster 224 in response to rotation of the indexer input shaft 196 and barrel cam 220. As best shown in FIG. 8C, the thruster paw 240 has a straight groove 242 outside the thruster shaft 238. As shown in detail in FIGS. 9A-9B, a retainer bar mounting block 242 is secured to the mounting block with fasteners 244. The retainer bar mounting block 242 has an extension 246 which fits inside the straight groove 242 of the thruster paw 240. Linear movement in the direction of the y-axis 7 by the thruster 224 caused by rotation of the barrel cam 220 causes linear movement in the direction of the y-axis 7 of the thruster shaft 238 and thruster paw 240. See arrows 183, 245 in FIGS. 9A and 9B, respectively. Linear movement in the direction of the y-axis 7 of the thruster paw 240 causes linear movement in the direction of the y-axis 7 of the retainer bar mounting block 242, which causes linear movement in the direction of the y-axis 7 of the retainer bar 190 and attached spreaders 191.

Figure 10A:
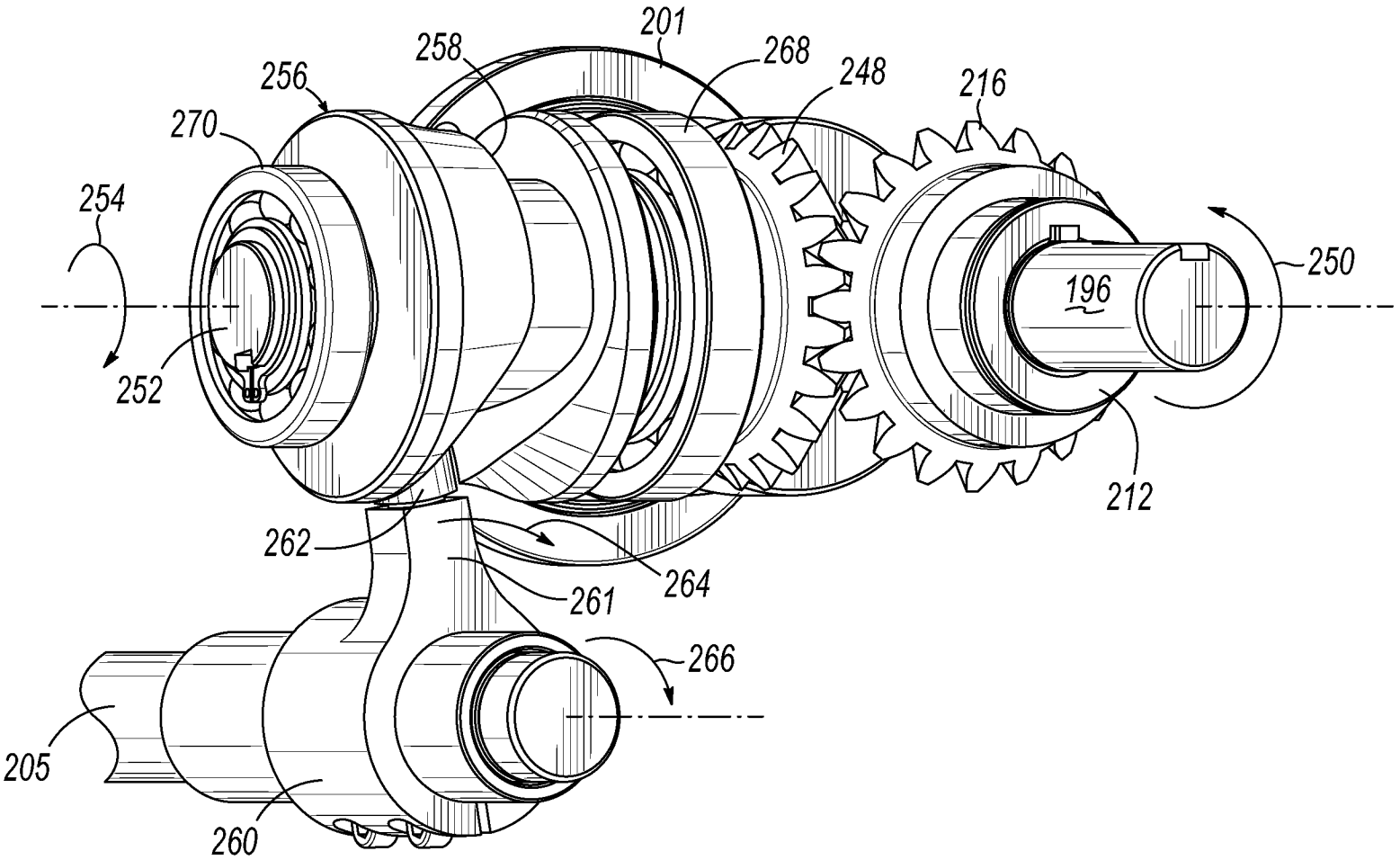
FIG. 10A is an enlarged front perspective view of another portion of the indexer assembly.
Figure 10B:
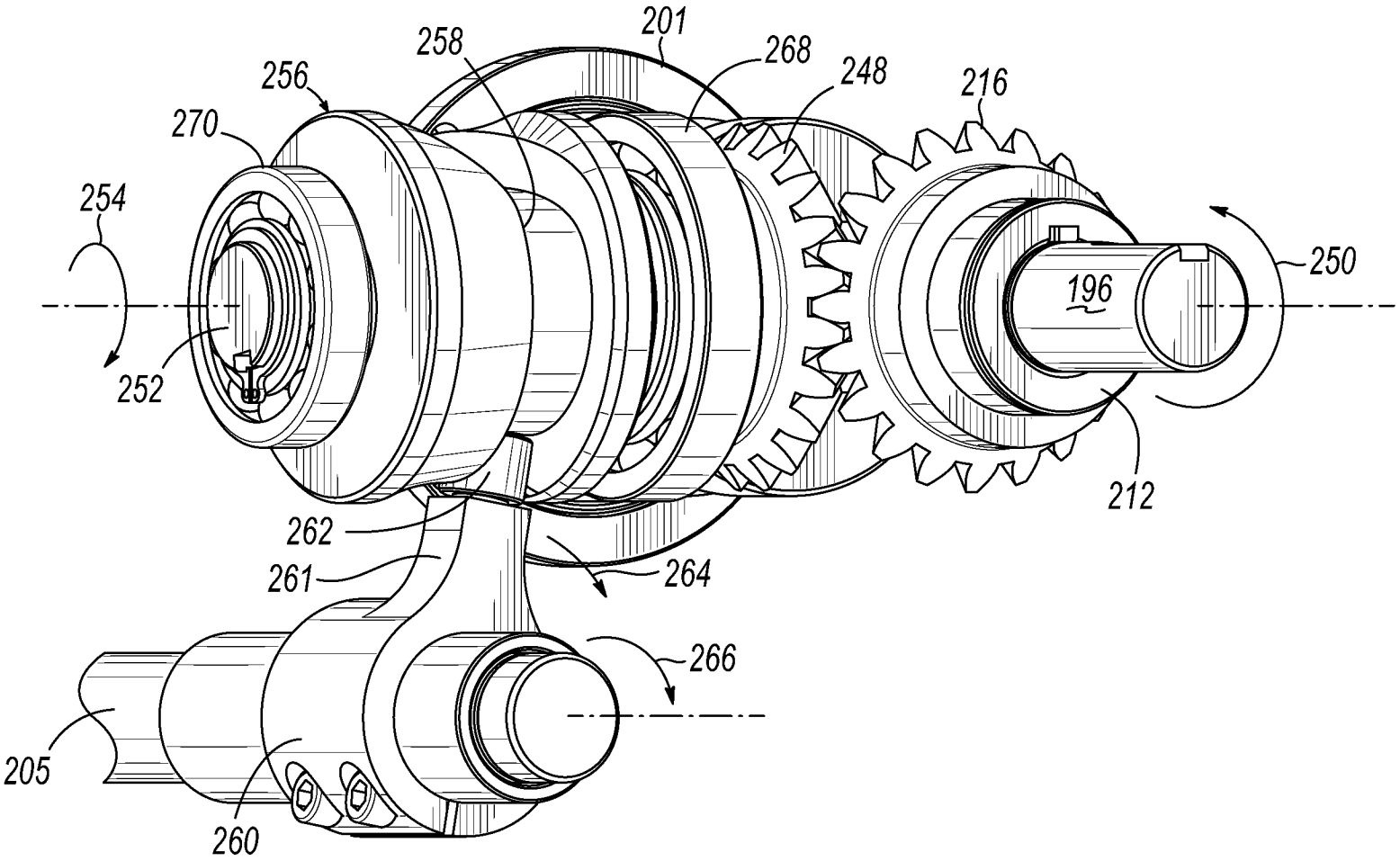
FIG. 10B is an enlarged front perspective view of the portion of the indexer assembly shown in FIG. 10A.

As shown in detail in FIGS. 10A-10B, drive bevel gear 216 mates with driven bevel gear 248 to rotate driven bevel gear 248. Rotation of the input shaft 196 and drive bevel gear 216, as shown by the arrow 250 in FIGS. 10A and 10B, rotates the driven bevel gear 248 and output shaft 252, as shown by the arrow 254 in FIGS. 10A and 10B. A globoidal cam 256 having a uniquely shaped groove 258 is attached to the output shaft 252. As shown in FIGS. 10A and 10B, bearings 268, 270 are located on opposite sides of the globoidal cam 256 and surround the output shaft 252.

Indexer output shaft 205 is located below the globoidal cam 256. A collar 260 surrounds the indexer output shaft 205 and is secured thereto. The collar 260 has a neck 261 having an extension 262 which rides inside the uniquely shaped groove 258 of the globoidal cam 256 to oscillate the neck 261 of indexer output shaft 205, as shown by the arrow 264 and therefore, oscillate the indexer output shaft 205, as shown by the arrow 266. As shown in FIG. 8B, the indexer output shaft 205 extends through a bearing assembly 207 and extends outside the inner wall 202 of the indexer housing 200. A drive pulley 209 is attached to the end of the indexer output shaft 205. A looper shaft pulley 211 is in front of the drive pulley 209 and oscillates with the drive pulley 209 due to an endless belt 213 surrounding the drive pulley 209, the looper shaft pulley 209 and a belt tensioner 215.

Figure 11B:
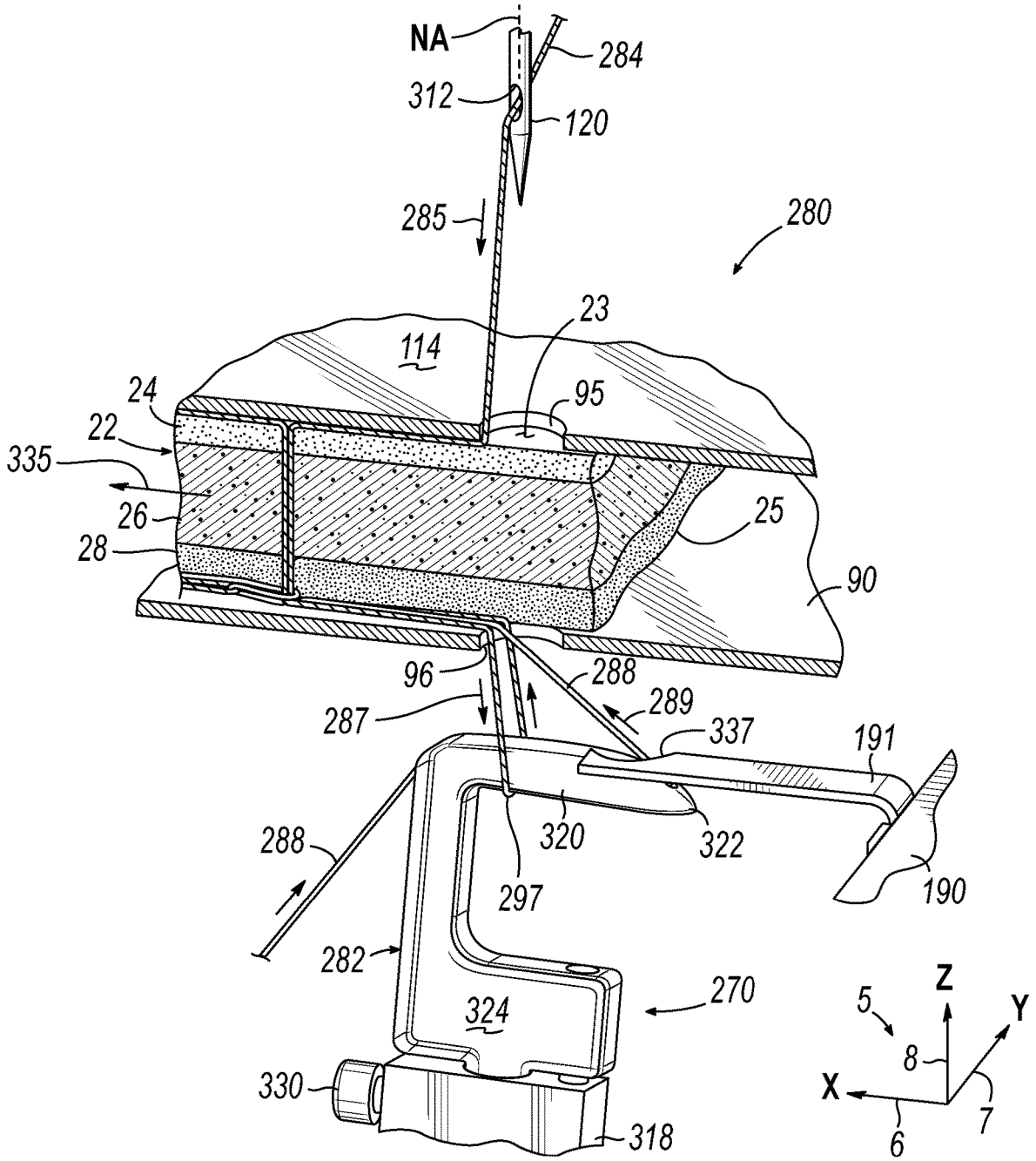
FIG. 11B is a perspective view of the stitch forming elements in their home position and the input web moving downstream.

In operation, the indexer assembly 128 functions to turn rotation of the indexer pulley 168 into an oscillation movement of the output shaft 205 and looper shaft 188. As the cranks 156 of the sewing assembly 122 rotate their first one hundred (100) degrees, as shown by the arrow 181 in FIG. 7A, the looper shaft 188 does not move as shown in FIGS. 11A and 11B. As the cranks 156 of the sewing assembly 122 rotate their next eighty (80) degrees, as shown by the arrow 181 in FIG. 7A, the looper shaft 188 rotates twenty (20) degrees, as shown by the arrow 189 shown in FIG. 8B, causing the loopers 282 attached to the looper shaft 188 to move from their forward or home position shown in FIG. 11A to their rear position shown in FIG. 11E. As the cranks 156 of the sewing assembly 122 rotate their next ten (10) degrees as shown by the arrow 181 in FIG. 7A, the looper shaft 188 remains stationary. As the cranks 156 rotate their next eighty (80) degrees, as shown by the arrow 181 in FIG. 7A, the looper shaft 188 rotates in the opposite direction twenty (20) degrees back to its original position, as shown by the arrow 189 in FIG. 8B, the loopers 282 attached to the looper shaft 188 returning from their rear position shown in FIG. 11E to their forward position shown in FIG. 11A. As the cranks 156 rotate the remaining two hundred thirty (230) degrees to complete a three hundred sixty (360) degree cycle, as shown by the arrow 181 in FIG. 7A, the looper shaft 188 remains stationary. The process then repeats itself due to the unique configuration of the indexer assembly 128.

Rotation of the indexer pulley 168 also creates a linear movement of the retainer bar 190 and spreaders 191 attached to the retainer bar 190. See FIG. 8A. As the cranks 156 of the sewing assembly 122 rotate their first fifty two (52) degrees, as shown by the arrow 181 in FIG. 7A, the retainer bar 190 and spreaders 191 move 0.25 inch away from the indexer housing 200, as shown by the arrow 183 of FIG. 9A, causing the spreaders 191 attached to the retainer bar 190 to move from their home position shown in FIG. 11A to their side position shown in FIG. 11D. As the cranks 156 of the sewing assembly 122 rotate their next forty (40) degrees as shown by the arrow 181 in FIG. 7A, the retainer bar 190 and spreaders 191 remain stationary. As the cranks 156 rotate their next sixty (60) degrees, as shown by the arrow 181 in FIG. 7A, the retainer bar 190 and spreaders 191 move in the opposite direction 0.25 inch towards the indexer housing 200 as shown by arrow 245 of FIG. 9B causing the spreaders 191 attached to the retainer bar 190 to move from their extended position shown in FIG. 11C to their home position shown in FIGS. 11A, 11F and 11G. As the cranks 156 rotate the remaining two hundred thirty (230) degrees to complete a three hundred sixty (360) degree cycle, as shown by the arrow 181 in FIG. 7A, the retainer bar 190 and spreaders 191 remain stationary in their home position. The process then repeats itself due to the unique configuration of the indexer assembly 128.

Alternatively, the indexer input shaft 196 of indexer assembly 128 of the machine 10 could be driven by another servo motor (not shown) instead of being driven by rotation of the indexer pulley 168. In such an embodiment, the indexer pulley 168 could be omitted and the drive pulley 132 rotated by sewing servo motor 130 would drive only the outside transfer pulley 142 of the transfer assembly 140 via an endless drive belt. See FIG. 2B. The indexer assembly 128 of the machine 10 would still oscillate the looper shaft 188 and move the retainer bar 190 with spreaders 191 attached to the retainer bar 190.

As shown in detail in FIGS. 11A-11G, in operation the input web 22 passes between the platen 114 and the needle plate 90. The controller 50 controls the operation of the feed servo-motor 40, platen servo-motor 102, sewing servo-motor 130 and the air cylinders 112. The needle plate 90 supports the input web 22 as stitch lines 34 are stitched through the input web 22 to form a quilted panel 32. The platen 114 has a plurality of platen holes 95 and the needle plate 90 has a plurality of needle holes 96 that are aligned vertically to allow the needle 120 to pass through the input web 22 and extend below the needle plate 90. At the start of a stitching cycle, the platen 114 may be moved toward the needle plate 90, thereby moving the input web 22 against the needle plate 90 to hold the input web 22 as the needle 120 is extended through the input web 22. At the end of the cycle, the platen 114 may be moved up to facilitate insertion of another input web 22.

The location and movement of the components of machine 10 may be described using a coordinate system 5 that includes an x-axis 6, a y-axis 7, and a z-axis 8. The x-axis 6 of coordinate system 5 is in a quilting plane Q defined by the needle plate 90 in the downstream direction of the movement of the input web 22 between the platen 114 and needle plate 90. The y-axis 7 of coordinate system 5 is in a direction perpendicular to the x-axis 6 and parallel to the transverse movement of the retainer bar 190. The z-axis 8 of coordinate system 5 is perpendicular to both the x-axis 6 and the y-axis 7, and in the direction of movement of the needles 120.

One or more needle assemblies 268 may be mounted to a support structure 272 that couples the needle assemblies 268 to the frame 12. See FIGS. 13 and 14. One or more looper assemblies 270 may be mounted to a support structure 274. See FIGS. 15 and 16. The support structures 272, 274 locate each needle assembly 268 on a needle facing side of platen 114 and locates each looper assembly 270 on a looper facing side of needle plate 90. Each of the needle assemblies 268 is provided with thread from a respective needle thread spool 276, and each of the looper assemblies 270 is provided with thread from respective looper thread spool 278. Each needle assembly 268 is located opposite a corresponding looper assembly 270 to form a sewing station 280. The needle and looper assemblies 268, 270 of each sewing station 280 may be configured to work cooperatively to form a series of chain stitches in the input web 22 using the thread provided by the needle and looper thread spools 276, 278, respectively.

Figure 14:
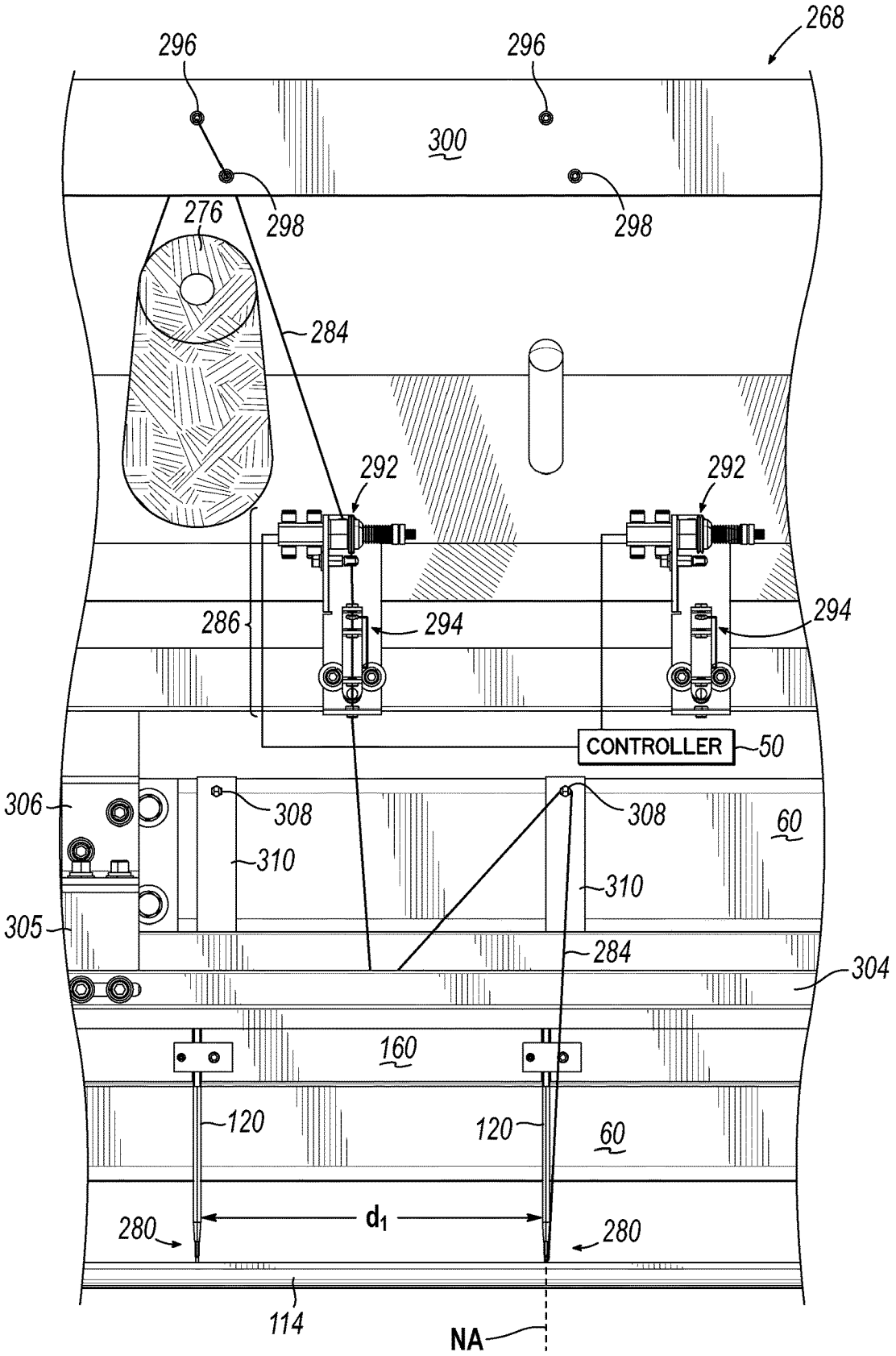
FIG. 14 is a front view of the quilting machine of FIG. 1 showing a needle thread flow path.

As best shown in FIG. 14, the machine 10 comprises a plurality of sewing stations 280 arranged in a row (e.g., nine shown) spaced laterally along the row. The lateral spacing in the row may be selected so that each sewing station 280 is offset from its neighboring sewing station along the y-axis 7 by a fixed distance $d_1$ (e.g., 12 inches) corresponding to the distance between needles 120 and corresponding stitch lines 34 produced by the machine 10. This spacing may enable the machine 10 to simultaneously produce stitch lines 34 having a desired spacing by synchronous operation of the sewing stations 280.

Figure 13:
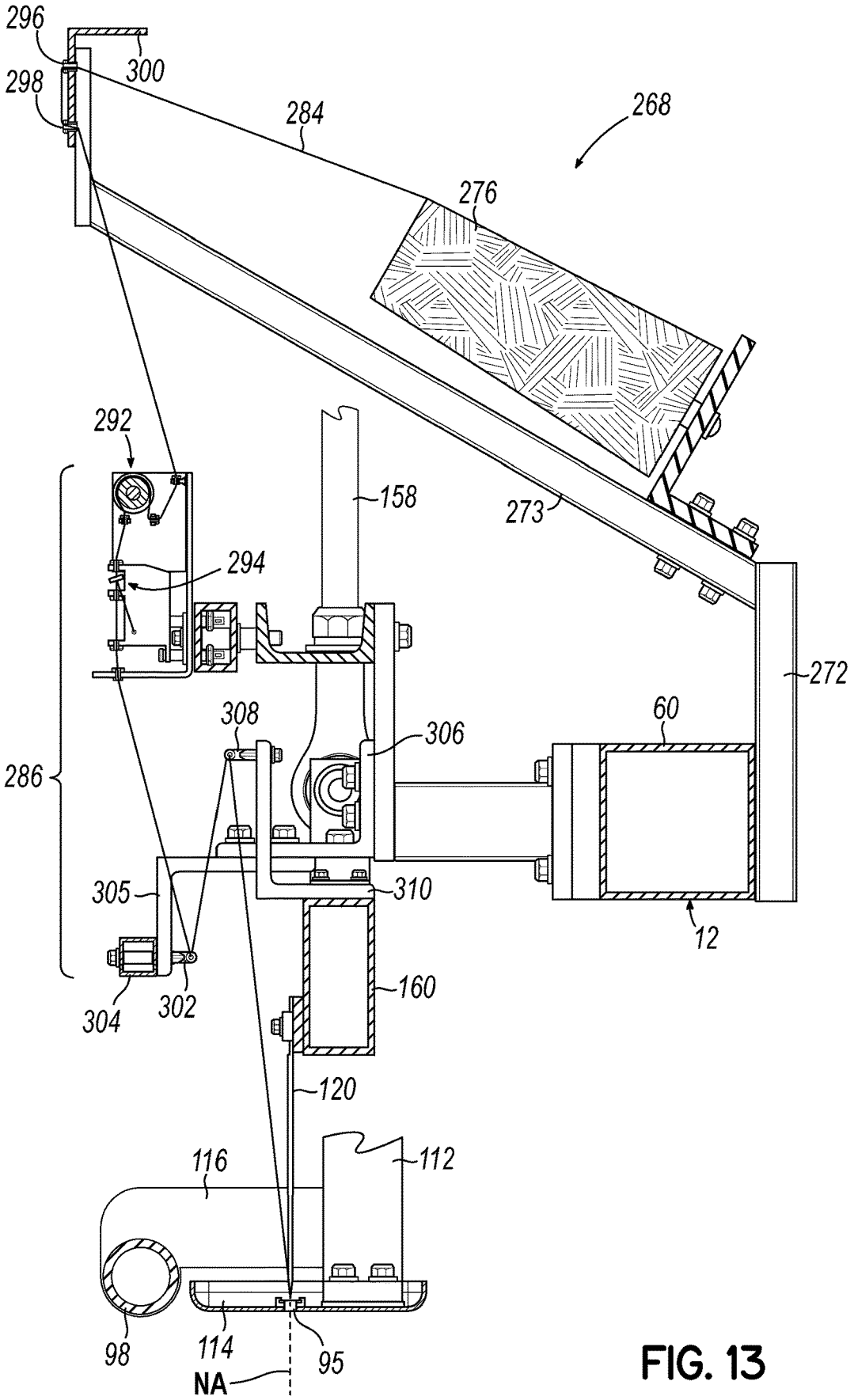
FIG. 13 is a cross-sectional view of the quilting machine of FIG. 1 showing a needle thread flow path.
Figure 15:
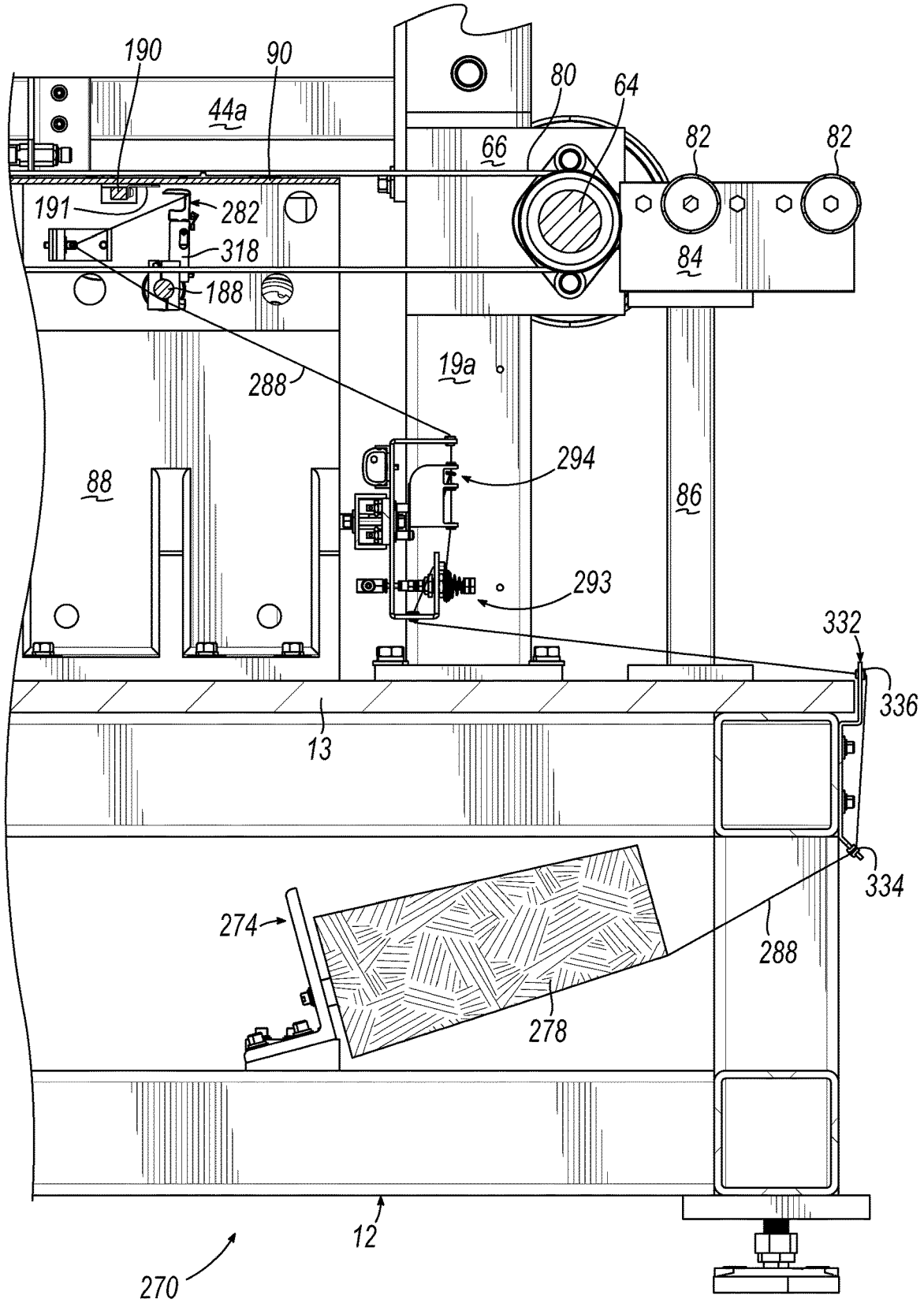
FIG. 15 is a cross-sectional view of a portion of the quilting machine of FIG. 1 showing a looper thread flow path.
Figure 16:
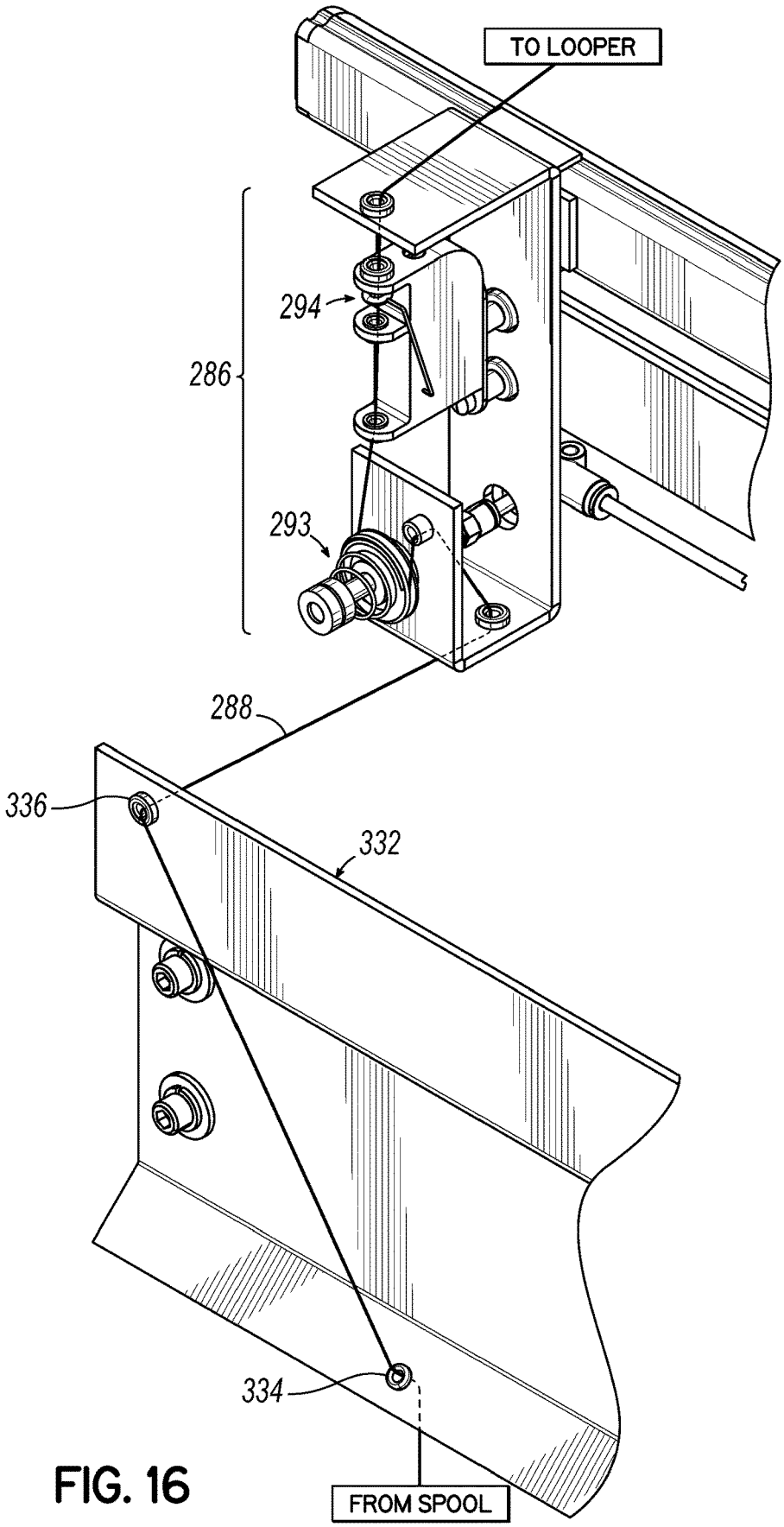
FIG. 16 is a perspective view of a portion of the quilting machine of FIG. 1 showing a looper thread flow path.

FIGS. 13 and 14 present respective side and front views of one needle assembly 268. The needle assembly 268 of each sewing station 280 is configured to reciprocate a needle 120 in a generally linear path along an axis NA thereof that is perpendicular to the quilting plane Q. FIGS. 15 and 16 present respective side and perspective views of one looper assembly 270. The corresponding looper assembly 270 is configured to oscillate a looper 282 in a plane that is generally perpendicular to the quilting plane Q and which intersects the path of the needle 120. The platen 114 is coupled to linear actuators 100 by arms 116 that moves the platen 114 linearly along the z-axis 8 to selectively release the input web 22 in response to activation of the platen servo motor 102.

As shown in FIGS. 13 and 14, each of the needle assemblies 268 receives needle thread 284 from its corresponding needle thread spool 276 through a needle thread handler 286. The needle thread handler 286 includes a thread tensioner 292 and a thread tension monitor 294, as disclosed in U.S. patent application Ser. No. 15/662,750, which is fully incorporated herein.

As shown in FIGS. 13 and 14, the needle thread 284 extends from the needle thread spool 276 upwardly through an upper eyelet 296 and lower eyelet 298 in an L-shaped bracket 300 mounted to diagonal member 273 of support structure 272. After exiting the lower eyelet 298, the needle thread 284 passes through the thread tensioner 292, the thread tension monitor 294 and then through an eyelet 302 secured to a stationary eyelet bar 304. The stationary eyelet bar 304 is secured to a stationary L-shaped bracket 305 which is bolted to another stationary L-shaped bracket 306 which is secured to one of the spanners 60 of frame 12. After exiting the eyelet 302, the needle thread 284 passes through an eyelet 308 secured to the top of an L-shaped bracket 310. The L-shaped bracket 310 is secured to and moves with the needle bar 160. After exiting the eyelet 308, the needle thread 284 passes through an opening 312 in the needle 120, as best shown in FIGS. 11A-11G.

As shown in FIGS. 15 and 16, the looper assembly 270 of each sewing station 280 is positioned beneath the corresponding needle assembly 268. Each looper assembly 270 includes a looper 282, a looper holder 318 and a spreader 191 secured to the retainer bar 190. Each looper assembly 270 receives looper thread 288 from the looper thread spool 278 through a looper thread handler 290. The looper assemblies 270 are transversely spaced on looper shaft 188, so that each looper 282 is in a generally vertical alignment with the needle 120 of the corresponding needle assembly 268 at a sewing station 280. The looper shaft 188 is configured to oscillate about an axis LSA (FIGS. 8A and 11A) of the looper shaft 188 synchronously with the reciprocal movement of the needle 120. This synchronous oscillation causes the loopers 282 to reciprocate in a vertical plane generally perpendicular to the quilting plane Q and parallel to the movement of the needle 120.

FIGS. 11A-11G depict a portion of the looper assembly 270 including the looper 282, a looper holder 318, the retainer bar 190 and the spreader 191. The looper holder 318 couples the looper 282 to the looper shaft 188. The looper 282 further includes a hook 320 having a tip 322 at a forward end thereof, and a base 324 at a rearward end thereof from which the hook 320 extends. The hook 320 includes a longitudinal bore or channel that connects an opening 326 at the back or rearward side of the looper 282 with an opening or eye 328 (FIG. 11D) at the tip 322. Looper thread 288 from the looper thread spool 278 enters the opening 326 in the back of the looper 282 and emerges from the eye 328 of looper 282. The base 324 of looper 282 may be secured to the looper holder 318 by a set screw 330. As best shown in FIG. 11A, a rearward end of spreader 191 may form a bracket that couples the spreader 191 to a retainer bar 190.

FIGS. 15 and 16 depict a looper thread tensioner 293 similar to needle thread tensioner 292 of the corresponding needle assembly 268 and a thread tension monitor 294 identical to the thread tension monitor of the corresponding needle assembly 268. The looper thread tensioner 293 is identical to the one disclosed in U.S. patent application Ser. No. 15/662,750.

The looper thread 288 may be received from the looper thread spool 278 and directed to the thread tensioner 293 by a guide bracket 332 secured to base 12. The guide bracket 332 has a lower thread guide 334 and an upper thread guide 336. After leaving the upper thread guide 336 of the guide bracket 332, the looper thread 288 enters the thread tensioner 293. After exiting the thread tensioner 293, the looper thread 288 may pass through the thread tension monitor 294 before being provided to the respective looper 282.

With reference to FIGS. 7A and 7B, the position of the needle 120 may be described in terms of the angular position of the cranks 156. As shown in FIG. 7A, the positions of the cranks 156 are considered to be at a 0-degree position when the needle 120 is at its most retracted position above the quilting plane Q along its axis NA, or its Top Dead Center (TDC) position. As shown in FIG. 7B, when the needle 120 is at its most extended position through the quilting plane Q along its axis NA, or its Bottom Dead Center (BDC) position, the cranks 156 are at 180 degrees. Because the movement of the looper 282 and spreader 191 are synchronized with the movement of the needle 120, the angular position of the cranks 156 also define the positions of these elements. Thus, the orientation of the needle 120, looper 282, and spreader 191, or the "stitch forming elements" 120, 282, 191, may be fully defined as a function of the angular position of the cranks 156, with each stitch cycle beginning at the 0-degree reference position and repeating for each 360 degrees of rotation.

FIG. 11A provides a perspective view that illustrates the positions of the stitch forming elements 120, 282, 191 at a point in the stitch cycle associated with the 0-degree position of the cranks 156. In this position, the needle 120 is fully retracted in its TDC or home position, the looper 282 is in its most forward or home position, the spreader 191 is in its home position, the needle thread 284 is wrapped around the hook 320 of looper 282 and around the looper thread 288.

As shown in FIG. 11B, while the stitch forming elements 120, 282, 191 are in their home positions as illustrated in FIG. 11A and the cranks 156 are in their 0-degree positions as illustrated in FIG. 7A, the feed assembly 38 indexes the input web 22 rearwardly or downstream as shown by the arrow 335 in a position direction along the x-axis 6 (to the left in FIG. 11B). As the input web 22 is indexed downstream a pre-programmed distance, the needle thread 284 is drawn through an eye 312 of needle 120 downwardly until it contacts the top surface 23 of input web 22 (see arrow 285), across the top surface 23 of the input web 22 below the platen 114 (to the left in FIG. 11B), downwardly through the input web 22, across the bottom surface 25 of the input web 22 above the needle plate 90 (to the right in FIG. 11B), around the hook 320 of looper 282 forming a loop 297 around the hook 320 of looper 282, back across the bottom surface 25 of the input web 22 above the needle plate 90 (to the left in FIG. 11B), back up through the input web 22 and across the top surface 23 of the input web 22 below the platen 114 (to the left in FIG. 11B) which is the top of the previous chain stitch.

As shown in FIG. 11B, during movement of the input web 22 downstream, the looper thread 288 is pulled through the hook 320 of looper 282 (see arrow 289), passes through the loop 297 of needle thread 284 around the hook 320 of looper 282 and through another loop 299 of needle thread 284, moves upstream across the bottom surface 25 of the input web 22 and around the two sections of needle thread 284 which become the sides of the chain stitches, and back through the loop 299 of needle thread 284. This process repeats itself each time the input web is moved downstream.

Figure 11C:
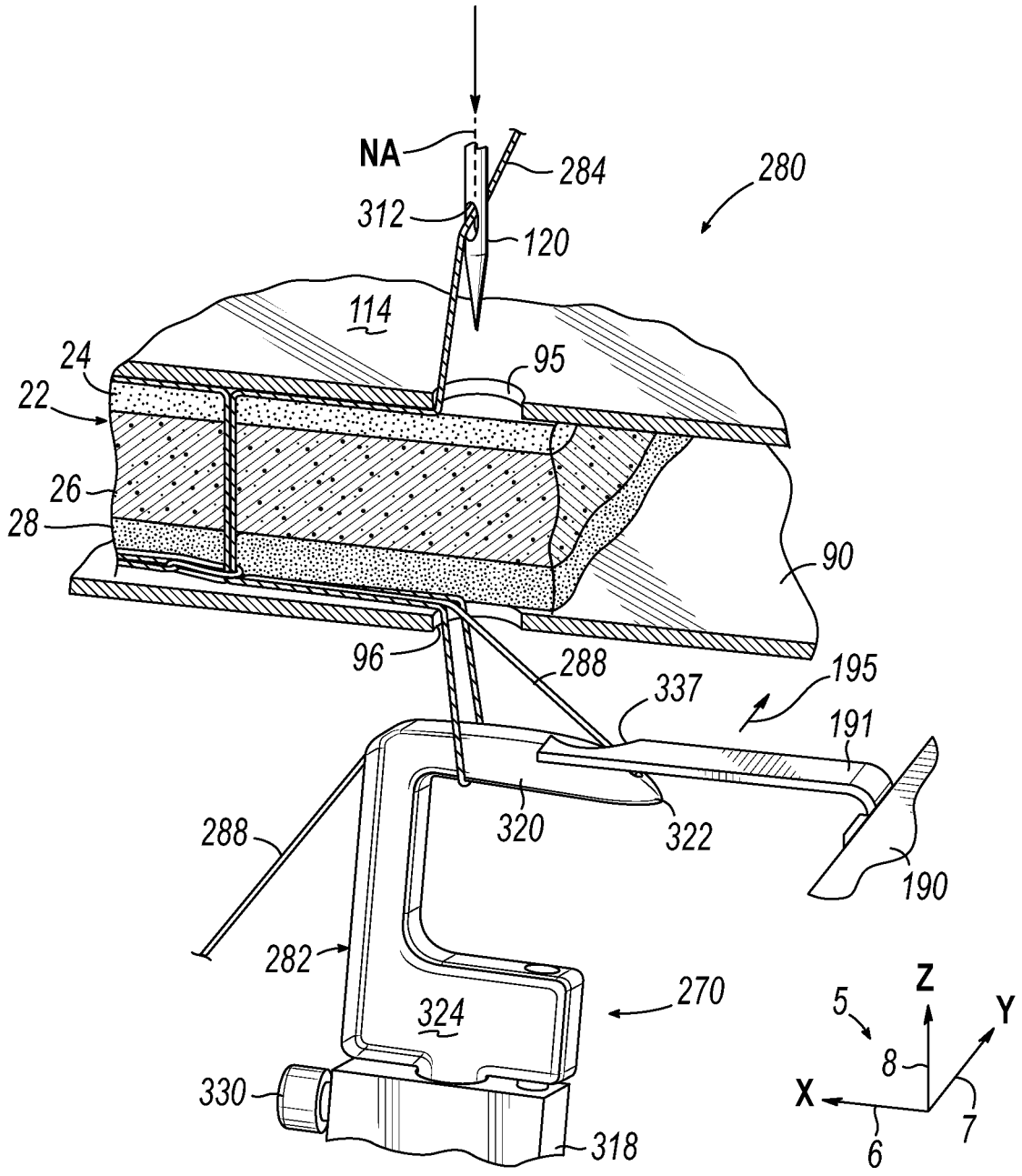
FIG. 11C is a perspective view of the needle moving downwardly after the input web has moved downstream a desired distance.

As shown in FIG. 11C, as the stitch cycle begins, the cranks 156 rotating from their 0-degree positions, the needle 120 lowers from its TDC or home position and begins to move toward the input web 22. When the cranks 156 reach the 52 degree positions, the spreader 191 begins to move from its home position shown in FIG. 11A towards an extended position direction along the y-axis 7 shown by arrow 195. The looper 282 remains stationary in its home position.

Figure 11D:
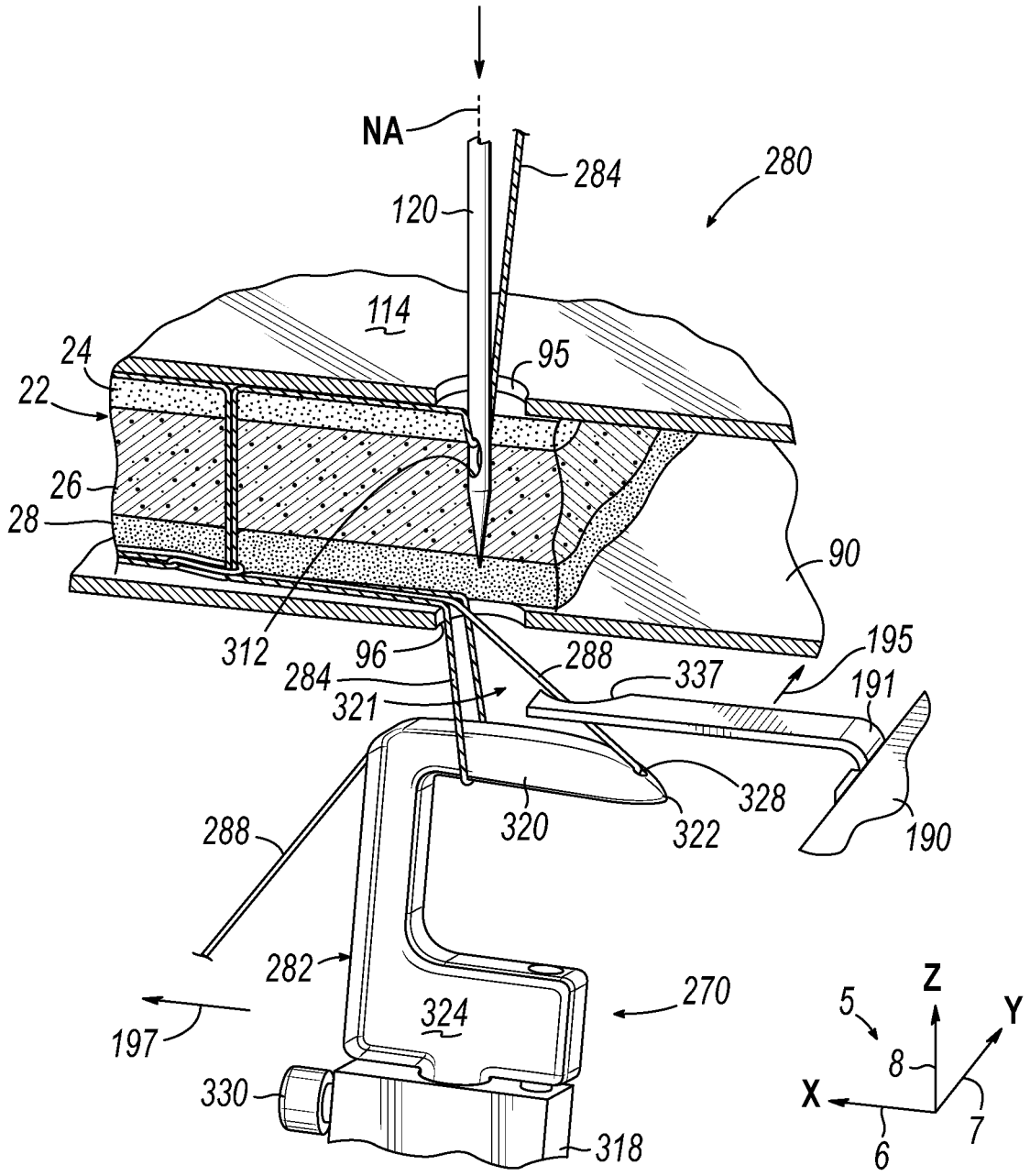
FIG. 11D is a perspective view of the needle moving further downwardly, the lopper moving in a negative direction along the x-axis and the spreader moving along the y-axis in a positive direction.

As shown in FIG. 11D, when the cranks 156 have rotated to the 100 degree point in the stitch cycle and the needle 120 has entered the input web 22, the looper 282 begins to move rearwardly from its home position (to the left in FIG. 11C) as shown by the arrow 197 in FIG. 11D. The needle 120 is illustrated passing through the input web 22. The spreader 191 is still moving towards its fully extended position furthest along the Y-axis from its home position. The looper thread 288 gets grabbed by a notch 337 in the spreader 191 during the movement of the spreader 191 to open a triangle 321 having sides defined by the needle thread 284, the hook 320 of looper 282, and the looper thread 288.

To further explain the movement of the spreader 191, when the cranks 156 have rotated to the 122 degree point in the stitch cycle, the spreader 190 is in its fully extended position. As the cranks 156 move between 122 degrees and 142 degrees, the spreader 190 dwells or remains in its fully extended position. When the cranks 156 reach 142 degrees, the spreader 190 begins to move towards its home position. as shown by the arrow 193 in FIG. 11E. When the cranks 156 have rotated to the 212 degree point in the stitch cycle, the spreader 191 is finally back to its home position.

Figure 11E:
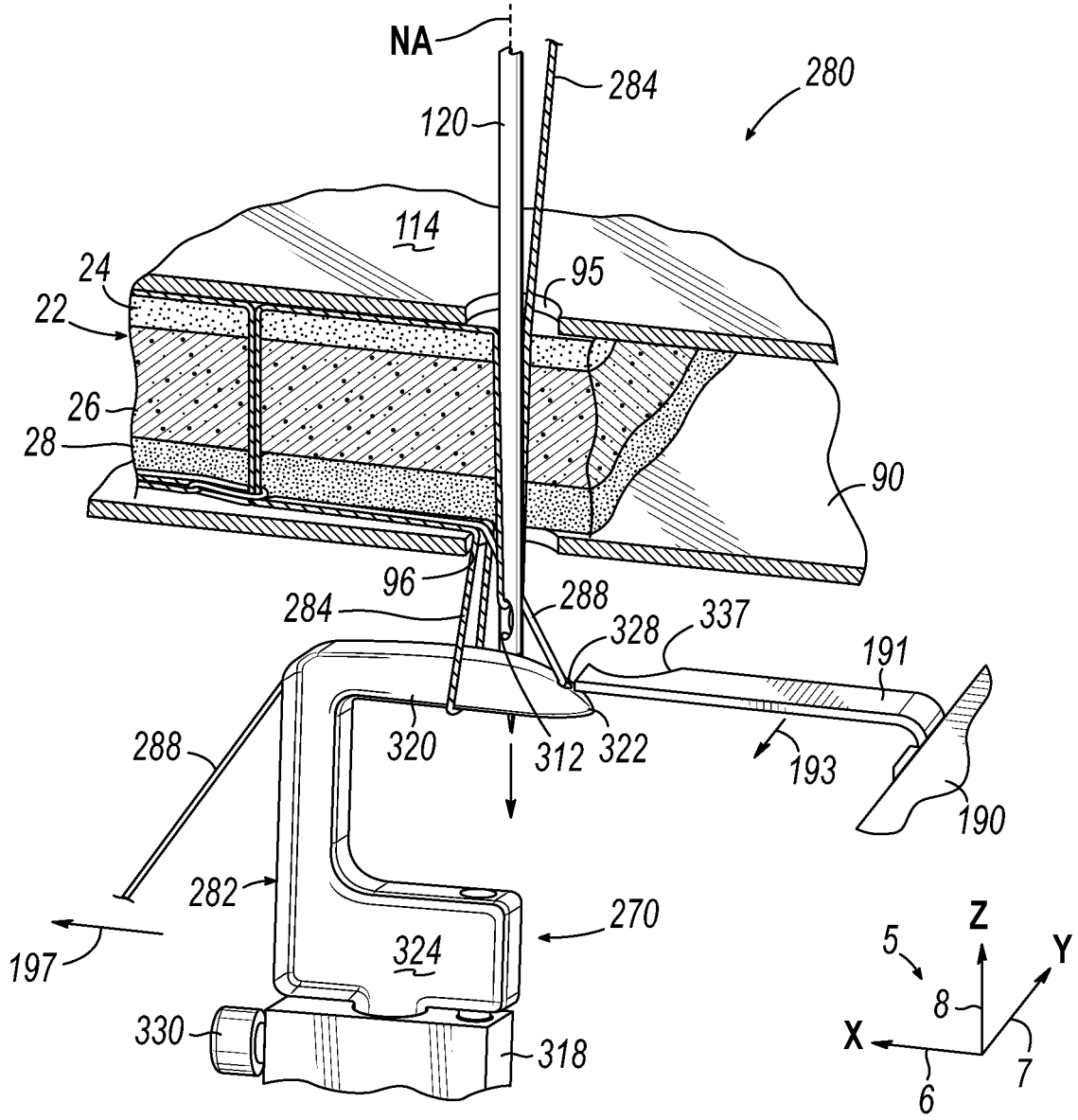
FIG. 11E is a perspective view of the needle moving further downwardly, the lopper moving further in a negative direction along the x-axis and the spreader moving along the y-axis in a negative direction.

FIG. 11E depicts stitch forming elements 120, 282, 191 at a point in the stitch cycle when the cranks 156 are approaching their 180-degree positions as illustrated in FIG. 7B. The needle 120 is illustrated having passed through the input web 22. The looper 282 is illustrated moving further downstream or in a positive direction in the x-axis 6 from its position shown in FIG. 11D. The needle 120 has begun passing through the triangle 321. The spreader 191 is moving towards its home position, as indicated by arrow 193 and the looper 282 is still moving away its home position, as indicated by arrow 197.

Figure 11F:
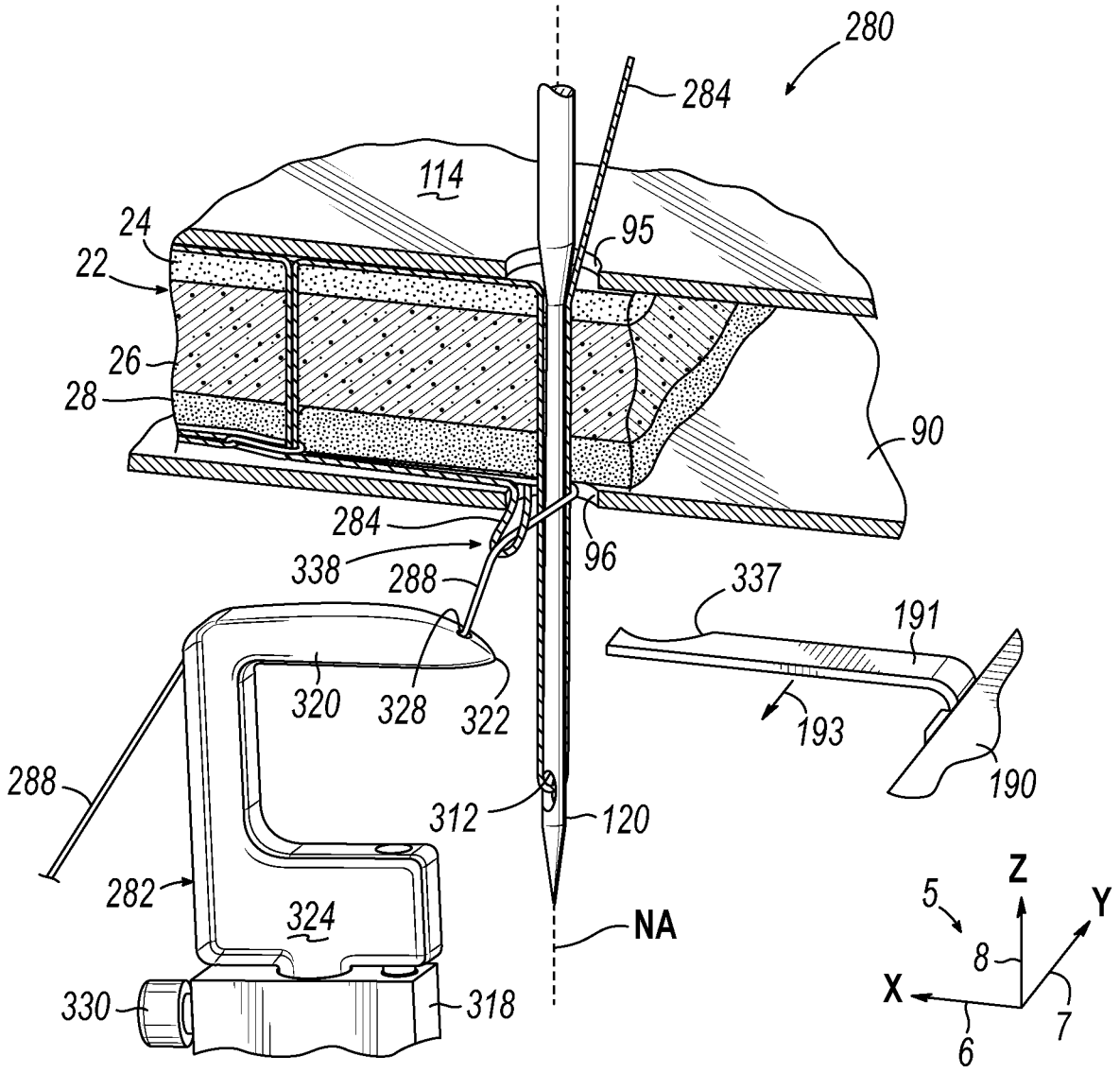
FIG. 11F is a perspective view of the needle at its lowest point, the lopper at its rearmost position along the x-axis and the spreader moving further along the y-axis in a negative direction.

FIG. 11F depicts stitch forming elements 120, 282, 191 at a point in the stitch cycle when the cranks 156 are in their 180-degree positions as illustrated in FIG. 7B. In this position, the needle 120 is in its BDC position fully extended through the platen hole 95 in platen 114, the input web 22 and needle hole 96 of needle plate 90. The looper 282 is stationary in its rearward position (i.e., its most extended position in the positive direction of the x-axis 6), and the spreader 191 is moving upstream towards its home position as shown by arrow 193. The needle thread 284 passes through an eye 312 of needle 120 proximate the tip thereof and extends from the opposite side of the needle 120 to the last formed stitch 338. The looper thread 288 extends from the tip 322 of hook 320 to the last formed stitch 338, which is now completely formed but may remain to be tightened.

Figure 11G:
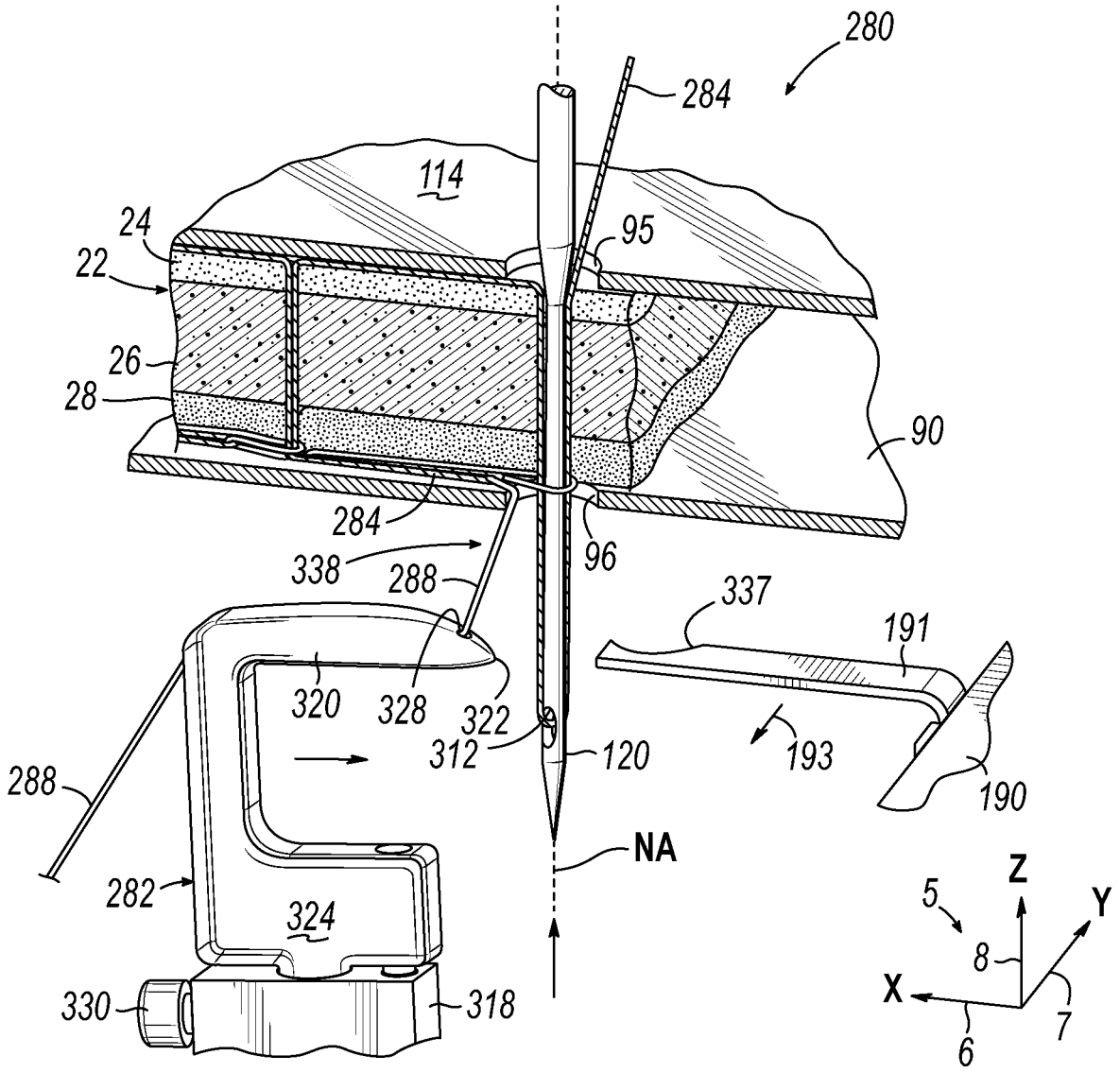
FIG. 11G is a perspective view of the needle moving upwardly towards its home position, the lopper moving towards its home position in a positive direction along the x-axis and the spreader moving further along the y-axis in a negative direction.

As illustrated by FIG. 11G, the needle 120 begins to move upwardly as the cranks 156 rotate past the 180-degree position in the stitch cycle. At this point, the looper 282 is moving upstream towards its home position (e.g., in a negative direction with respect to x-axis 6), and the spreader 191 is still moving towards its home position, as indicated by arrow 193.

Figure 11H:
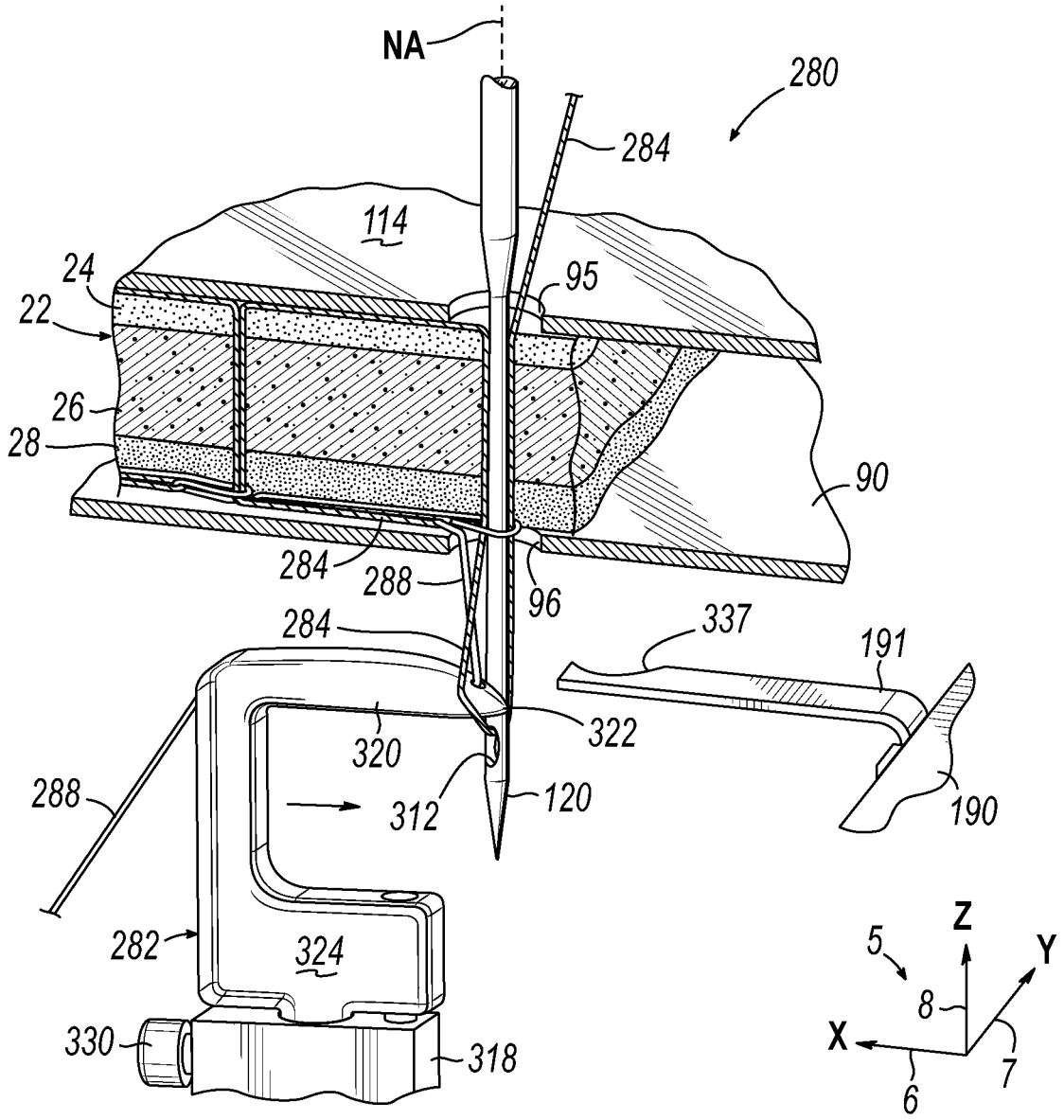
FIG. 11H is a perspective view of the needle moving further upwardly towards its home position, the lopper moving towards its home position in a positive direction along the x-axis and the spreader in its home position.

Further rotation of the cranks 156 brings the stitch forming elements 120, 282, 191 to the positions depicted in FIG. 11H. At this point, the tip 322 of hook 320 of looper 282 passes against the looper facing side of the needle 120 and slips between the needle thread 284 and the needle 120 as it enters from the stitch side of the needle 120. As illustrated by FIG. 11H, as the looper 282 continues moving upstream (e.g., in a negative direction with respect to x-axis 6), the needle thread 284 wraps around the hook 320 of looper 282, and the needle 120 raises upwardly, pulling more needle thread 284 through the opening 312 in needle 120 until the stitch forming elements 120, 282, 191 return to their home positions depicted in FIG. 11A.

After the chain stitch is completed, the feed servo-motor 40 is activated by the controller 50, causing rotation of the endless feed belts 80, thereby moving the input web 22 a pre-programmed distance in the downstream direction which is depicted as the positive direction along the x-axis 6.

Figure 17:
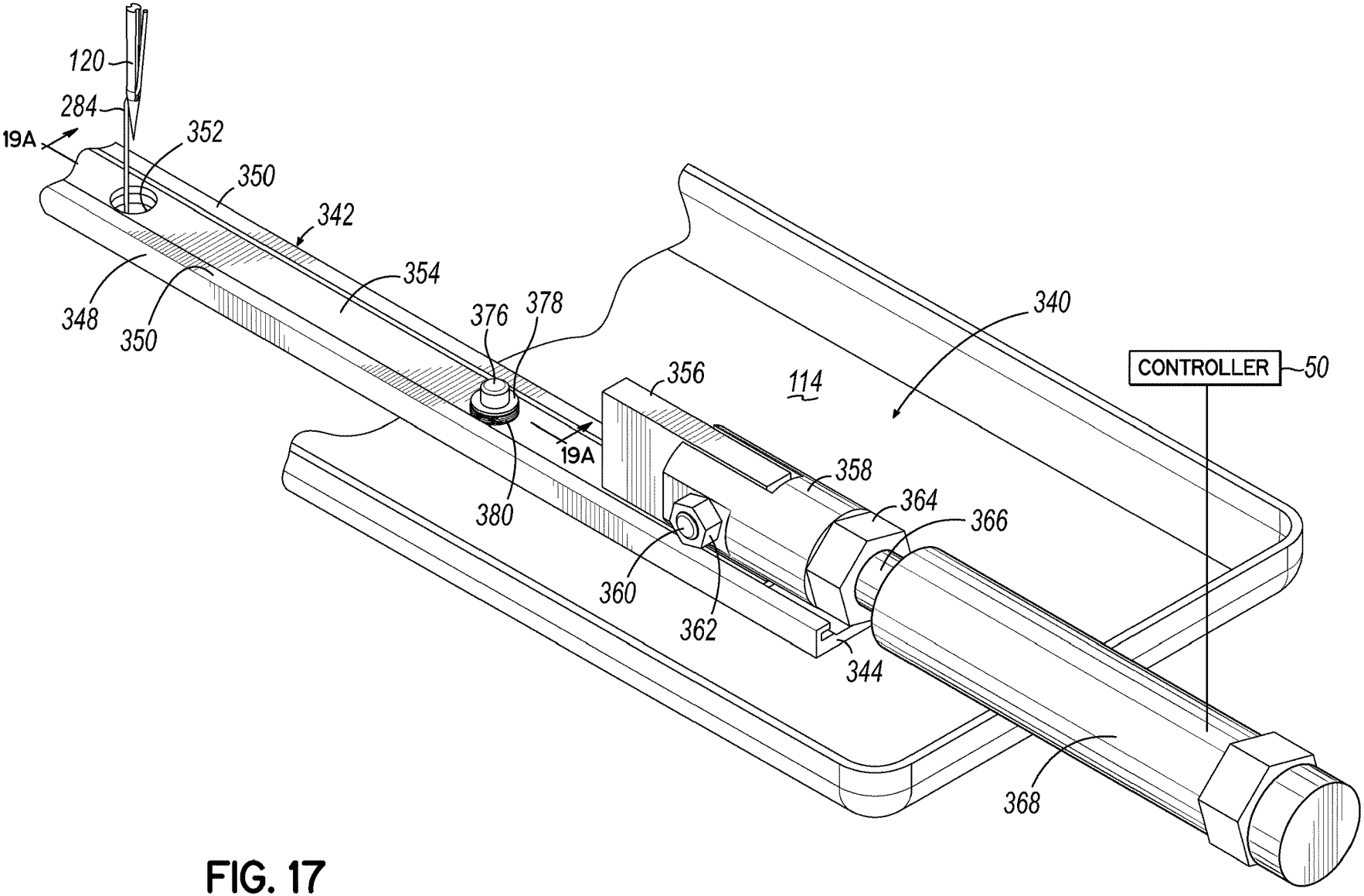
FIG. 17 is an enlarged front perspective view of a portion of the needle thread cutting assembly of FIG. 12.
Figure 18:
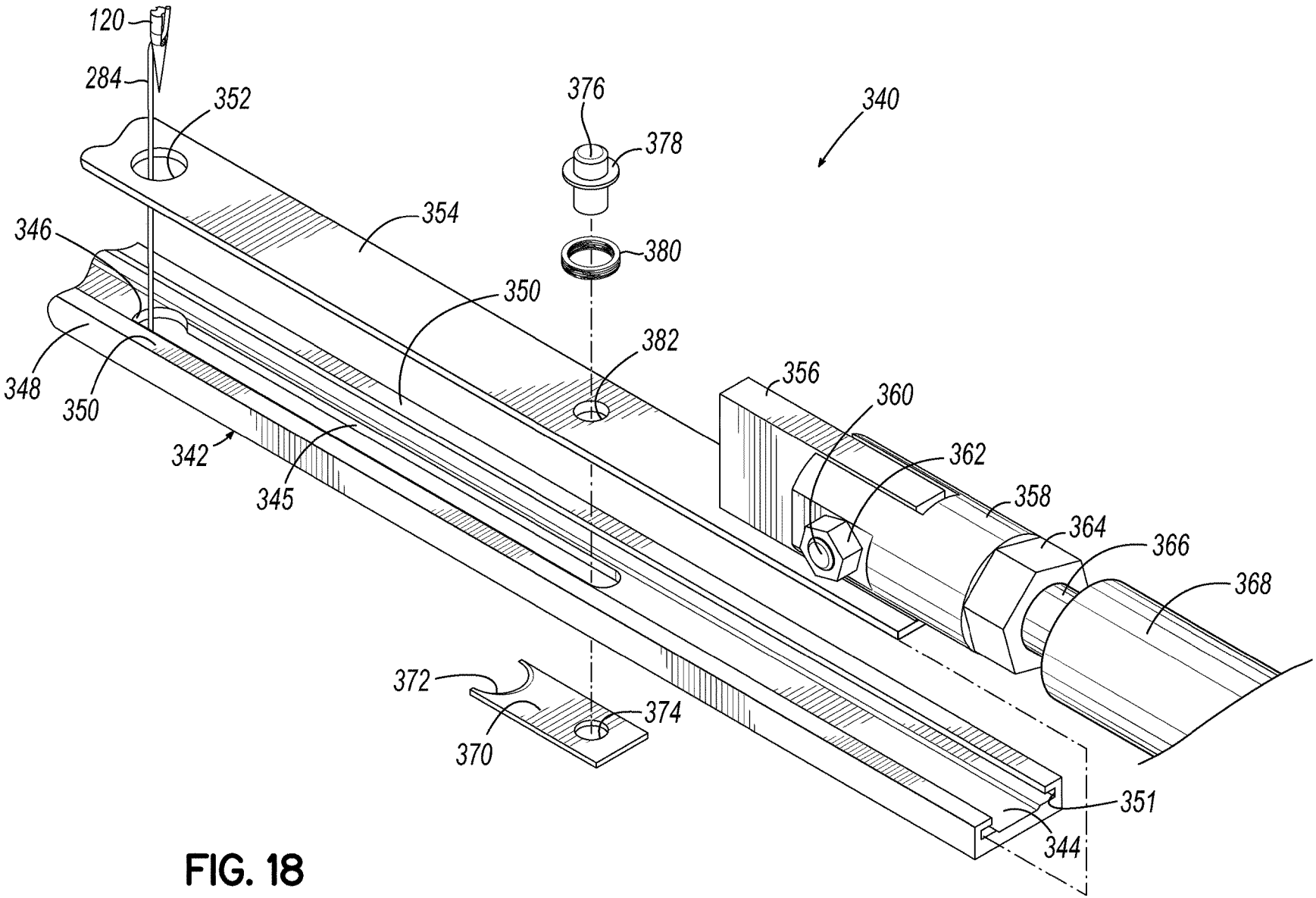
FIG. 18 is a disassembled front perspective view of a portion of the needle thread cutting assembly of FIG. 17.

Referring now to FIGS. 17-19C, a needle thread cutting assembly 340 whose operation is controlled by controller 50 is illustrated. As shown in FIG. 12, the needle thread cutting assembly 340 extends across the machine generally in the direction of the y-axis 7 and functions to cut all the needle threads 284 simultaneously upon the completion of a job. FIG. 17 illustrates a portion of the needle thread cutting assembly 340 in an assembled condition. FIG. 18 shows the same portion of the needle thread cutting assembly 340 in a disassembled condition. As shown in FIG. 17, the needle thread cutting assembly 340 comprises a rail 342 secured to the platen 114. As shown in FIG. 18, the rail 342 has a bottom 344 having a plurality of keyhole slots 345 (only one being shown), sides 348 and lips 350 extending towards each other from sides 346 which define an inner groove 351 in rail 342 inside which moves a slider 354. As shown in FIG. 19A, each keyhole slot 345 has a circular end opening 346 which is aligned with an opening 352 (only one being shown) in the slider 354 when the needle thread cutting assembly 340 is at rest. As shown in FIG. 18, a slider mounting block 356 is secured to the slider 354 and a clevis 358 is bolted to the slider mounting block 356 with bolt 360 and nut 362. A large nut 364 secures the clevis 358 to a moving rod 366 which is moved by a pneumatic cylinder 368 controlled by controller 50.

As best shown in FIG. 18, the needle thread cutting assembly 340 further comprises a blade 370 having a cutting edge 372 and an opening 374. A pin 376 has a removable snap ring 378 which fits inside a groove 381 (FIGS. 19A-19C) in the pin 376 such that to the snap ring 378 may be quickly and easily removed to remove the blade 370. The pin 376 fits inside the opening 374 of blade 370 and is welded to the blade 370. The pin 376 extends through an opening 382 in the slider 354 and moves inside the keyhole slot 345. The blade 370 moves along a slot (not shown) underneath the rail 342 as the pin 376 moves in the keyhole slot 345. A spring 380 is sandwiched between the removable snap ring 378 and the slider 354 to urge the pin 376 upwardly, thus keeping the blade 370 against the slider 354.

Figure 19A:
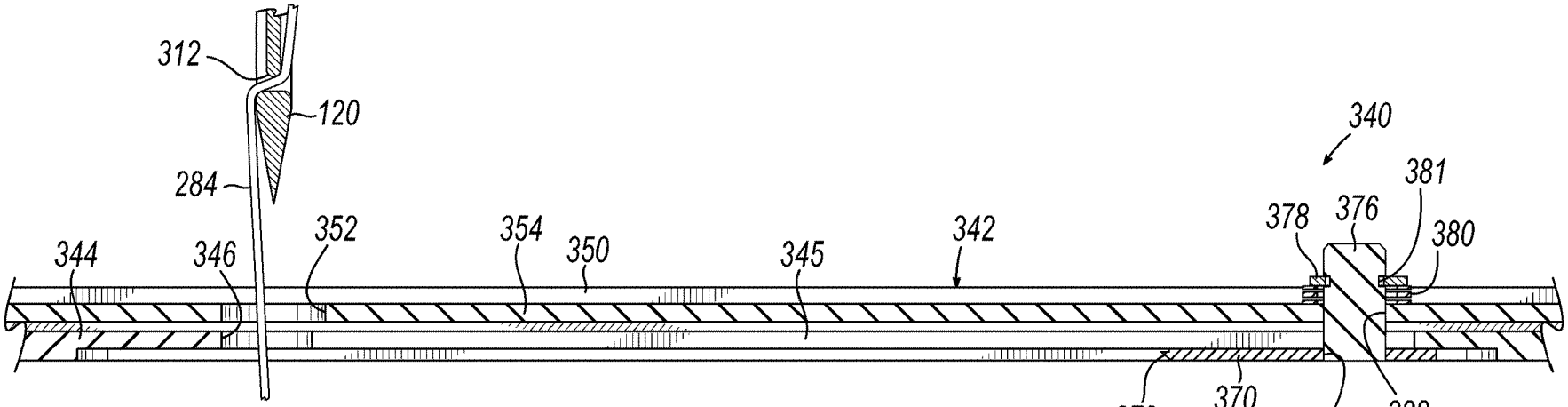
FIG. 19A is a cross-sectional view taken along the line 19A-19A of a portion of the needle thread cutting assembly of FIG. 17 before movement of the cutting bar.
Figure 19B:
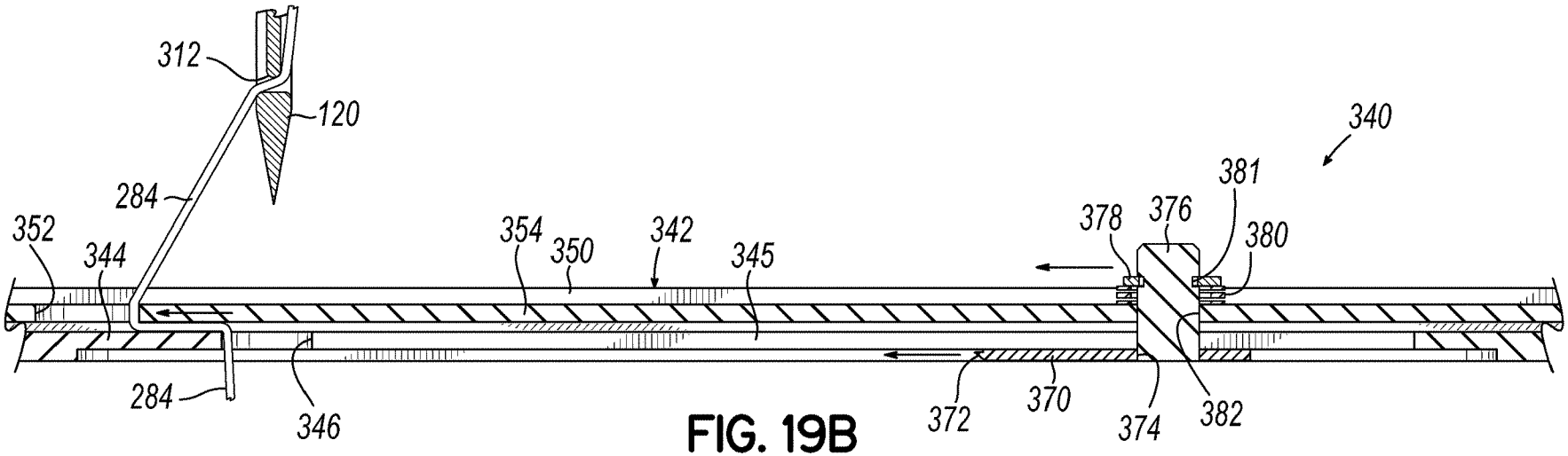
FIG. 19B is a cross-sectional view of a portion of the cutting assembly of FIG. 12 during movement of the cutting bar.
Figure 19C:
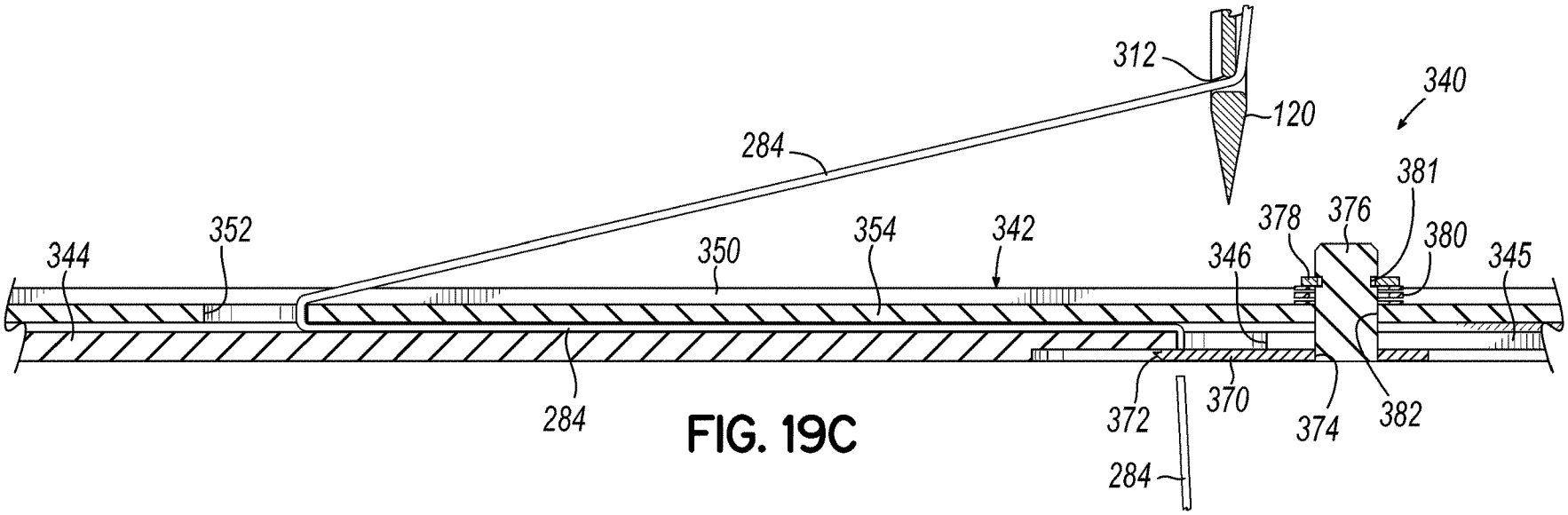
FIG. 19C is a cross-sectional view of a portion of the cutting assembly of FIG. 12 after the needle thread is cut.

FIGS. 19A-19C illustrate operation of the needle thread cutting assembly 340. FIG. 19A illustrates the needle thread cutting assembly 340 at rest, opening 352 of the movable slider 354 being aligned with the stationary circular end opening 346 of the keyhole slot 345 of the rail 342. The needle thread 284 extends through the aligned openings 352, 246.

FIG. 19B illustrates the needle thread cutting assembly 340 being activated by the controller 50, the pneumatic cylinder 368 extending the moving rod 366 to move the slider 354, blade 370 and pin 376 away from the pneumatic cylinder 368. The openings 352 of the movable slider 354 pull the needle threads 284 (only one being shown) through the openings 312 in needles 120 (only one being shown), the needle threads 284 still extending through the stationary circular end openings 346 of the keyhole slots 345 (only one being shown) of the rail 342.

FIG. 19C illustrates the needle thread cutting assembly 340 being further activated by the controller 50, the pneumatic cylinder 368 further extending the moving rod 366 to move the slider 354, blade 370 and pin 376 further away from the pneumatic cylinder 368. The openings 352 (only one being shown) of the movable slider 354 continue to pull the needle threads 284 (only one being shown) through the openings 312 in needles 120 (only one being shown), the needle threads 284 still extending through the stationary circular end openings 346 of the keyhole slots 345 (only one being shown) of the rail 342 until the cutting edges 372 of blades 370 (only one being shown) cut the needle threads 284 (only one being shown). After the needle threads 284 are cut, the moving rod 366 is pulled back inside the pneumatic cylinder 368 to the position shown in FIG. 19A.

Figure 20:
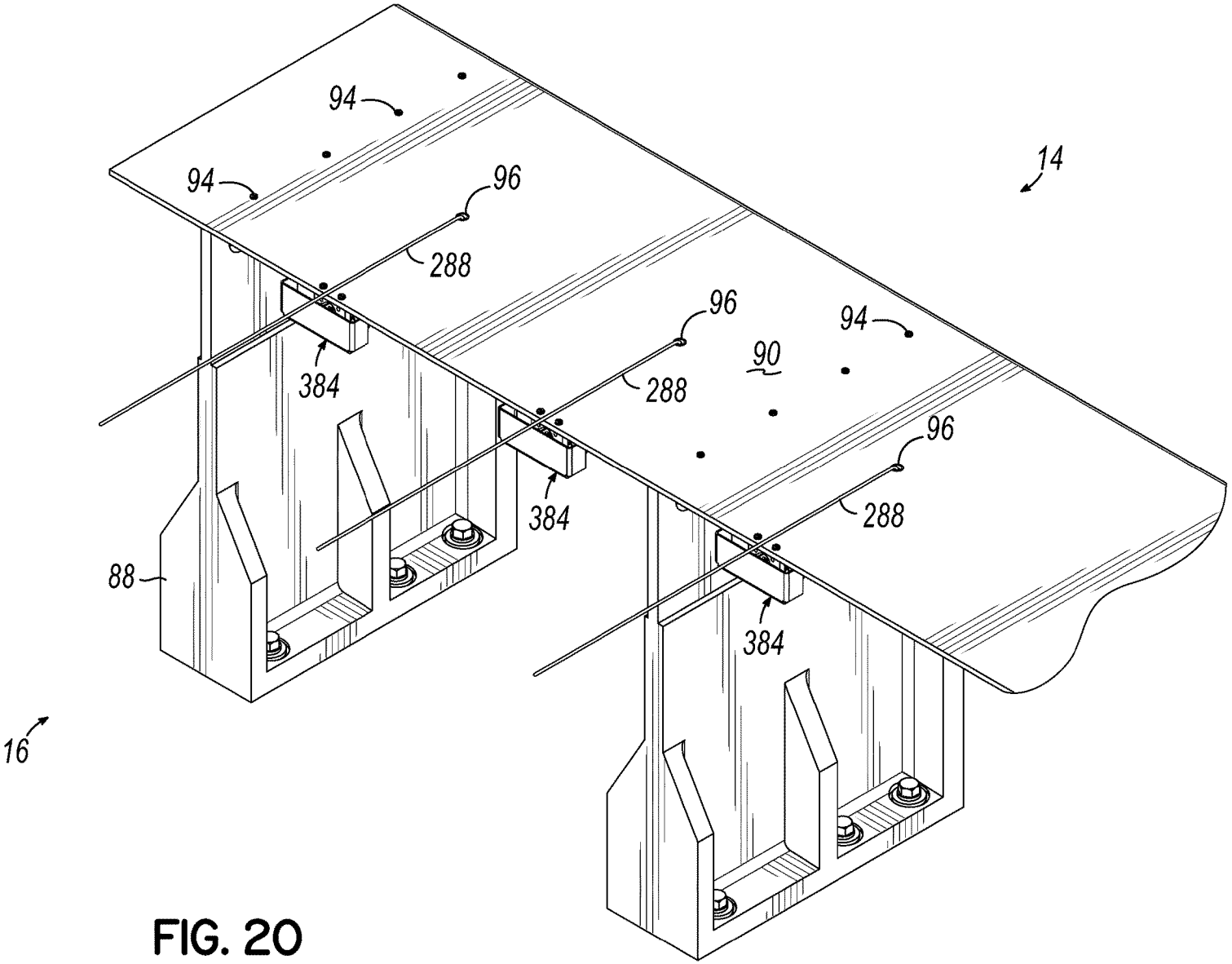
FIG. 20 is an enlarged rear perspective view of a portion of the quilting machine of FIG. 1 showing three looper thread cutters.
Figure 21A:
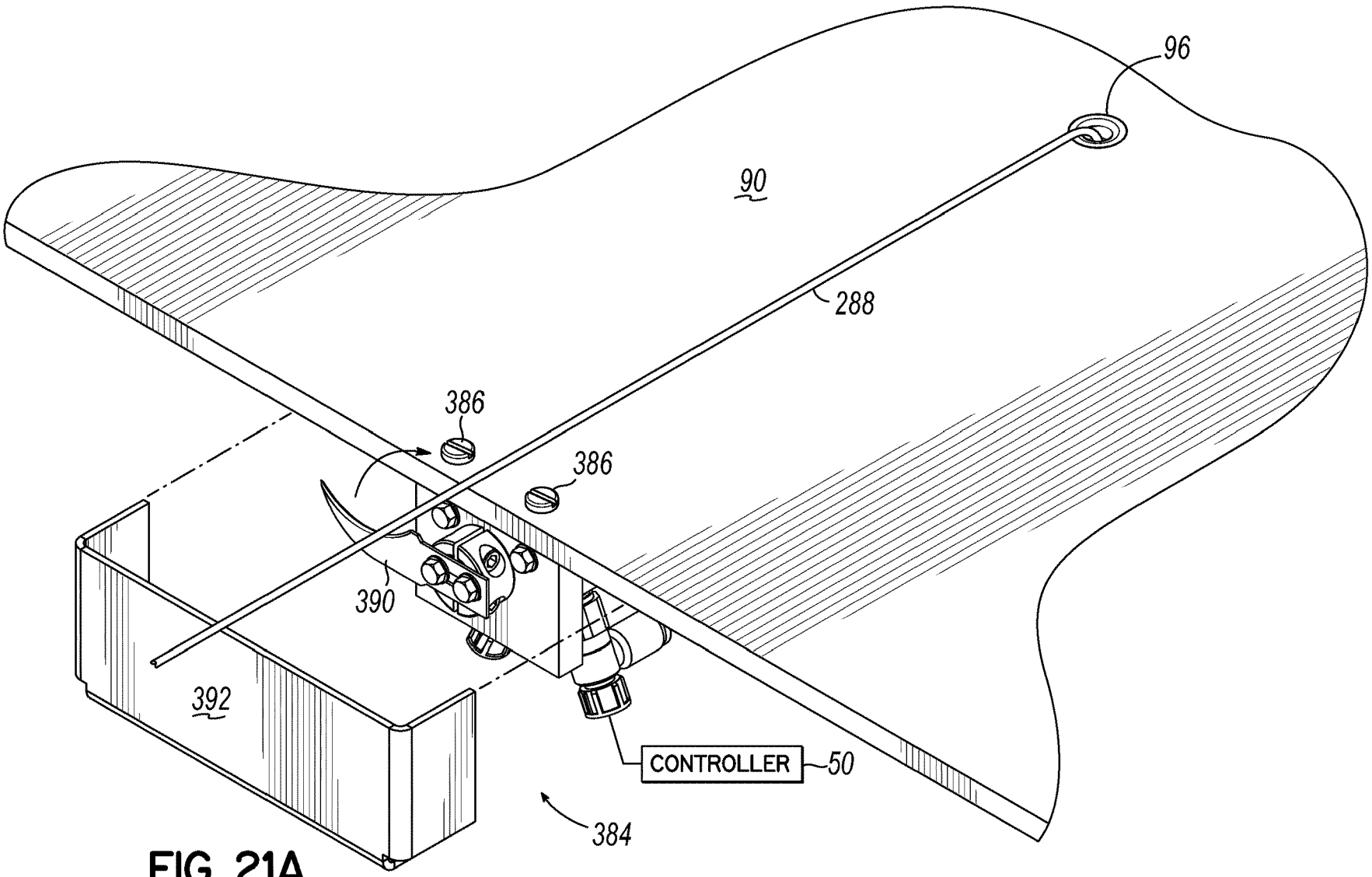
FIG. 21A is a partially disassembled view of one of the looper thread cutters prior to cutting a looper thread.
Figure 21B:
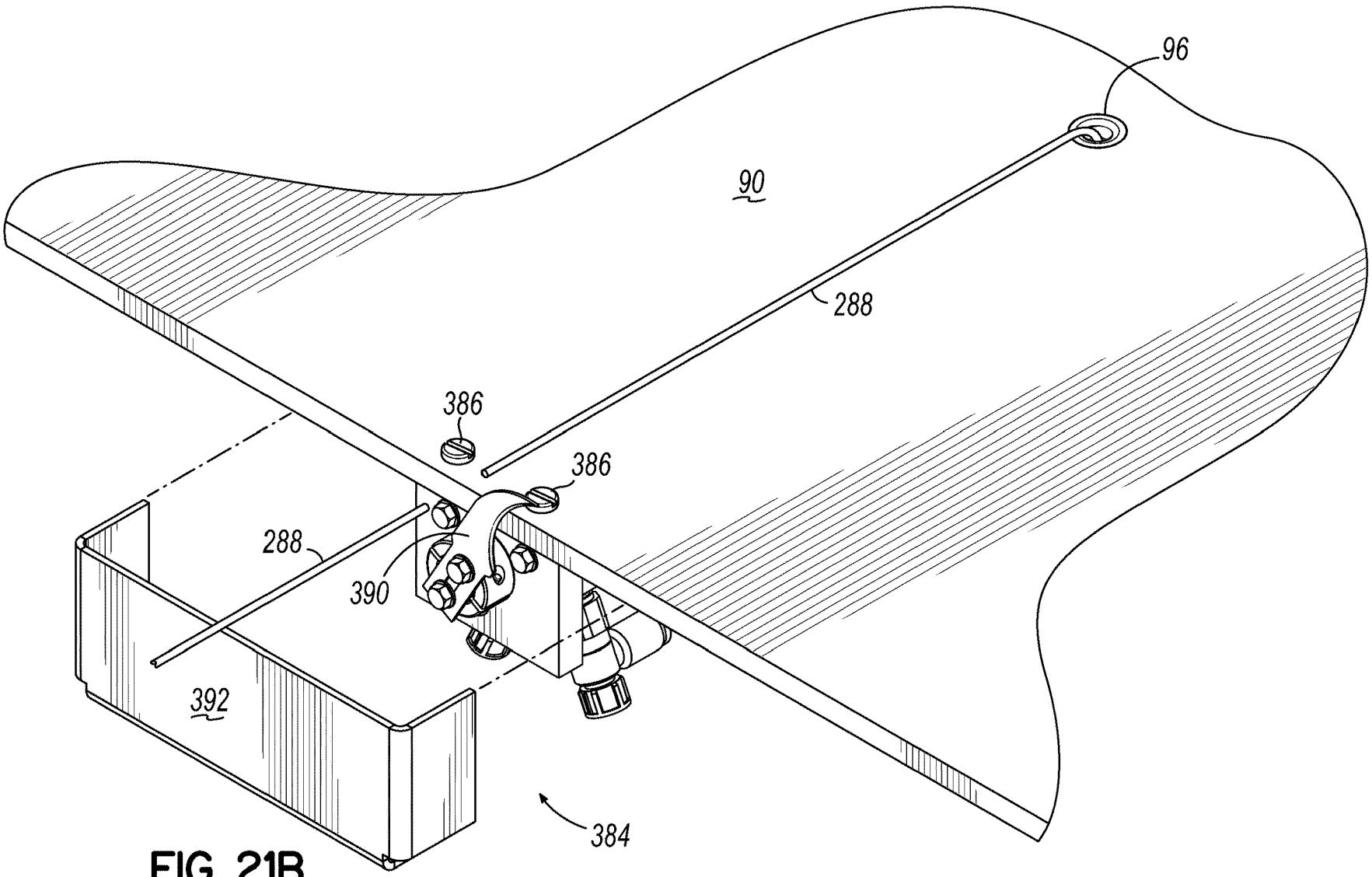
FIG. 21B is a partially disassembled view of one of the looper thread cutters after cutting a looper thread.

Referring now to FIGS. 20-21B, three (of nine) looper thread cutting assemblies 384 are illustrated, each one of which is controlled by controller 50. As shown in FIG. 21A, each looper thread cutting assembly 384 is secured to the needle plate 90 with fasteners 386 and functions to cut one the looper threads 288 upon the completion of a job. FIG. 21A illustrates a portion of a looper thread cutting assembly 384 in a partially assembled condition before the looper thread 288 is cut. FIG. 21A illustrates a blade 390 in a home position and a cover 392 pulled away from the needle plate 90. FIG. 21B shows the same portion of the looper thread cutting assembly 340 in a partially assembled condition after the looper thread 288 is cut. FIG. 21B illustrates the blade 390 in a finished position.

Figure 22A:
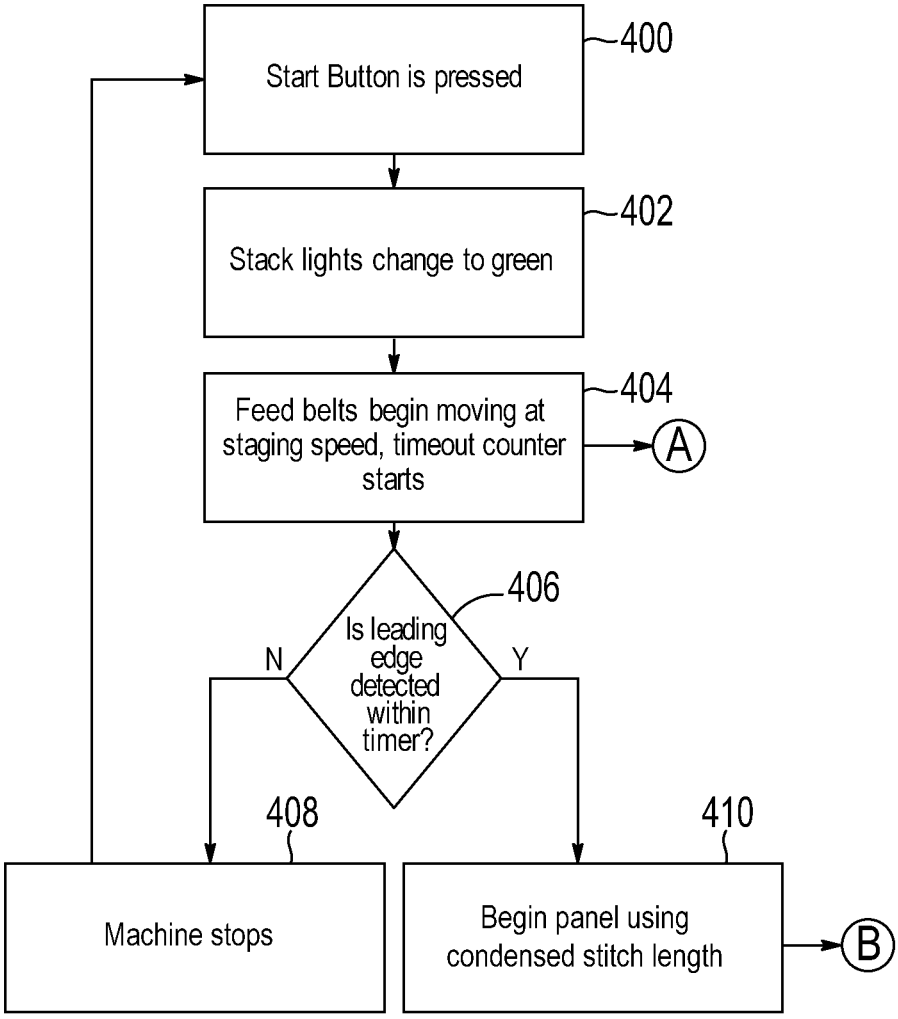
FIG. 22A-22E illustrate a flow chart of the operation of the quilting machine of the present invention.
Figure 22B:
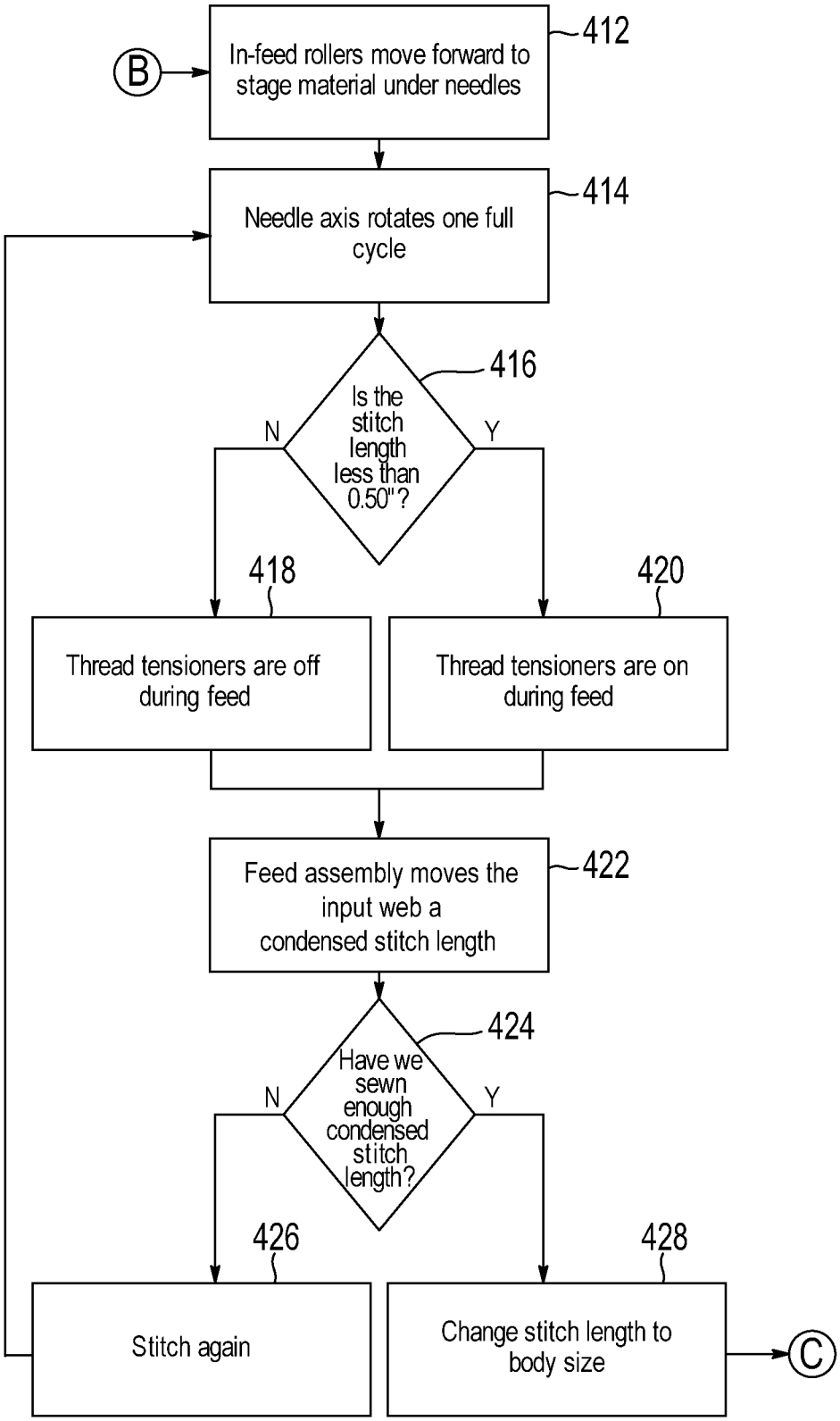
Figure 22C:
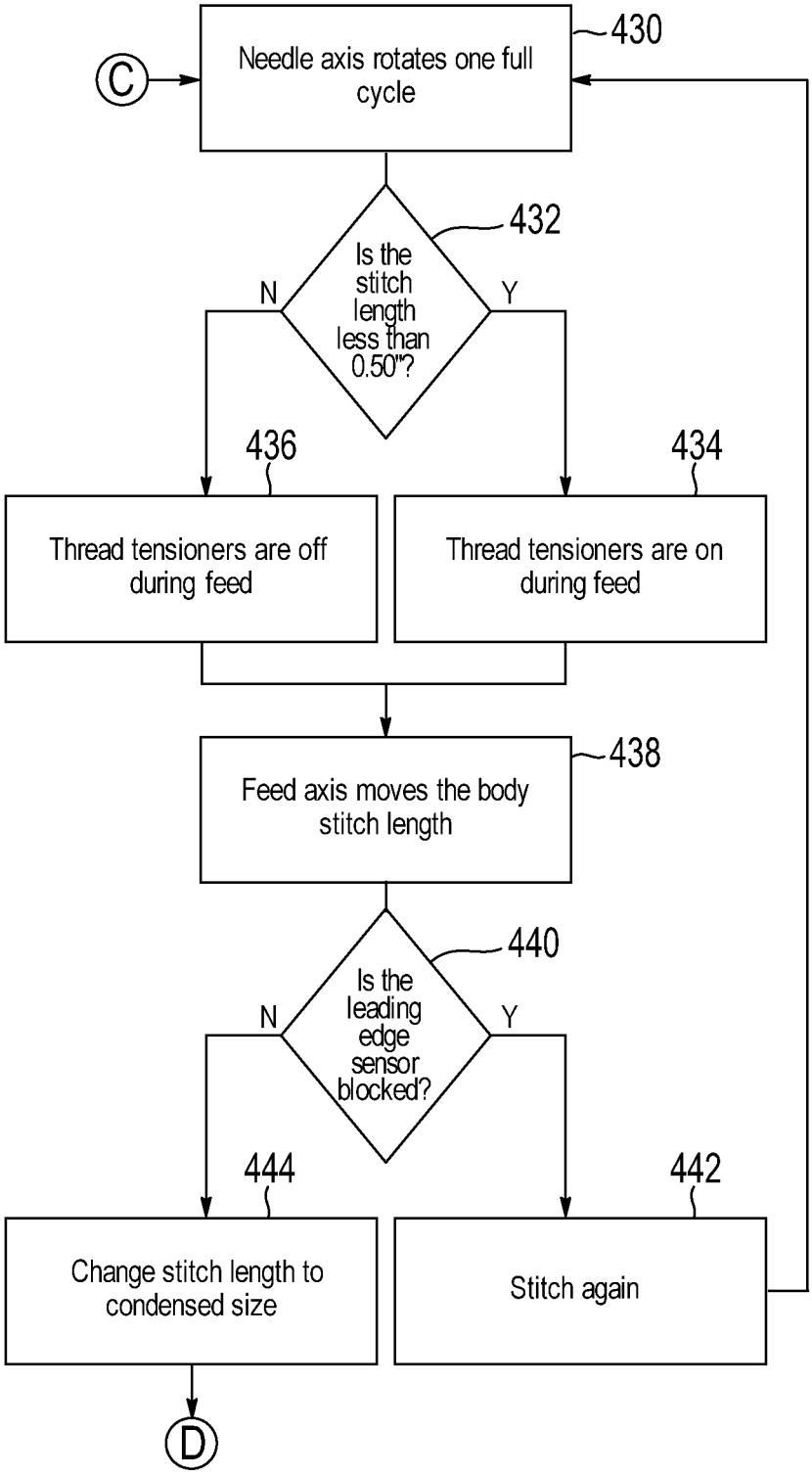
Figure 22D:
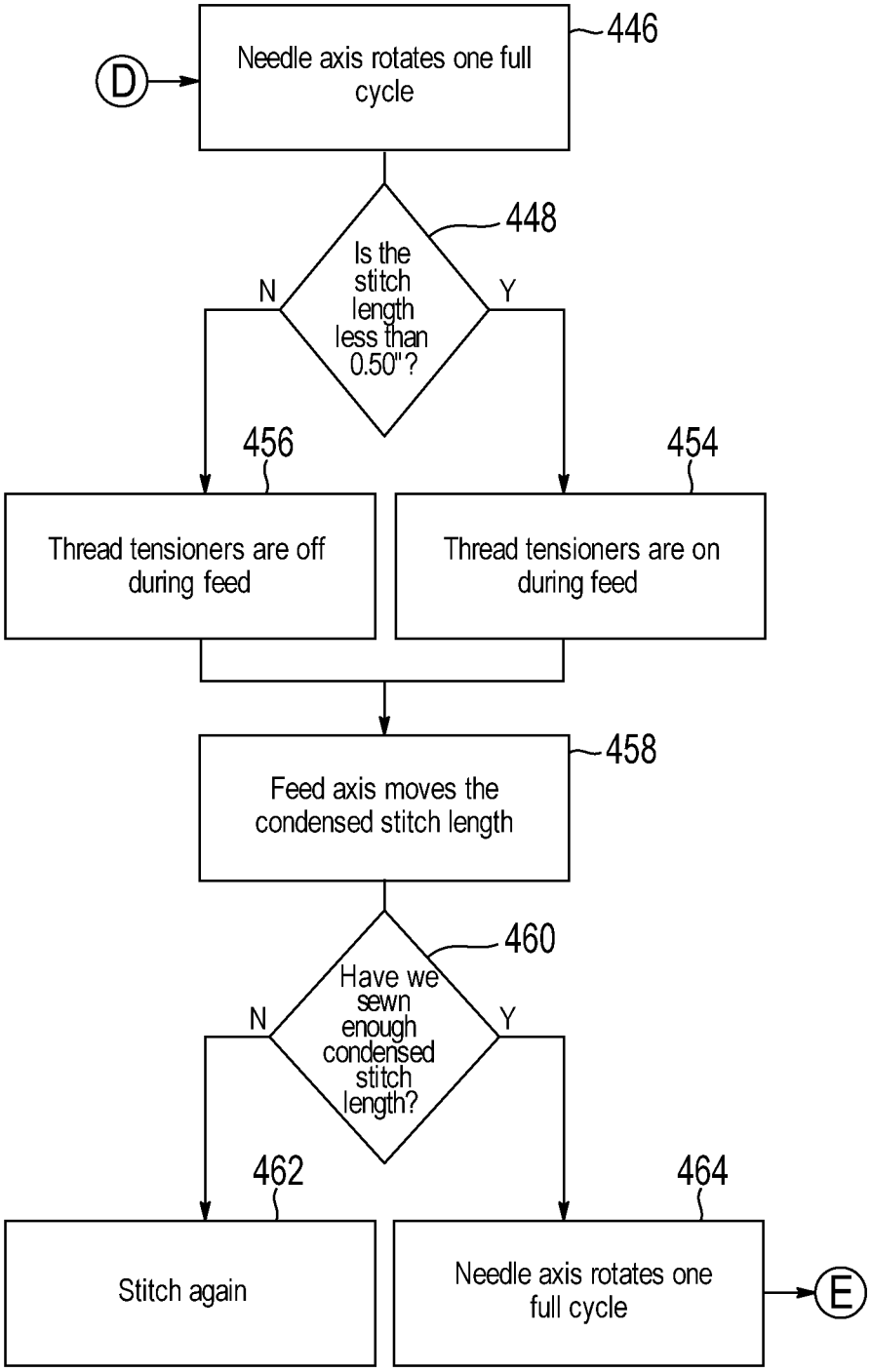
Figure 22E:
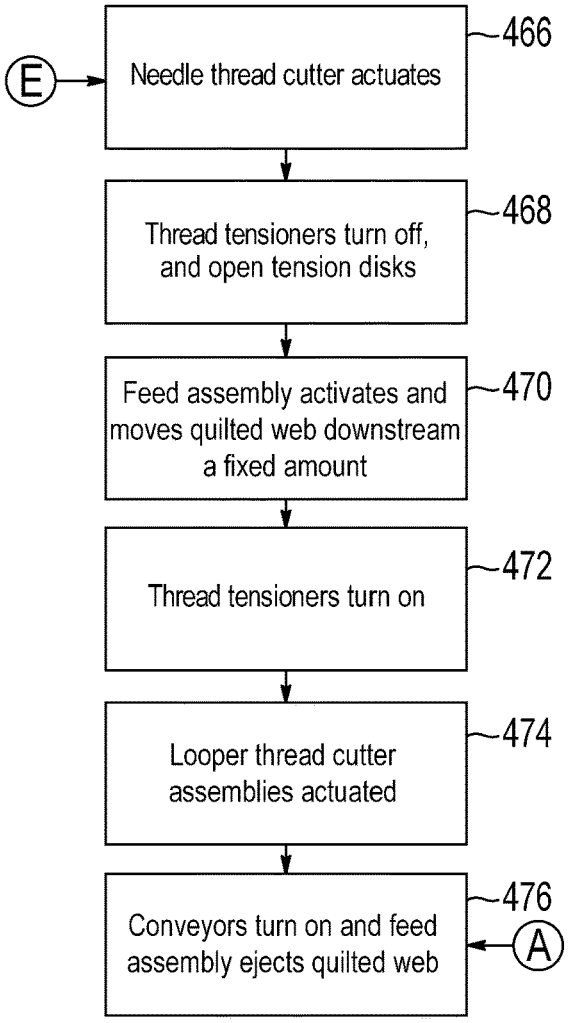

FIGS. 22A-22E show a flow chart illustrating the operation of the quilting machine. FIG. 22A shows a block 400 illustrating an operator turning on the machine by pushing a start button on a control panel (shown as block 504 in FIG. 23). Block 402 indicates that upon the start button being pushed the stack lights (not shown) turn from red to green indicating the quilting machine is turned on. These stack lights 401 are a safety feature which preferably are incorporated into the machine but may be omitted. Upon the machine 10 being turned on, the controller 50 activates the feed servo-motor 40 which rotates the drive pulley 48 which rotates the endless drive belt 72 which rotates the feed belts 80 of the feed assembly 38 at a staging speed. See FIG. 3. Block 404 indicates the feed belts 80 moving at a staging speed and the start of a timeout counter. Block 406 indicates that the controller 50 detects whether a leading edge of the input web 22 is detected within the time set by the timeout counter. If the leading edge of the input web 22 is not detected, the controller 50 turns the machine off, as indicated by block 408.

As indicated by block 410, if the leading edge of the input web 22 is detected, the controller 50 activates the feed servo-motor 40 which rotates the drive pulley 48 which rotates the endless drive belt 72 which rotates the feed belts 80 of the feed assembly 38 at a pre-programmed staging speed to move the input web 22 downstream at a staging speed until the input web is underneath the needles 120. As indicated by block 412, when the feed belts 80 of the feed assembly 38 are moving at the staging speed, a series of short stitches 530 are created. See FIG. 23. Typically, each of these short stiches 530 is less than 0.5 inch in length.

As indicated by block 414, when the input web 22 is stationary between incremental movements, the controller 50 activates the sewing servo-motor 130 of sewing assembly 122 which causes rotation of the endless drive belt 166 via the drive pulley 132. The endless drive belt 166 rotates the indexer pulley 168 which causes movement of the retainer bar 190 and attached spreaders 191 and oscillation of the looper shaft 188. Each rotation of the drive pulley 132 causes one rotation of cranks 156 which causes one rotation or cycle of the needle bar 160, attached needles 120 and hence needle axis NA of each needle 120. Each chain stitch created by the sewing assembly 122 is created by one rotation of the drive pulley 132 and cranks 156. After each chain stitch the controller 50 temporarily stops rotation of the drive pulley 132 of sewing assembly 122 by stopping the sewing servo-motor 130. When the sewing assembly is inactive, the controller 50 activates rotation of the drive pulley 48 of feed assembly 38 by activating the feed servo-motor 40 for a programmed time depending upon the desired travel distance of the input web 22 before the next stitch is started.

As indicated by blocks 416 and 418, if the desired stitch length is less than 0.5 inch, in other words, a short stitch 530 is desired, the looper thread tensioner 293 of a looper assembly 270 and the needle thread tensioner 292 of the corresponding needle assembly 268 are turned off during activation of the feed assembly 38 and downstream movement of the input web 22.

As indicated by blocks 416 and 420, if the desired stitch length is greater than 0.5 inch, in other words, a long stitch 532 is desired, the looper thread tensioner 293 of a looper assembly 270 and the needle thread tensioner 292 of the corresponding needle assembly 268 are turned on during activation of the feed assembly 38 and downstream movement of the input web 22.

As indicated by block 422, regardless of whether the looper thread tensioner 293 of a looper assembly 270 and the needle thread tensioner 292 of the corresponding needle assembly 268 are turned on, during the initial sewing period of a job, the feed assembly 38 moves the input web 22 and the sewing assembly 122 cooperate to create a condensed or short stitch length or short stitches 530.

As indicated by decision block 424, the controller 50 is programmed to stitch a certain number of short stitches 530 along a beginning period of a job and again at an ending period of a job. If less than the desired number of short stitches 530 have been completed, the controller 50 instructs the machine to sew another short stitch 530, as indicated by block 426. If the desired number of short stitches 530 have been completed, the controller 50 instructs the machine to sew a long stitch 532 by changing the distance the input web travels between stitches, as indicated by block 428.

As indicated by block 430, the controller 50 is programmed to stitch a certain number of long stitches 532 along a middle period of a job. Every rotation of the drive pulley 132 causes one rotation of cranks 156 which causes one rotation or cycle of the needle bar 160, attached needles 120 and needle axis NA of each needle 120. As indicated by decision block 432 and block 434, if the stitch length is greater than 0.5 inch, the looper thread tensioner 293 of a looper assembly 270 and the needle thread tensioner 292 of the corresponding needle assembly 268 are turned on during activation of the feed assembly 38 and downstream movement of the input web 22. As indicated by decision block 432 and block 436, if the stitch length is less than 0.5 inch, the looper thread tensioner 293 of a looper assembly 270 and the needle thread tensioner 292 of the corresponding needle assembly 268 are turned off during activation of the feed assembly 38 and downstream movement of the input web 22. The downstream movement of the input web 22 the programmed distance defining the stitch length is indicated by block 438.

As indicated by decision block 440 and block 442, if the leading edge sensor is blocked, the controller 50 operates the sewing assembly 122 to perform another stitch. As indicated by decision block 440 and block 444, if the leading edge sensor is not blocked the controller 50 changes the time between stitches, i.e. the downstream travel time of the input web 22 which fixes the stitch length.

As indicated by block 446, after the controller 50 changes the stitch length to a short stitch length, the drive pulley 132 is rotated one rotation, causing one full rotation of cranks 156 which causes one rotation or cycle of the needle bar 160, attached needles 120 and needle axis NA of each needle 120. This creates a short stitch at the tail end of the job.

As indicated by decision block 448 and block 454, if the stitch length is greater than 0.5 inch, the looper thread tensioner 293 of a looper assembly 270 and the needle thread tensioner 292 of the corresponding needle assembly 268 are turned on during activation of the feed assembly 38 and downstream movement of the input web 22. As indicated by decision block 448 and block 456, if the stitch length is less than 0.5 inch, the looper thread tensioner 293 of a looper assembly 270 and the needle thread tensioner 292 of the corresponding needle assembly 268 are turned off during activation of the feed assembly 38 and downstream movement of the input web 22. The downstream movement of the input web 22 the programmed distance defining the stitch length is indicated by block 458.

As indicated by decision block 460, the controller 50 is programmed to stitch a certain number of short stitches 530 along a beginning period of a job and again at an ending period of a job. If less than the desired number of short stitches 530 have been completed, the controller 50 instructs the machine to sew another short stitch 530, as indicated by block 462. If the desired number of short stitches 530 have been completed, the controller 50 instructs the machine to sew another short stitch 530, as indicated by block 464.

As indicated by the block 466, the needle thread cutting assembly 340 is activated, cutting all needle threads. As indicated at block 468, after the last short stitch 530 has been completed, the controller 50 turns off the needle thread tensioner 292 of each needle assembly 268 and the looper thread tensioner 293 of each looper assembly 270.

As indicated by the block 470, the feed assembly 38 is activated by the controller 50 to move the quilted panel 32 downstream. As indicated at block 472, after the controller 50 turns off the needle thread tensioner 292 of each needle assembly 268 and the looper thread tensioner 293 of each looper assembly 270. As indicated at block 474, the looper thread cutting assemblies 384 are activated by controller 50 to cut the looper threads 282. As indicated at block 476, the feed assembly 38 is activated for the last time, thereby ejected the completed quilted panel 32.

Figure 23:
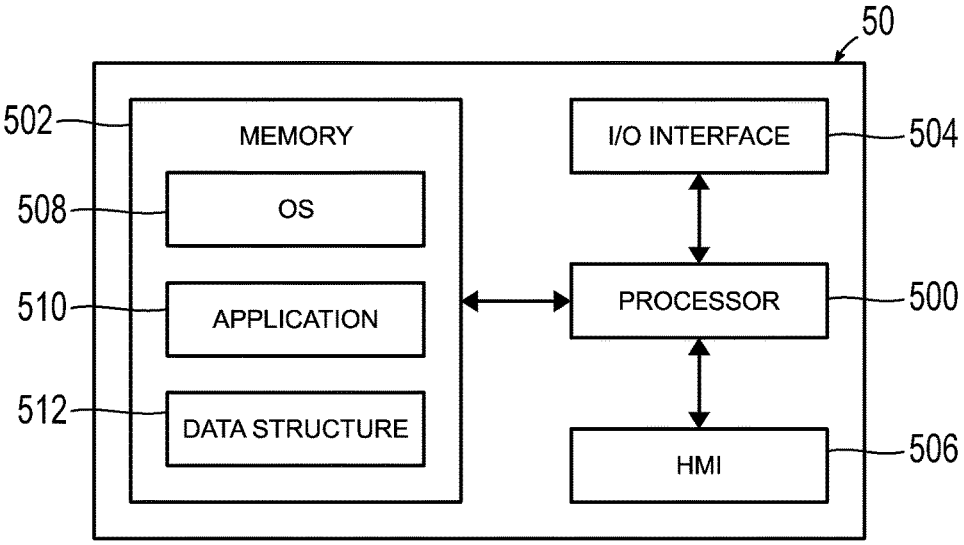
FIG. 23 is a diagrammatic view of an exemplary controller that may be used to execute the processes of FIGS. 22A-22E.

Referring now to FIG. 23, the controller 50 may include a processor 500, a memory 502, an input/output (I/O) interface 504, and a Human Machine Interface (HMI) 506. The processor 500 may include one or more devices configured to manipulate signals (analog or digital) based on operational instructions that are stored in memory 502. Memory 502 may include a single memory device or a plurality of memory devices including, but not limited to, read-only memory (ROM), random access memory (RAM), volatile memory, non-volatile memory, hard drives, optical storage, mass storage devices, or any other device capable of storing data.

The processor 500 may operate under the control of an operating system 508 that resides in memory 502. The operating system 508 may manage controller resources so that computer program code embodied as one or more computer software applications, such as a controller application 510 residing in memory 502, can have instructions executed by the processor 500. One or more data structures 512 may also reside in memory 502, and may be used by the processor 500, operating system 508, and/or controller application 510 to store data.

The I/O interface 504 operatively couples the processor 500 to the other components of the machine 10 and may also couple the processor 500 to an external computing system or network (not shown). The external computing system or network may be used, for example, to exchange data files, such as quilting patterns, updated applications, and/or other operational data, with controller 50 to update the controller 50 and/or collect data related to the operation of the quilting machine 10.

The I/O interface 504 may include signal processing circuits that condition or encode/decode incoming and outgoing signals so that the signals are compatible with both the processor 500 and the components to which the processor 500 is coupled. To this end, the I/O interface 504 may include analog to digital (A/D) and/or digital to analog (D/A) converters, voltage level and/or frequency shifting circuits, optical isolation and/or driver circuits, protocol stacks, solenoids, relays, pneumatic valves, and/or any other devices suitable for coupling the processor 500 to the other components of the machine 10 and/or an external computing system.

The HMI 506 may be operatively coupled to the processor 500 of controller 50 to enable a user to interact directly with the controller 50. The HMI 506 may include video or alphanumeric displays, a touch screen, a speaker, and any other suitable audio and visual indicators capable of providing data to the user. The HMI 506 may also include input devices and controls such as an alphanumeric keyboard, a pointing device, keypads, pushbuttons, control knobs, microphones, etc., capable of accepting commands or input from the user and transmitting the entered input to the processor 500.

In general, the routines executed to implement the embodiments of the invention, whether implemented as part of an operating system or a specific application, component, program, object, module or sequence of instructions, or a subset thereof, may be referred to herein as "computer program code," or simply "program code." Program code typically comprises computer-readable instructions that are resident at various times in various memory and storage devices in a computer and that, when read and executed by one or more processors in a computer, cause that computer to perform the operations necessary to execute operations and/or elements embodying the various aspects of the embodiments of the invention. Computer-readable program instructions for carrying out operations of the embodiments of the invention may be, for example, assembly language or either source code or object code written in any combination of one or more programming languages.

Various program code described herein may be identified based upon the application within which it is implemented in specific embodiments of the invention. However, it should be appreciated that any particular program nomenclature which follows is used merely for convenience, and thus the invention should not be limited to use solely in any specific application identified and/or implied by such nomenclature. Furthermore, given the generally endless number of manners in which computer programs may be organized into routines, procedures, methods, modules, objects, and the like, as well as the various manners in which program functionality may be allocated among various software layers that are resident within a typical computer (e.g., operating systems, libraries, API's, applications, applets, etc.), it should be appreciated that the embodiments of the invention are not limited to the specific organization and allocation of program functionality described herein.

The program code embodied in any of the applications/modules described herein is capable of being individually or collectively distributed as a program product in a variety of different forms. In particular, the program code may be distributed using a computer-readable storage medium having computer-readable program instructions thereon for causing a processor to carry out aspects of the embodiments of the invention.

Computer-readable storage media, which is inherently non-transitory, may include volatile and non-volatile, and removable and non-removable tangible media implemented in any method or technology for storage of data, such as computer-readable instructions, data structures, program modules, or other data. Computer-readable storage media may further include RAM, ROM, erasable programmable read-only memory (EPROM), electrically erasable programmable read-only memory (EEPROM), flash memory or other solid state memory technology, portable compact disc read-only memory (CD-ROM), or other optical storage, magnetic cassettes, magnetic tape, magnetic disk storage or other magnetic storage devices, or any other medium that can be used to store the desired data and which can be read by a computer. A computer-readable storage medium should not be construed as transitory signals per se (e.g., radio waves or other propagating electromagnetic waves, electromagnetic waves propagating through a transmission media such as a waveguide, or electrical signals transmitted through a wire). Computer-readable program instructions may be downloaded to a computer, another type of programmable data processing apparatus, or another device from a computer-readable storage medium or to an external computer or external storage device via a network.

Computer-readable program instructions stored in a computer-readable medium may be used to direct a computer, other types of programmable data processing apparatuses, or other devices to function in a particular manner, such that the instructions stored in the computer-readable medium produce an article of manufacture including instructions that implement the functions, acts, and/or operations specified in the flow-charts, sequence diagrams, and/or block diagrams. The computer program instructions may be provided to one or more processors of a general purpose computer, a special purpose computer, or other programmable data processing apparatus to produce a machine, such that the instructions, which execute via the one or more processors, cause a series of computations to be performed to implement the functions, acts, and/or operations specified in the flow-charts, sequence diagrams, and/or block diagrams.

In certain alternative embodiments, the functions, acts, and/or operations specified in the flow-charts, sequence diagrams, and/or block diagrams may be re-ordered, processed serially, and/or processed concurrently consistent with embodiments of the invention. Moreover, any of the flow-charts, sequence diagrams, and/or block diagrams may include more or fewer blocks than those illustrated consistent with embodiments of the invention.

FIG. 24 illustrates the quilted panel 32 exiting the machine 10. The quilted panel 32 has two end surfaces 520, the linear distance between which defines the longitudinal dimension or length "L" of the quilted panel 32. The quilted panel 32 has two side surfaces 522, the linear distance between which defines the transverse dimension or width "W" of the quilted panel 32. As shown in FIGS. 24 and 25, the quilted panel 32 has an upper layer 524 having a uniform height H1 comprising the piece 24 of the input web 22, a middle layer 526 having a uniform height H2 comprising the piece 26 of input web 22 and a lower layer 528 having a uniform height H3 comprising the piece 28 of the input web 22. Each of the layers 524, 526, 528 may be made of any known material including any known foam or fiber material or combination thereof. Alternatively, any of the layers 524, 526, 528 may be made of the same material in different densities. FIGS. 1, 24 and 25 illustrate multiple spaced stitch lines 34 extending parallel the side surfaces 522 of the quilted panel 32 and extending in the longitudinal direction.

Each of the stitch lines 34 is identical and made up of chain stitches 530, 532. It is within the scope of the present invention that any of the stitch lines of any of the embodiments shown or described herein may have any number of different chain stitches of any desired length or may comprise chain stitches of the same length as described below. For example, short chain stitches may be on opposite sides of long chain stitches in the stitch lines or versa visa.

FIG. 25 best illustrates short and long chain stitches 530, 532, respectively, of stitch lines 34 holding the layers 524, 526, 528 of the quilted panel 32 together. Each of the stitch lines 34 comprises multiple short chain stitches 530 comprising an end section 534 at each end of the quilted panel 32. Each of the stitch lines 34 further comprises multiple long chain stitches 532 comprising a middle section 536 between the end sections 534 of each stitch line 34 of the quilted panel 32.

As best shown in FIG. 11, each chain stitch, shown as short chain stitches 530 comprises two sides 540, a top 542 and a bottom 544. Each side 540 comprises one section 546 of a needle thread 284. The side 540 of one chain stitch 530 abuts the side of an adjacent chain stitch 530, except for the outermost side of each outermost short chain stitch 530. As best seen in FIGS. 11 and 25, the top 542 of each chain stitch 530, comprises a single section 550 of needle thread 284 which extends across an upper surface 552 of the quilted panel 32. The bottom 544 of each chain stitch 530 comprises two portions, a short portion 545 comprising three sections 556 of looper thread 288 and a long portion 547 comprising one section 549 of looper thread 288 and two sections 554 of needle thread 284. Each of the short and long portions 545, 547 of the bottom 544 of each chain stitch 530 extends below a lower surface 560 of the quilted panel 32. Although FIG. 11 illustrates short chain stitches 530, the composition of the chain stitch is the same regardless of the size/length of the chain stitch.

The linear distance between the opposed sides 540 of a long chain stitch 532 is greater than the linear distance between the opposed sides 540 of a short chain stitch 530. Similarly, the length of the top 542 and bottom 544 of a long chain stitch 532 is greater than the length of the top 542 and bottom 544 of a short chain stitch 530.

Figure 26:
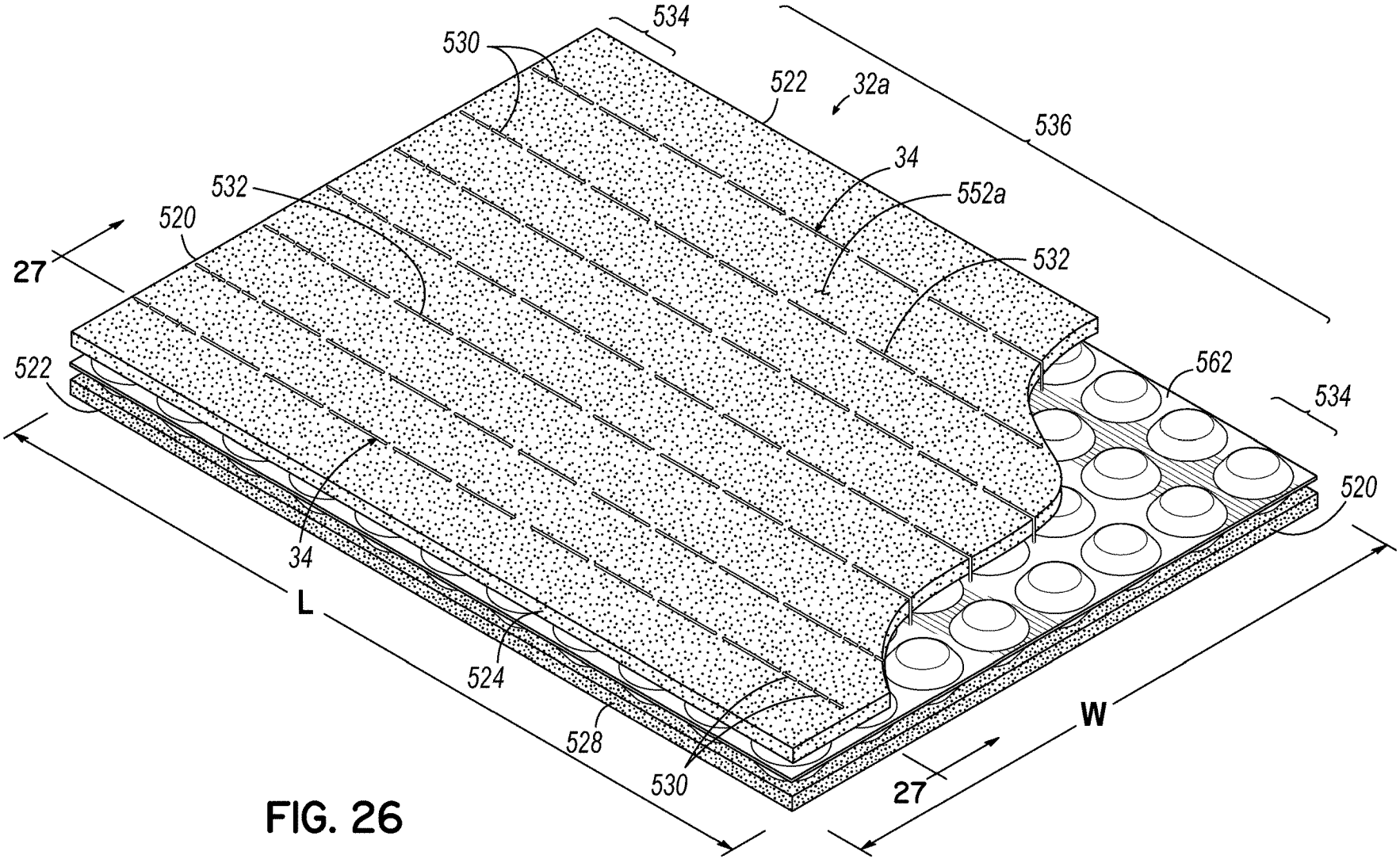
FIG. 26 is a perspective view of an alternative quilted panel resulting from the method of using the quilting machine of the present invention.
Figure 27:
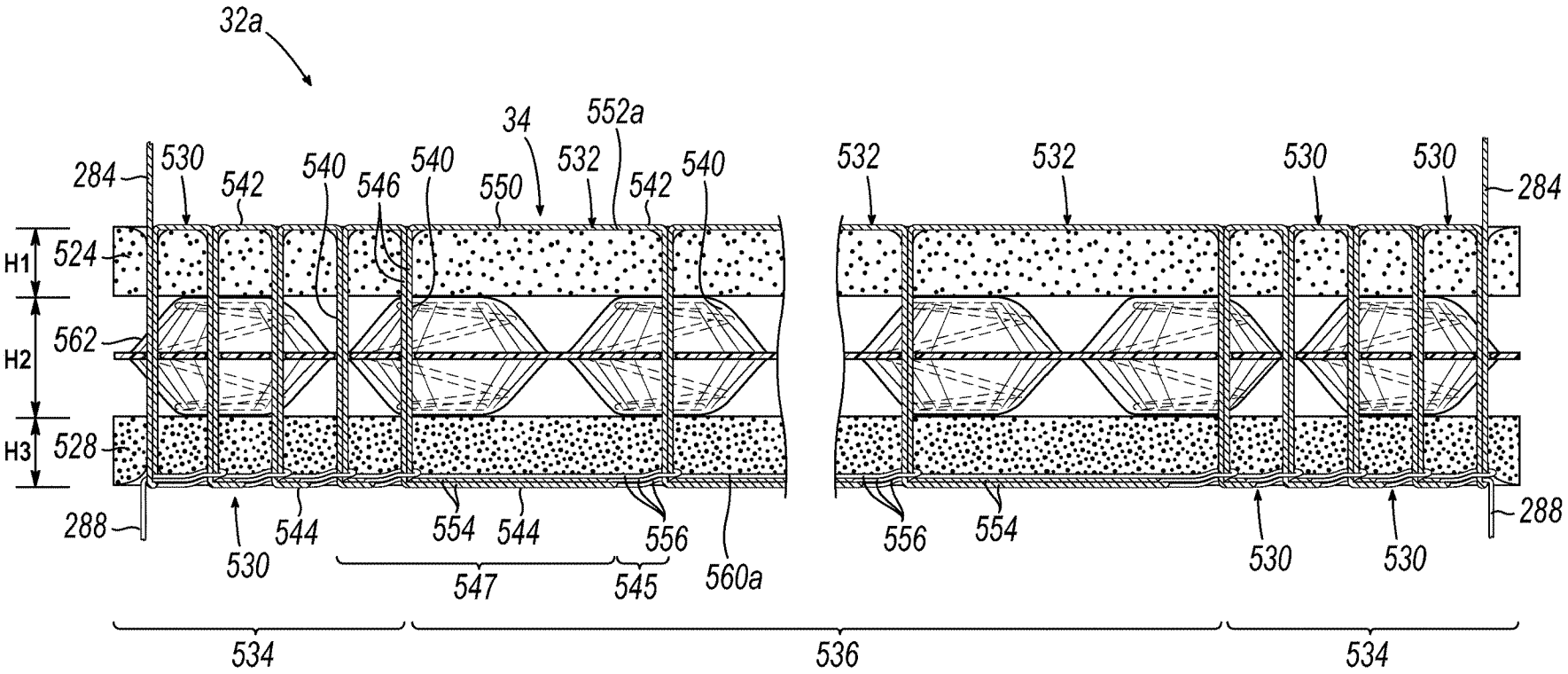
FIG. 27 is a cross-sectional view taken along the line 27-27 of FIG. 26.

FIGS. 26 and 27 illustrate an alternative quilted panel 32*a* comprising a pocketed spring layer 562 sandwiched between upper layer 524 (same as in quilted panel 32) and lower layer 528 (same as in quilted panel 32). The stitch lines 34 extend longitudinally between rows of pocketed springs as seen in FIG. 26. The chain stitches 530, 532 of stitch lines 34 holding the layers 524, 562, 528 of the quilted panel 32*a* together are the same as in the quilted panel 32, so for simplicity like numbers are used. The quilted panel 32 has an upper surface 552*a* and a lower surface 560*a*. Layers 524, 528 may be made of any known material including any known foam or fiber material or combination thereof. Alternatively, the layers 524, 528 may be made of the same material in different densities.

Figure 28:
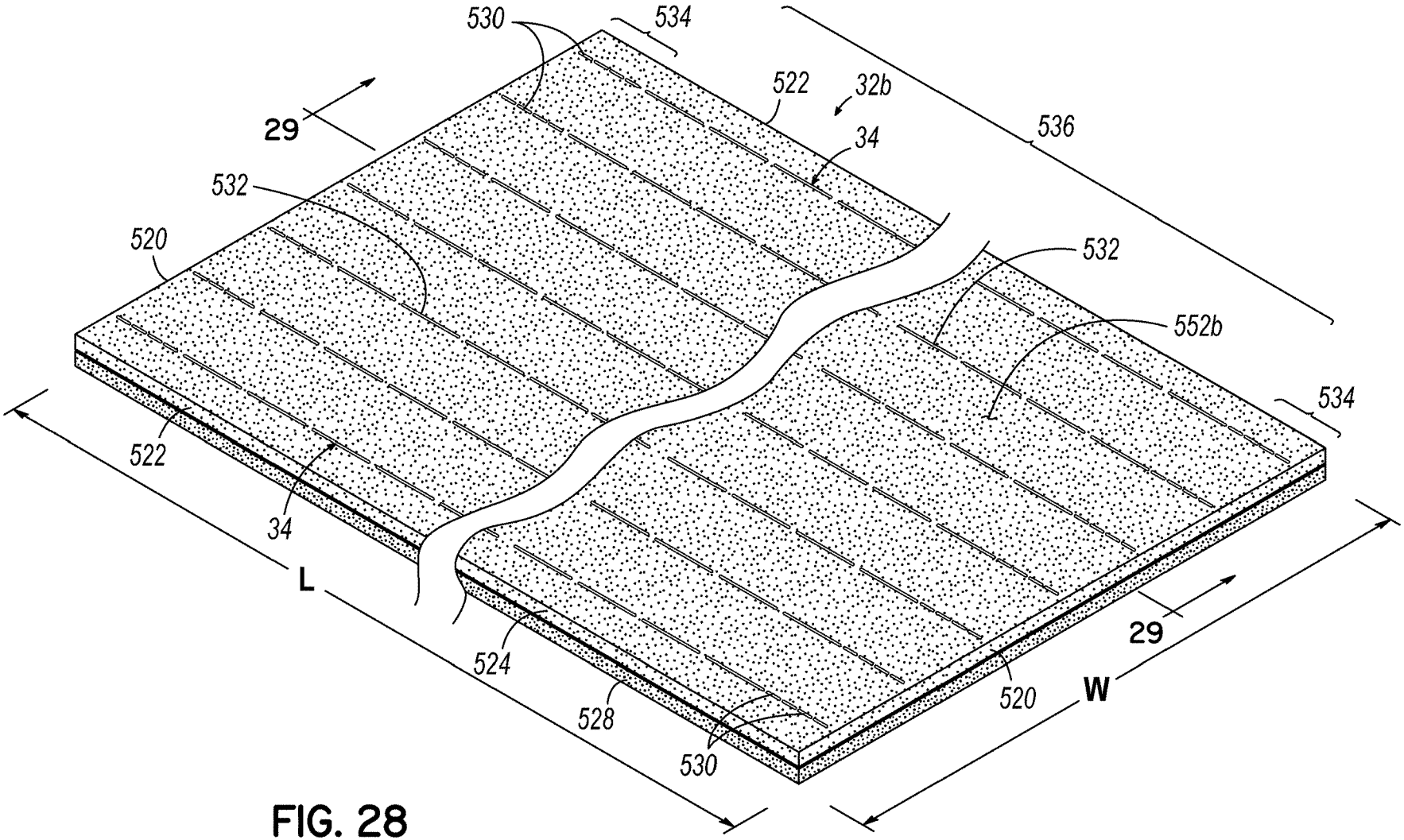
FIG. 28 is a perspective view of an alternative quilted panel resulting from the method of using the quilting machine of the present invention.
Figure 29:
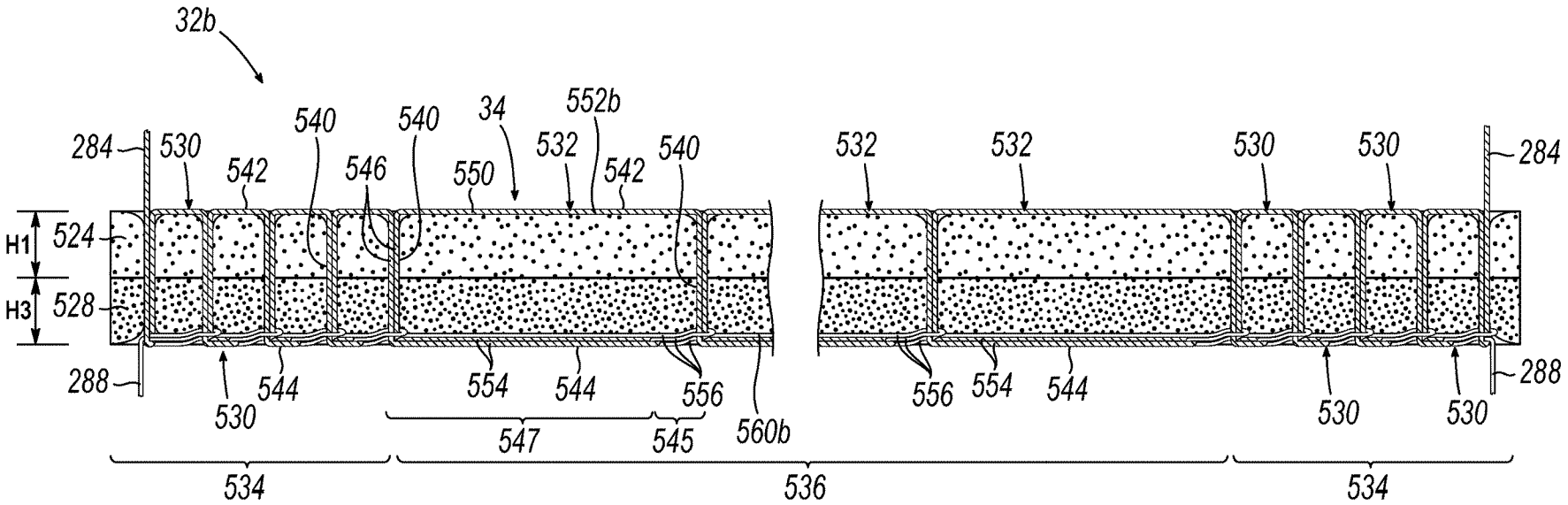
FIG. 29 is a cross-sectional view taken along the line 29-29 of FIG. 28.

FIGS. 28 and 29 illustrate an alternative quilted panel 32*b* comprising only two lofted layers: upper layer 524 (same as in quilted panel 32) and lower layer 528 (same as in quilted panel 32). The chain stitches 530, 532 of stitch lines 34 holding the layers 524, 528 of the quilted panel 32*b* together are the same as in the quilted panel 32, so for simplicity like numbers are used. The quilted panel 32*b* has an upper surface 552*b* and a lower surface 560*b*. Each of the layers 524, 528 may be made of any known material including any known foam or fiber material or combination thereof. Alternatively, any of the layers 524, 528 may be made of the same material in different densities.

Figure 30:
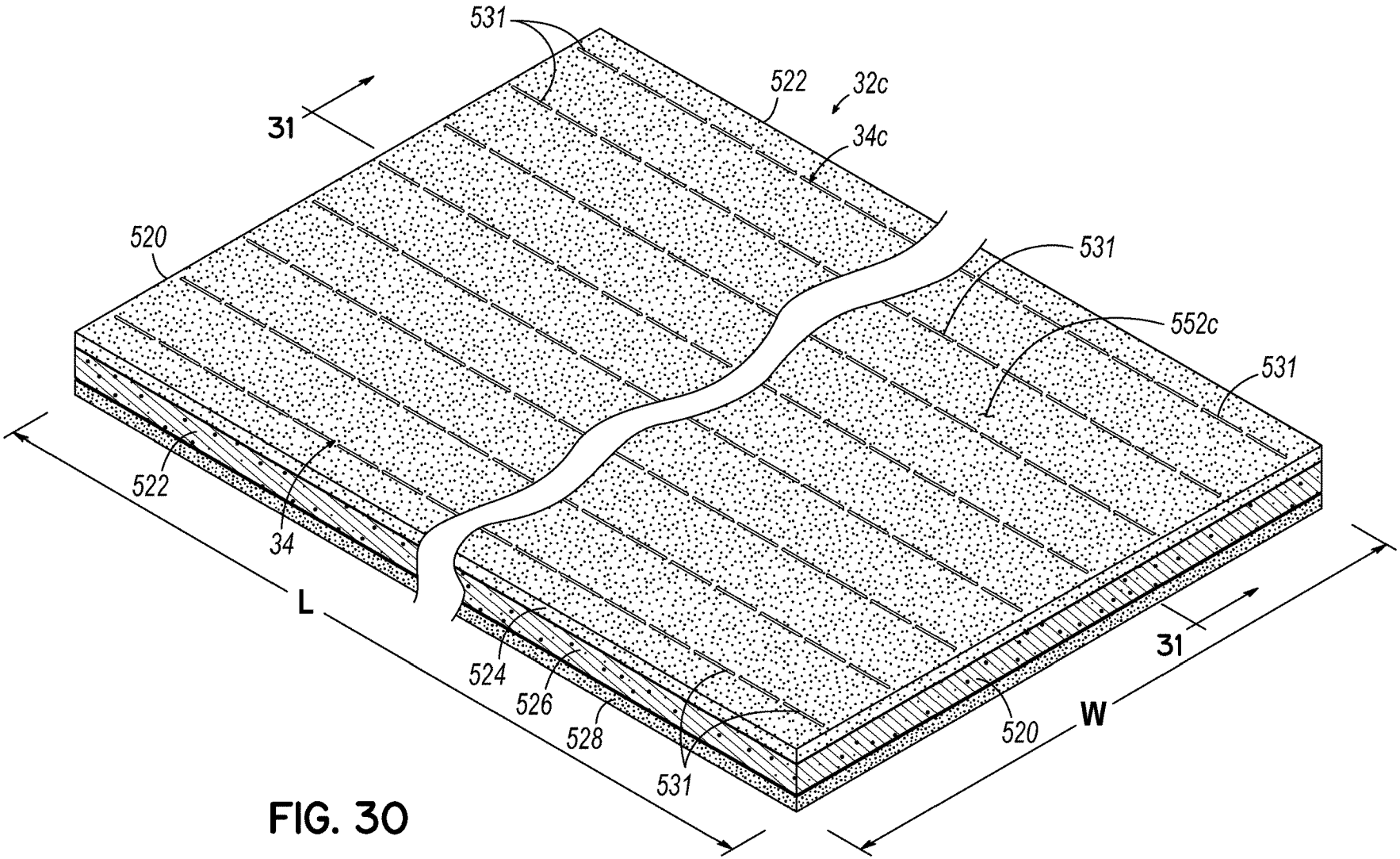
FIG. 30 is a perspective view of an alternative quilted panel resulting from the method of using the quilting machine of the present invention.
Figure 31:
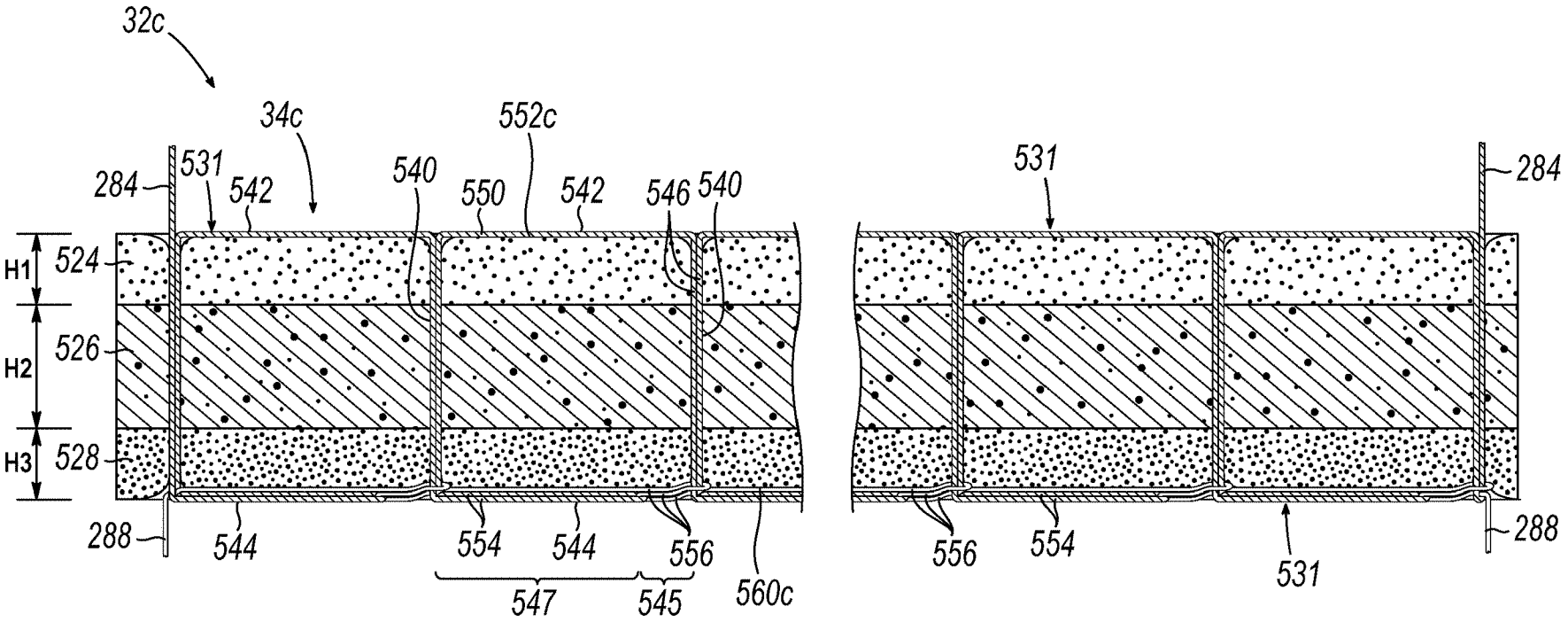
FIG. 31 is a cross-sectional view taken along the line 31-31 of FIG. 30.

FIGS. 30 and 31 illustrate an alternative quilted panel 32*c* comprising the same three lofted layers as in the quilted panel 32: an upper layer 524, a middle layer 526 and a lower layer 528. In this embodiment each of the spaced stitch lines 34*c* comprises chain stitches 531 of the same length holding the layers 524, 526, 528 of the quilted panel 32*c* together. For simplicity like numbers are used. The quilted panel 32*c* has an upper surface 552*c* and a lower surface 560*c*. Although FIGS. 30 and 31 illustrate chain stitches 531 of a particular length, the drawings are not intended to be limiting. The length of the chain stitches may be any desired length throughout the stitch lines of the quilted panel.

Figure 32:
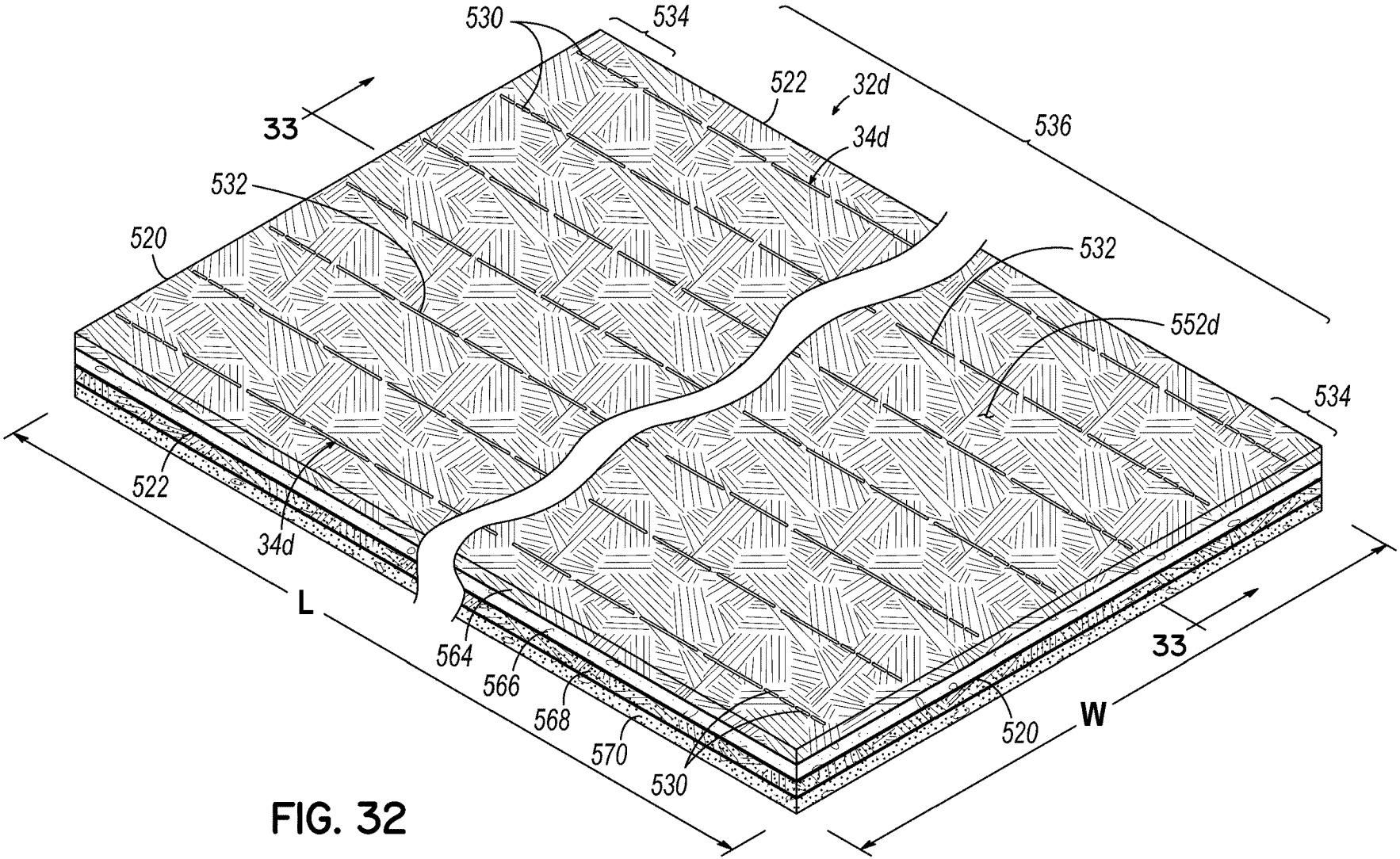
FIG. 32 is a perspective view of an alternative quilted panel resulting from the method of using the quilting machine of the present invention.
Figure 33:
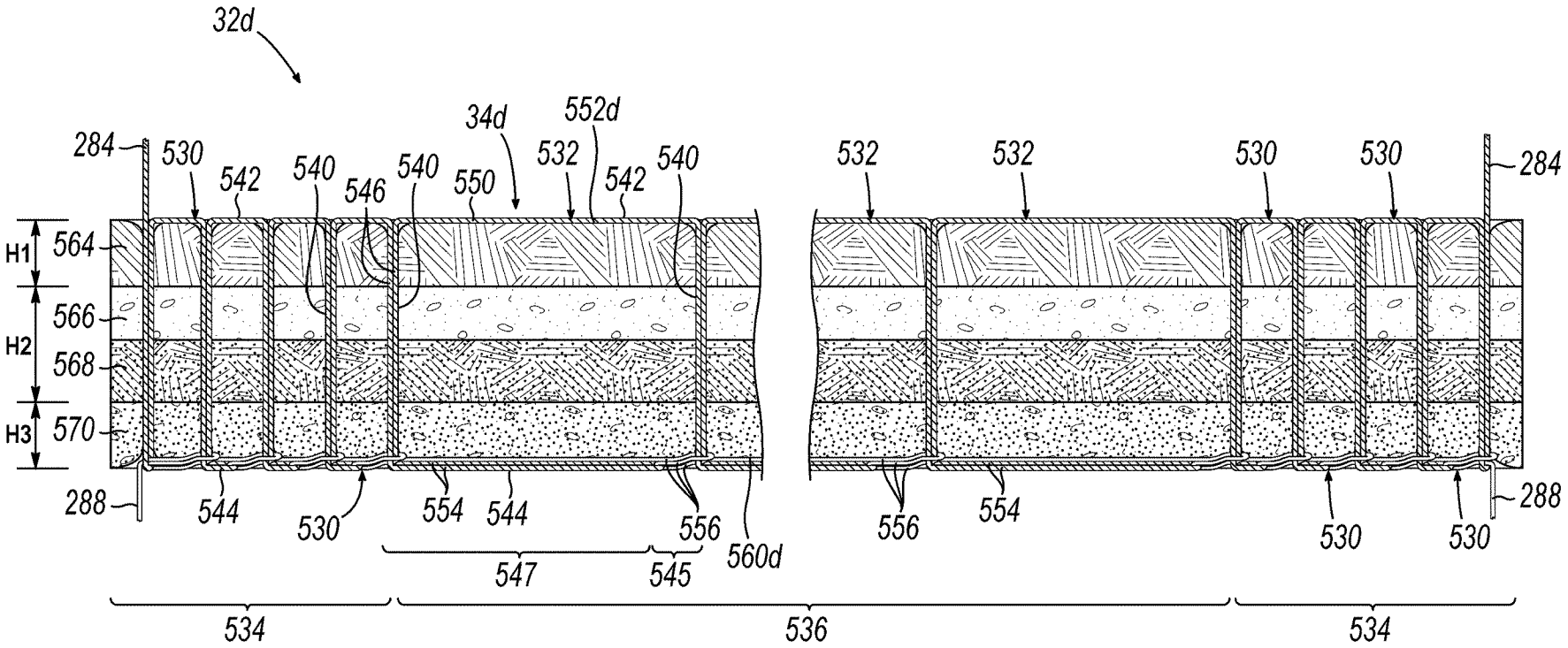
FIG. 33 is a cross-sectional view taken along the line 32-32 of FIG. 31.

FIGS. 32 and 33 illustrate an alternative quilted panel 32*d* comprising four lofted fiber layers: an upper layer 564, an upper middle layer 566 and a lower middle layer 568 and a lower layer 570. In this embodiment each of the spaced stitch lines 34*d* comprises short and long chain stitches 530, 532 of different lengths holding the layers 564, 566, 568 and 570 of the quilted panel 32*d* together. For simplicity like numbers are used. The quilted panel 32*d* has an upper surface 552*d* and a lower surface 560*d*. Although FIGS. 32 and 33 illustrate chain stitches 530, 532 of a particular length, the drawings are not intended to be limiting. The length of the chain stitches may be any desired length throughout the stitch lines of the quilted panel.

Although the embodiment of FIGS. 30 and 31 is the only embodiment illustrated having spaced stitch lines comprising chain stitches of the same length, any of the quilted panels shown as described herein, regardless of the composition of all or any of the layers, may have spaced stitch lines each comprising chain stitches of the same length.

The terminology used herein is for the purpose of describing particular embodiments only and is not intended to be limiting of the embodiments of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, actions, steps, operations, elements, and/or components, but do not preclude the presence or addition of one or more other features, integers, actions, steps, operations, elements, components, and/or groups thereof. Furthermore, to the extent that the terms "includes", "having", "has", "with", "comprised of", or variants thereof are used in either the detailed description or the claims, such terms are intended to be inclusive in a manner similar to the term "comprising".

While all the invention has been illustrated by a description of various embodiments and while these embodiments have been described in considerable detail, it is not the intention of the Applicant to restrict or in any way limit the scope of the appended claims to such detail. Additional advantages and modifications will readily appear to those skilled in the art. The invention in its broader aspects is therefore not limited to the specific details, representative apparatus and method, and illustrative examples shown and described. Accordingly, departures may be made from such details without departing from the spirit or scope of the Applicant's general inventive concept.

What is claimed is:

1. A method of quilting a layered input web, the method comprising:

providing a quilting machine including a sewing assembly powered by a first servo motor and a feed assembly powered by a second servo motor;

moving the layered input web through the quilting machine using the feed assembly;

forming chain stitches in the layered input web without compressing the layered input web using the sewing assembly, wherein a controller activates the feed assembly for a programmed time when the sewing assembly is inactive to move the layered input web a desired travel distance.

2. The method of claim 1 wherein the sewing assembly includes a drive pulley which completes one chain stitch per each rotation of the drive pulley.

3. The method of claim 2 wherein the drive pulley of the sewing assembly rotates an endless drive belt which reciprocates a needle bar to which sewing needles are secured, oscillates a looper shaft and reciprocates a retainer bar.

4. The method of claim 3 wherein the looper shaft and retainer bar are driven by an indexer assembly.

5. The method of claim 3 wherein the looper shaft and retainer bar are stationary during a portion of one rotation of the drive pulley of the sewing assembly.

6. The method of claim 5 wherein the needle bar completes one cycle for each rotation of the drive pulley of the sewing assembly.

7. The method of claim 3 wherein the needle bar continuously moves during each rotation of the drive pulley of the sewing assembly.

8. The method of claim 1 wherein the feed assembly rotates a drive pulley by activating a feed servo-motor for the programmed time.

9. The method of claim 1 wherein the feed assembly includes a drive pulley rotated by an endless belt.

10. A method of quilting a layered input web, the method comprising:

providing a quilting machine including a feed assembly and a sewing assembly;

powering the sewing assembly with a first servo motor to form chain stitches in the layered input web using needle threads and looper threads without compressing the layered input web, powering the feed assembly with a second servo motor to move a stack of lofted materials through the quilting machine a fixed distance when the sewing assembly is inactive, wherein the fixed distance may be changed by a programmable controller.

11. The method of claim 10 wherein the first servo motor powers a first drive pulley which rotates a first endless drive belt to operate the sewing assembly.

12. The method of claim 10 wherein second servo motor powers a second drive pulley which rotates a second endless drive belt to operate the feed assembly.

13. The method of claim 10 wherein one rotation of the first drive pulley causes one chain stitch.

14. The method of claim 10 wherein the layered input web passes between a platen and a needle plate having aligned holes therein.

15. The method of claim 14 further comprising cutting the needle threads with a needle thread cutting assembly secured to the platen and cutting the looper threads with looper thread cutting assemblies secured to the needle plate.

16. The method of claim 10 further comprising applying a desired degree of tension to the needle threads and the looper threads using the programmable controller.

17. A method of quilting a layered input web, the method comprising:

providing a quilting machine having a feed assembly and a sewing assembly;

powering the sewing assembly with a first servo motor to move a needle bar with a crank assembly, loopers and spreaders with an indexer assembly to form chain stitches in the layered input web using needle threads and looper threads without compressing the layered input web; and powering the feed assembly with a second servo motor to move the layered input web through the quilting machine a distance determined by a programmable controller when the sewing assembly is inactive.

18. The method of claim 10 wherein one rotation of the first drive pulley causes one chain stitch in each of multiple stitch lines.

19. The method of claim 10 wherein the layered input web passes between a platen and a needle plate having aligned holes therein.

20. The method of claim 19 further comprising cutting the needle threads with a needle thread cutting assembly secured to the platen and cutting the looper threads with looper thread cutting assemblies secured to the needle plate.

* * * * *